US007028654B2

(12) United States Patent
Mandal et al.

(10) Patent No.: US 7,028,654 B2
(45) **Date of Patent: *Apr. 18, 2006**

(54) METERING SOCKET

(75) Inventors: Dhruva Mandal, Vernon Hills, IL (US); Carroll Williams, Pocahontas, AR (US)

(73) Assignee: The MacLean-Fogg Company, Mundelein, IL (US)

( * ) Notice: Subject to any disclaimer, the term of this patent is extended or adjusted under 35 U.S.C. 154(b) by 263 days.

This patent is subject to a terminal disclaimer.

(21) Appl. No.: 10/316,262

(22) Filed: Oct. 18, 2002

(65) Prior Publication Data

US 2004/0074463 A1 Apr. 22, 2004

(51) Int. Cl.
*F01L 1/14* (2006.01)

(52) U.S. Cl. ..... 123/90.52; 123/90.48; 123/90.45

(58) Field of Classification Search ..... 123/90.45, 123/90.48, 90.52, 90.43, 90.46, 90.61, 90.63; 483/114, 165

See application file for complete search history.

(56) References Cited

U.S. PATENT DOCUMENTS

| | | | |
|---|---|---|---|
| 188,764 | A | 3/1877 | Adams |
| 626,594 | A | 6/1899 | Chapman |
| 703,838 | A | 7/1902 | Scobee |
| 794,683 | A | 7/1905 | Riotte |
| 872,598 | A | 12/1907 | Watts et al. |
| 948,248 | A | 1/1910 | Reaugh |
| 992,089 | A | 5/1911 | Watt |
| 993,875 | A | 5/1911 | Richards et al. |
| 1,000,722 | A | 8/1911 | Danver |
| 1,001,265 | A | 8/1911 | Graham |
| 1,061,700 | A | 5/1913 | Steinbecker |
| 1,066,069 | A | 7/1913 | D'Arcy |
| 1,080,733 | A | 12/1913 | Thomson |
| 1,084,514 | A | 1/1914 | Whitlock |
| 1,101,935 | A | 6/1914 | Jacobs et al. |
| 1,129,555 | A | 2/1915 | Curran |
| 1,198,115 | A | 9/1916 | De La Bar |
| 1,210,871 | A | 1/1917 | Suffa |
| 1,220,380 | A | 3/1917 | Turner |
| 1,245,552 | A | 11/1917 | Becket |
| 1,246,343 | A | 11/1917 | Snadecki |
| 1,247,366 | A | 11/1917 | Brockway |
| 1,252,692 | A | 1/1918 | Harris |
| 1,254,227 | A | 1/1918 | Huber |
| 1,292,312 | A | 6/1919 | Gronkwist |
| 1,331,787 | A | 2/1920 | Schlatter |
| 1,336,447 | A | 4/1920 | Suffa |

(Continued)

OTHER PUBLICATIONS

Print, Apr. 30, 1986, 02979.
Prints, Feb. 12, 1986, 02983–02984.
"GM Displacement on Demand," Jim Kerr, Canadian Driver, Oct. 25, 2002, 01468–01469.

(Continued)

*Primary Examiner*—Thomas Denion
*Assistant Examiner*—Ching Chang
(74) *Attorney, Agent, or Firm*—Dana Andrew Alden

(57) ABSTRACT

The present invention relates to an assembly, comprising a socket body including a forgeable material and provided with an outer socket surface, a first socket surface, and a second socket surface, wherein the outer socket surface is configured to cooperate with the inner surface of an engine workpiece, the first socket surface includes a push rod cooperating surface, and the second socket surface includes a plunger reservoir passage configured to conduct fluid and a curved socket surface that is configured to cooperate with a leakdown plunger.

22 Claims, 66 Drawing Sheets

U.S. PATENT DOCUMENTS

| | | | |
|---|---|---|---|
| 1,350,989 | A | 8/1920 | Cox |
| 1,354,852 | A | 10/1920 | Schneider |
| 1,358,459 | A | 11/1920 | Pache |
| 1,363,398 | A | 12/1920 | Davids |
| 1,374,059 | A | 4/1921 | Church |
| 1,377,866 | A | 5/1921 | White |
| 1,409,625 | A | 3/1922 | Vosbrink |
| 1,409,878 | A | 3/1922 | Mainland |
| 1,410,771 | A | 3/1922 | Strohl |
| 1,422,698 | A | 7/1922 | Pagé |
| 1,427,111 | A | 8/1922 | Knudsen |
| 1,461,560 | A | 7/1923 | Rich |
| 1,475,557 | A | 11/1923 | Albrecht |
| 1,479,735 | A | 1/1924 | Page |
| 1,515,201 | A | 11/1924 | Hewitt |
| 1,537,529 | A | 5/1925 | Enberg |
| 1,543,438 | A | 6/1925 | Hutt |
| 1,573,962 | A | 2/1926 | Charnock |
| 1,582,883 | A | 4/1926 | Rich |
| 1,594,471 | A | 8/1926 | Short |
| 1,605,494 | A | 11/1926 | Anderson |
| 1,607,128 | A | 11/1926 | Johansen |
| 1,613,012 | A | 1/1927 | Baker |
| 1,623,826 | A | 4/1927 | Burleson |
| 1,674,310 | A | 6/1928 | Topping |
| 1,728,149 | A | 9/1929 | Berne |
| 1,735,695 | A | 11/1929 | Rich |
| 1,741,093 | A | 12/1929 | Briggs |
| 1,741,230 | A | 12/1929 | Goodwin |
| 1,748,086 | A | 2/1930 | Small |
| 1,784,257 | A | 12/1930 | Thomas |
| 1,797,105 | A | 3/1931 | Shoblom |
| 1,798,738 | A | 3/1931 | Hoern |
| 1,798,938 | A | 3/1931 | Hallett |
| 1,820,299 | A | 8/1931 | Church |
| 1,834,285 | A | 12/1931 | Loeffler |
| 1,835,622 | A | 12/1931 | Willgoos |
| 1,844,021 | A | 2/1932 | Stewart |
| 1,847,312 | A | 3/1932 | Seufert |
| 1,848,083 | A | 3/1932 | Wetherald |
| 1,899,251 | A | 2/1933 | Zerk |
| 1,907,506 | A | 5/1933 | Coburn |
| 1,915,867 | A | 6/1933 | Penick |
| 1,930,261 | A | 10/1933 | Berry |
| 1,930,368 | A | 10/1933 | Nelson |
| 1,930,568 | A | 10/1933 | Short |
| 1,956,014 | A | 4/1934 | Fink et al. |
| 1,962,057 | A | 6/1934 | Clutterbuck |
| 1,968,982 | A | 8/1934 | Baranaby et al. |
| 1,971,083 | A | 8/1934 | Schlaa |
| 1,977,778 | A | 10/1934 | Rice |
| 1,985,447 | A | 12/1934 | Grubbs |
| 2,000,635 | A | 5/1935 | Edwards |
| 2,002,196 | A | 5/1935 | Ucko |
| 2,015,991 | A | 10/1935 | Breeler |
| 2,019,138 | A | 10/1935 | Kliesrath et al. |
| 2,019,252 | A | 10/1935 | Cottingham |
| 2,027,406 | A | 1/1936 | Spatta |
| 2,036,936 | A | 4/1936 | Halford |
| 2,051,415 | A | 8/1936 | Payson |
| 2,053,743 | A | 9/1936 | Russell |
| 2,055,341 | A | 9/1936 | Dyer |
| 2,067,114 | A | 1/1937 | Ashton |
| 2,071,051 | A | 2/1937 | Van Ranst |
| 2,071,719 | A | 2/1937 | Wurtele |
| 2,073,178 | A | 2/1937 | Rich |
| 2,081,390 | A | 5/1937 | Trapp |
| 2,089,478 | A | 8/1937 | Heiss |
| 2,091,451 | A | 8/1937 | Phillips |
| 2,091,674 | A | 8/1937 | Dostal |
| 2,091,413 | A | 10/1937 | Hurst et al. |
| 2,098,115 | A | 11/1937 | Voorhies |
| 2,107,456 | A | 2/1938 | Trapp |
| 2,109,815 | A | 3/1938 | Best |
| 2,114,655 | A | 4/1938 | Leibing |
| 2,116,749 | A | 5/1938 | Daisley |
| 2,117,434 | A | 5/1938 | Krebs |
| 2,120,389 | A | 6/1938 | Bettison |
| 2,127,245 | A | 8/1938 | Breeler |
| 2,131,948 | A | 10/1938 | Graham |
| 2,142,224 | A | 1/1939 | Turlay |
| 2,151,832 | A | 3/1939 | Bugatti |
| 2,154,494 | A | 4/1939 | Corlett |
| 2,163,969 | A | 6/1939 | Whalen |
| 2,166,968 | A | 7/1939 | Rohlin |
| 2,174,526 | A | 10/1939 | Parker |
| 2,175,466 | A | 10/1939 | Johnson |
| 2,179,354 | A | 11/1939 | Scott |
| 2,185,991 | A | 1/1940 | Voorhies et al. |
| 2,187,008 | A | 1/1940 | Baxter |
| 2,199,096 | A | 7/1940 | Berglund |
| 2,207,324 | A | 7/1940 | L'Orange |
| 2,209,479 | A | 7/1940 | Spencer |
| 2,227,127 | A | 12/1940 | Dillström |
| 2,247,278 | A | 6/1941 | Daisley |
| 2,247,299 | A | 6/1941 | Klavik |
| 2,250,011 | A | 7/1941 | Dayton |
| 2,250,814 | A | 7/1941 | Rohlin |
| 2,272,074 | A | 2/1942 | Voorhies |
| 2,280,753 | A | 4/1942 | Essl |
| 2,308,858 | A | 1/1943 | Burkhardt |
| 2,309,740 | A | 2/1943 | Voorhies |
| 2,319,546 | A | 5/1943 | Insley et al. |
| 2,322,172 | A | 6/1943 | Spencer |
| 2,322,173 | A | 6/1943 | Spencer |
| 2,322,174 | A | 6/1943 | Spencer |
| 2,322,195 | A | 6/1943 | Mock |
| 2,324,322 | A | 7/1943 | Reese et al. |
| 2,339,238 | A | 1/1944 | Buckley |
| 2,344,285 | A | 3/1944 | Cormode |
| 2,346,737 | A | 5/1944 | Essl |
| 2,349,203 | A | 5/1944 | Spencer |
| 2,356,900 | A | 8/1944 | Voorhies |
| 2,381,339 | A | 8/1945 | Doman |
| 2,385,309 | A | 9/1945 | Spencer |
| 2,386,317 | A | 10/1945 | Jenny et al. |
| 2,392,933 | A | 1/1946 | Mallory |
| 2,394,738 | A | 2/1946 | Anthony |
| 2,405,927 | A | 8/1946 | Tornblom |
| 2,408,325 | A | 9/1946 | Luce et al. |
| 2,410,411 | A | 11/1946 | Gregory |
| 2,434,386 | A | 1/1948 | Bradshaw |
| 2,435,727 | A | 2/1948 | Spencer |
| 2,438,631 | A | 3/1948 | Bergmann |
| 2,443,999 | A | 6/1948 | Wright |
| 2,451,395 | A | 10/1948 | Klukan |
| 2,483,779 | A | 10/1949 | Mucher |
| 2,485,760 | A | 10/1949 | Millis et al. |
| 2,494,128 | A | 1/1950 | Holmquist et al. |
| 2,508,557 | A | 5/1950 | Wood, Jr. |
| 2,516,775 | A | 7/1950 | Johansen |
| 2,518,272 | A | 8/1950 | Beckwith |
| 2,522,326 | A | 9/1950 | Winter, Jr. |
| 2,526,239 | A | 10/1950 | Kincaid, Jr. |
| 2,527,604 | A | 10/1950 | Walk |
| 2,528,983 | A | 11/1950 | Weiss |
| 2,542,036 | A | 2/1951 | Knaggs |
| 2,548,342 | A | 4/1951 | Brook et al. |
| 2,563,699 | A | 8/1951 | Winter |
| 2,564,902 | A | 8/1951 | Houser et al. |
| 2,572,968 | A | 10/1951 | Bachle |

| | | | |
|---|---|---|---|
| 2,595,583 | A | 5/1952 | Johnson |
| 2,618,297 | A | 11/1952 | Gosselin |
| 2,619,946 | A | 12/1952 | Michelich |
| 2,629,639 | A | 2/1953 | Johansen |
| 2,631,576 | A | 3/1953 | Schowalter |
| 2,642,051 | A | 6/1953 | Russell |
| 2,688,319 | A | 9/1954 | Humphreys |
| 2,694,389 | A | 11/1954 | Turkish |
| 2,705,482 | A | 4/1955 | Randol |
| 2,733,619 | A | 2/1956 | Smith |
| 2,735,313 | A | 2/1956 | Dickson |
| 2,737,934 | A | 3/1956 | Banker |
| 2,739,580 | A | 3/1956 | Brown |
| 2,743,712 | A | 5/1956 | Hulsing |
| 2,743,713 | A | 5/1956 | Russell |
| 2,763,250 | A | 9/1956 | Bensinge |
| 2,765,783 | A | 10/1956 | Randol |
| 2,773,761 | A | 12/1956 | Fuqua et al. |
| 2,781,868 | A | 2/1957 | House |
| 2,784,707 | A | 3/1957 | Skinner |
| 2,795,217 | A | 6/1957 | Ware |
| 2,797,673 | A | 7/1957 | Black |
| 2,797,701 | A | 7/1957 | Nurkiewicz |
| 2,807,251 | A | 9/1957 | Peras |
| 2,808,818 | A | 10/1957 | Sampietro |
| 2,815,740 | A | 12/1957 | Slater |
| 2,818,050 | A | 12/1957 | Papenguth |
| 2,818,844 | A | 1/1958 | Wood |
| 2,821,970 | A | 2/1958 | Line |
| 2,827,887 | A | 3/1958 | Van Slooten |
| 2,829,540 | A | 4/1958 | Niemeyer |
| 2,840,063 | A | 6/1958 | Purchas, Jr. |
| 2,842,111 | A | 7/1958 | Braun |
| 2,845,914 | A | 8/1958 | Cobo |
| 2,846,988 | A | 8/1958 | Iskenderian |
| 2,849,997 | A | 9/1958 | Kravits |
| 2,853,984 | A | 9/1958 | Sampietro |
| 2,857,895 | A | 10/1958 | Scheibe |
| 2,859,510 | A | 11/1958 | Baxa |
| 2,863,430 | A | 12/1958 | Sampietro |
| 2,863,432 | A | 12/1958 | O'Brien |
| 2,865,352 | A | 12/1958 | Thompson |
| 2,874,685 | A | 2/1959 | Line |
| 2,875,742 | A | 3/1959 | Dolza |
| 2,882,876 | A | 4/1959 | Bergmann |
| 2,887,098 | A | 5/1959 | Thompson |
| 2,891,525 | A | 6/1959 | Moore |
| 2,908,260 | A | 10/1959 | Bergmann, Sr. |
| 2,918,047 | A | 12/1959 | Mick |
| 2,925,074 | A | 2/1960 | Dadd |
| 2,925,808 | A | 2/1960 | Baumann |
| 2,926,884 | A | 3/1960 | Clinkenbeard |
| 2,932,290 | A | 4/1960 | Christensen |
| 2,934,051 | A | 4/1960 | Drew |
| 2,934,052 | A | 4/1960 | Longenecker |
| 2,935,059 | A | 5/1960 | Thompson |
| 2,935,878 | A | 5/1960 | Wirsching |
| 2,937,632 | A | 5/1960 | Voorhies |
| 2,938,508 | A | 5/1960 | Papenguth |
| 2,947,298 | A | 8/1960 | Dolza |
| 2,948,270 | A | 8/1960 | Bergmann |
| 2,948,274 | A | 8/1960 | Wood |
| 2,919,686 | A | 9/1960 | Mick |
| 2,954,015 | A | 9/1960 | Line |
| 2,956,557 | A | 10/1960 | Dadd |
| 2,962,012 | A | 11/1960 | Howson |
| 2,963,012 | A | 12/1960 | Kolbe |
| 2,988,805 | A | 6/1961 | Thompson |
| 2,997,991 | A | 8/1961 | Roan |
| 3,009,450 | A | 11/1961 | Engemann |
| 3,016,887 | A | 1/1962 | Streit et al. |
| 3,021,593 | A | 2/1962 | Cousino |
| RE25,154 | E | 4/1962 | Bergmann |
| 3,028,479 | A | 4/1962 | Tauschek |
| 3,029,832 | A | 4/1962 | Tischler et al. |
| 3,054,392 | A | 9/1962 | Thompson |
| 3,070,080 | A | 12/1962 | Van Slooten |
| 3,078,194 | A | 2/1963 | Thompson |
| 3,079,903 | A | 3/1963 | Humphreys |
| 3,086,507 | A | 4/1963 | Mooney, Jr. |
| 3,089,472 | A | 5/1963 | Thompson |
| 3,090,367 | A | 5/1963 | Ayres |
| 3,101,077 | A | 8/1963 | Engle |
| 3,101,402 | A | 8/1963 | Gondek |
| 3,109,418 | A | 11/1963 | Exline et al. |
| 3,111,118 | A | 11/1963 | Weiman |
| 3,111,119 | A | 11/1963 | Bergmann |
| 3,114,361 | A | 12/1963 | Mullen |
| 3,124,114 | A | 3/1964 | Voorhies |
| 3,124,115 | A | 3/1964 | Voorhies |
| 3,128,749 | A | 4/1964 | Dadd |
| 3,137,282 | A | 6/1964 | Voorhies |
| 3,137,283 | A | 6/1964 | Sampietro |
| 3,138,146 | A | 6/1964 | Hutchison |
| 3,139,076 | A | 6/1964 | Flaherty |
| 3,139,078 | A | 6/1964 | Van Slooten |
| 3,139,872 | A | 7/1964 | Thompson |
| 3,144,010 | A | 8/1964 | Van Slooten |
| 3,147,745 | A | 9/1964 | Kilgore |
| 3,151,603 | A | 10/1964 | Schumm |
| 3,153,404 | A | 10/1964 | Van Slooten |
| 3,166,057 | A | 1/1965 | Konrad et al. |
| 3,169,515 | A | 2/1965 | Kilgore et al. |
| 3,176,669 | A | 4/1965 | Kuchen et al. |
| 3,177,857 | A | 4/1965 | Kuchen et al. |
| 3,180,328 | A | 4/1965 | Engle |
| 3,194,439 | A | 7/1965 | Beduerftig |
| 3,200,801 | A | 8/1965 | Dornbos |
| 3,220,393 | A | 11/1965 | Schlink |
| 3,224,243 | A | 12/1965 | Van Deberg |
| 3,225,752 | A | 12/1965 | Robinson |
| 3,234,815 | A | 2/1966 | Line |
| RE25,974 | E | 3/1966 | Dadd |
| 3,240,195 | A | 3/1966 | Sossna |
| 3,255,513 | A | 6/1966 | Robinson et al. |
| 3,267,918 | A | 8/1966 | Ayres |
| 3,267,919 | A | 8/1966 | Wortman |
| 3,270,724 | A | 9/1966 | Dolza |
| 3,273,514 | A | 9/1966 | Bender |
| 3,273,546 | A | 9/1966 | Von Arx |
| 3,273,547 | A | 9/1966 | Lesher |
| 3,273,548 | A | 9/1966 | Hoffman |
| 3,273,998 | A | 9/1966 | Knoth et al. |
| 3,277,874 | A | 10/1966 | Wagner |
| 3,280,806 | A | 10/1966 | Iskenderian |
| 3,280,807 | A | 10/1966 | Bardy |
| 3,291,107 | A | 12/1966 | Cornell |
| 3,299,869 | A | 1/1967 | Sicklesteel |
| 3,299,986 | A | 1/1967 | Briggs et al. |
| 3,301,239 | A | 1/1967 | Thauer |
| 3,301,241 | A | 1/1967 | Iskenderian |
| 3,303,833 | A | 2/1967 | Melling |
| 3,304,925 | A | 2/1967 | Rhoads |
| 3,314,303 | A | 4/1967 | Maat |
| 3,314,404 | A | 4/1967 | Thompson |
| 3,322,104 | A | 5/1967 | Abell, Jr. |
| 3,332,405 | A | 7/1967 | Haviland |
| 3,354,898 | A | 11/1967 | Barnes |
| 3,365,979 | A | 1/1968 | Ericson |
| 3,367,312 | A | 2/1968 | Jonsson |
| 3,379,180 | A | 4/1968 | Kabel et al. |
| 3,385,274 | A | 5/1968 | Shunta et al. |

3,400,696 A 9/1968 Thompson
3,405,699 A 10/1968 Laas
3,410,366 A 11/1968 Winter, Jr.
3,413,965 A 12/1968 Gavasso
3,422,803 A 1/1969 Stivender
3,426,651 A 2/1969 Arendarski
3,430,613 A 3/1969 Barnes
3,437,080 A 4/1969 Abell, Jr.
3,439,659 A 4/1969 Bouwkamp
3,439,660 A 4/1969 Lesher
3,439,662 A 4/1969 Jones et al.
3,448,730 A 6/1969 Abell, Jr.
3,450,228 A 6/1969 Wortman et al.
3,455,346 A 7/1969 Stork
3,463,131 A 8/1969 Dolby
3,470,857 A 10/1969 Stivender
3,470,983 A 10/1969 Briggs
3,476,093 A 11/1969 Line
3,490,423 A 1/1970 Shunta et al.
3,502,058 A 3/1970 Thompson
3,518,976 A 7/1970 Thuesen
3,520,287 A 7/1970 Calvin
3,521,633 A 7/1970 Yahner
3,523,459 A 8/1970 Mowbray
3,528,451 A 9/1970 Hansen
3,542,001 A 11/1970 Line
3,547,087 A 12/1970 Siegler
3,549,430 A 12/1970 Kies et
3,549,431 A 12/1970 de Coyce de Ca
3,572,300 A 3/1971 Stager et al.
3,587,539 A 6/1971 Dadd
3,590,796 A 7/1971 Harkness
3,598,095 A 8/1971 Ayres
3,630,179 A 12/1971 Dadd
3,633,555 A 1/1972 Raggi
3,641,988 A 2/1972 Torazza et al.
3,650,251 A 3/1972 Pelizzoni
3,662,725 A 5/1972 Dragon et al.
3,664,312 A 5/1972 Miller, Jr.
3,665,156 A 5/1972 Lee
3,668,945 A 6/1972 Hofmann
3,690,959 A 9/1972 Thompson
3,716,036 A 2/1973 Kruger
3,717,134 A 2/1973 Cornell
3,722,484 A 3/1973 Gordini
3,741,240 A 6/1973 Berriman
3,742,921 A 7/1973 Rendine
3,782,345 A 1/1974 Erickson et al.
3,786,792 A 1/1974 Pelizzoni et al.
3,795,229 A 3/1974 Weber
3,799,129 A 3/1974 Cornell
3,799,186 A 3/1974 Bulin
3,805,753 A 4/1974 Bergmann et al.
3,822,683 A 7/1974 Clouse
3,831,457 A 8/1974 Kern
3,838,669 A 10/1974 Dadd
3,848,188 A 11/1974 Ardezzone et al.
3,855,981 A 12/1974 Loon
3,859,969 A 1/1975 Davis, Jr.
3,860,457 A 1/1975 Vourinen et al.
3,870,024 A 3/1975 Ridgeway
3,875,908 A 4/1975 Ayres
3,875,911 A 4/1975 Joseph
3,877,445 A 4/1975 Barnes
3,877,446 A 4/1975 Morgan
3,879,023 A 4/1975 Pearce et al.
3,880,127 A 4/1975 Abell, Jr.
3,886,808 A 6/1975 Weber
3,893,873 A 7/1975 Hanai et al.
3,902,467 A 9/1975 Cornell
3,911,879 A 10/1975 Altmann
3,915,129 A 10/1975 Rust et al.
3,921,609 A 11/1975 Rhoads
3,945,367 A 3/1976 Turner, Jr.
3,958,900 A 5/1976 Ueno
3,964,455 A 6/1976 Brown
3,967,602 A 7/1976 Brown
3,977,370 A 8/1976 Humphreys
3,992,663 A 11/1976 Seddick
3,998,190 A 12/1976 Keske
4,004,558 A 1/1977 Scheibe
4,007,716 A 2/1977 Jones
4,009,695 A 3/1977 Ule
4,009,696 A 3/1977 Cornell
4,050,435 A 9/1977 Fuller, Jr. et al.
4,061,123 A 12/1977 Janes
4,064,844 A 12/1977 Matsumoto et al.
4,064,861 A 12/1977 Schulz
4,080,941 A 3/1978 Bertrand
4,086,887 A 5/1978 Schoonover et al.
4,089,234 A 5/1978 Henson et al.
4,094,279 A 6/1978 Kueny
4,098,240 A 7/1978 Abell, Jr.
4,104,991 A 8/1978 Abdoo
4,104,996 A 8/1978 Hosono et al.
4,105,267 A 8/1978 Mori
4,107,921 A 8/1978 Iizuka
4,114,588 A 9/1978 Jordan
4,114,643 A 9/1978 Aoyama et al.
4,133,332 A * 1/1979 Benson et al. ..... 123/198 F
4,141,333 A 2/1979 Gilbert
4,151,817 A 5/1979 Mueller
4,152,953 A 5/1979 Headley
4,164,917 A 8/1979 Glasson
4,167,931 A 9/1979 Iizuka
4,173,209 A 11/1979 Jordan
4,173,954 A 11/1979 Speckhart
4,175,534 A 11/1979 Jordan
4,184,464 A 1/1980 Svihlik
4,188,933 A 2/1980 Iizuka
4,191,142 A 3/1980 Kodama
4,192,263 A 3/1980 Kitagawa et al.
4,200,081 A 4/1980 Meyer et al.
4,203,397 A 5/1980 Soeters, Jr.
4,204,814 A 5/1980 Matzen
4,206,734 A 6/1980 Perr et al.
4,207,775 A 6/1980 Lintott
4,213,442 A 7/1980 Mihalic
4,221,199 A 9/1980 Buuck et al.
4,221,200 A 9/1980 Soeters, Jr.
4,221,201 A 9/1980 Soeters, Jr.
4,222,354 A 9/1980 Uitvlugt
4,222,793 A 9/1980 Grindahl
4,227,149 A 10/1980 Faure et al.
4,227,494 A 10/1980 Uitvlugt
4,227,495 A 10/1980 Krieg
4,228,771 A 10/1980 Krieg
4,230,076 A 10/1980 Mueller
4,231,267 A 11/1980 Van Slooten
4,237,832 A 12/1980 Hartig et al.
4,245,596 A 1/1981 Bruder et al.
4,249,488 A 2/1981 Siegla
4,249,489 A 2/1981 Bruder et al.
4,252,093 A 2/1981 Hazelrigg
4,256,070 A 3/1981 Mueller
4,258,671 A 3/1981 Takizawa et al.
4,258,673 A 3/1981 Stoody, Jr. et al.
4,262,640 A 4/1981 Clark
4,284,042 A 8/1981 Springer
4,285,310 A 8/1981 Takizawa et al.
4,305,356 A 12/1981 Walsh
4,325,589 A 4/1982 Hirt 4,326,484 A 4/1982 Amrhein
4,335,685 A 6/1982 Clouse
4,336,775 A 6/1982 Meyer
4,337,738 A 7/1982 Bubniak et al.
4,338,894 A 7/1982 Kodama
4,356,799 A 11/1982 Clark
4,361,120 A 11/1982 Kueny
4,362,991 A 12/1982 Carbine
4,363,300 A 12/1982 Honda
4,367,701 A 1/1983 Buente
4,369,627 A 1/1983 Kasting et al.
4,380,219 A 4/1983 Walsh
4,385,599 A 5/1983 Hori et al.
4,387,674 A 6/1983 Connell
4,387,675 A 6/1983 Hori et al.
4,387,680 A 6/1983 Tsunetomi et al.
4,397,270 A 8/1983 Aoyama
4,401,064 A 8/1983 Nakamura et al.
4,402,285 A 9/1983 Arai et al.
4,406,257 A 9/1983 Keske et al.
4,408,580 A 10/1983 Kosuda et al.
4,411,229 A 10/1983 Curtis et al.
4,414,935 A 11/1983 Curtis et al.
4,437,439 A 3/1984 Speil
4,437,738 A 3/1984 Headley et al.
4,438,736 A 3/1984 Hara et al.
4,440,121 A 4/1984 Clancy et al.
4,442,806 A 4/1984 Matsuura et al.
4,448,155 A 5/1984 Hillebrand et al.
4,448,156 A 5/1984 Henault
4,452,187 A 6/1984 Kosuda et al.
4,453,505 A * 6/1984 Holtzberg et al. ..... 123/90.61
4,457,270 A 7/1984 Kodama et al.
4,459,946 A 7/1984 Burandt
4,462,353 A 7/1984 Arai et al.
4,462,364 A 7/1984 Kodama
4,463,714 A 8/1984 Nakamura
4,465,038 A 8/1984 Speil
4,466,390 A 8/1984 Babitzka et al.
4,469,061 A 9/1984 Ajiki et al.
4,475,489 A 10/1984 Honda
4,475,497 A 10/1984 Honda et al.
4,480,617 A 11/1984 Nakano et al.
4,481,913 A 11/1984 Wirth
4,481,919 A 11/1984 Honda et al.
4,483,281 A 11/1984 Black
4,484,546 A 11/1984 Burandt
4,488,520 A 12/1984 Almor
4,498,432 A 2/1985 Hara et al.
4,499,870 A 2/1985 Aoyama
4,502,425 A 3/1985 Wride
4,502,428 A 3/1985 Paar
4,503,818 A 3/1985 Hara et al.
4,506,635 A 3/1985 van Rinsum
4,509,467 A 4/1985 Arai et al.
4,515,121 A 5/1985 Matsuura et al.
4,515,346 A 5/1985 Gaterman, III
4,517,936 A 5/1985 Burgio di Aragona
4,519,345 A 5/1985 Walter
4,523,550 A 6/1985 Honda et al.
4,524,731 A 6/1985 Rhoads
4,526,142 A 7/1985 Hara et al.
4,534,323 A 8/1985 Kato et al.
4,535,732 A 8/1985 Nakano et al.
4,537,164 A 8/1985 Ajiki et al.
4,537,165 A 8/1985 Honda et al.
4,539,951 A 9/1985 Hara et al.
4,541,878 A 9/1985 Mühlberger et al.
4,545,342 A 10/1985 Nakano et al.
4,546,734 A 10/1985 Kodama
4,549,509 A 10/1985 Burtchell
4,556,025 A 12/1985 Morita
4,559,909 A 12/1985 Honda et al.
4,561,393 A 12/1985 Kopel
4,567,861 A 2/1986 Hara et al.
4,570,582 A 2/1986 Speil
4,576,128 A 3/1986 Kenichi
4,579,094 A 4/1986 Döppling et al.
4,584,974 A 4/1986 Aoyama et al.
4,584,976 A 4/1986 Hillebrand
4,587,936 A 5/1986 Matsuura et al.
4,589,383 A 5/1986 Showalter
4,589,387 A 5/1986 Miura et al.
4,590,898 A 5/1986 Buente et al.
RE32,167 E 6/1986 Buente
4,596,213 A 6/1986 Hillebrand
4,602,409 A 7/1986 Schaeffler
4,607,599 A 8/1986 Buente et al.
4,611,558 A 9/1986 Yoshizaki et al.
4,612,884 A 9/1986 Ajiki et al.
4,614,171 A 9/1986 Malhotra
4,615,306 A 10/1986 Wakeman
4,615,307 A 10/1986 Kodama et al.
4,624,223 A 11/1986 Wherry et al.
4,628,874 A 12/1986 Barlow
4,633,827 A 1/1987 Buente
4,635,593 A 1/1987 Kodama
4,637,357 A 1/1987 Ohmi
4,638,773 A 1/1987 Bonvallet
4,643,141 A 2/1987 Bledsoe
4,648,360 A 3/1987 Schaeffler
4,653,441 A 3/1987 Belsanti
4,655,176 A 4/1987 Sheehan
4,656,977 A 4/1987 Nagahiro et al.
4,671,221 A 6/1987 Geringer et al.
4,674,451 A 6/1987 Rembold et al.
4,677,723 A 7/1987 Greene, Sr.
4,690,110 A 9/1987 Nishimura et al.
4,693,214 A 9/1987 Titolo
4,694,788 A 9/1987 Craig
4,696,265 A 9/1987 Nohira
4,697,473 A 10/1987 Patel
4,699,094 A 10/1987 Stegeman
4,704,995 A 11/1987 Soeters, Jr.
4,708,102 A 11/1987 Schmid
4,711,202 A 12/1987 Baker
4,711,207 A 12/1987 Bonvallet
4,716,863 A 1/1988 Pruzan
4,718,379 A 1/1988 Clark
4,724,802 A 2/1988 Ishii
4,724,804 A 2/1988 Wirth
4,724,822 A 2/1988 Bonvallet
4,726,332 A 2/1988 Nishimura et al.
4,727,830 A 3/1988 Nagahiro et al.
4,727,831 A 3/1988 Nagahiro et al.
4,738,231 A 4/1988 Patel et al.
4,741,297 A 5/1988 Nagahiro et al.
4,741,298 A 5/1988 Rhoads
4,745,888 A 5/1988 Kapp
4,747,376 A 5/1988 Speil et al.
4,756,282 A 7/1988 Kunz et al.
4,759,321 A 7/1988 Matsumoto et al.
4,759,322 A 7/1988 Konno
4,762,096 A 8/1988 Kamm et al.
4,765,288 A 8/1988 Linder et al.
4,765,289 A 8/1988 Masuda et al.
4,768,467 A 9/1988 Yamada et al.
4,768,475 A 9/1988 Ikemura
4,771,741 A 9/1988 Leer
4,771,742 A 9/1988 Nelson et al.
4,773,359 A 9/1988 Titolo
4,779,583 A 10/1988 Laffter et al.

4,779,589 A 10/1988 Matsuura et al.
4,782,799 A 11/1988 Goppelt et al.
4,784,095 A 11/1988 Golding et al.
4,787,347 A 11/1988 Schaeffler
4,790,274 A 12/1988 Inoue et al.
4,791,895 A 12/1988 Tittizer
4,793,295 A 12/1988 Downing
4,793,296 A 12/1988 Inoue et al.
4,796,483 A 1/1989 Patel et al.
4,796,573 A 1/1989 Wakeman et al.
4,799,463 A 1/1989 Konno
4,800,850 A 1/1989 Yoshida et al.
4,802,448 A 2/1989 Ableitner
4,803,334 A 2/1989 Burke et al.
4,805,567 A 2/1989 Heimburg
4,809,651 A 3/1989 Gerchow et al.
4,815,424 A 3/1989 Buuck et al.
4,825,717 A 5/1989 Mills
4,825,823 A 5/1989 Schaeffler
4,829,948 A 5/1989 Yoshida et al.
4,840,153 A 6/1989 Aida et al.
4,844,022 A 7/1989 Konno
4,844,023 A 7/1989 Konno et al.
4,848,180 A 7/1989 Mills
4,848,285 A 7/1989 Konno
4,850,311 A 7/1989 Sohn
4,858,574 A 8/1989 Fukuo et al.
4,869,214 A 9/1989 Inoue et al.
4,872,429 A 10/1989 Anderson et al.
4,876,114 A 10/1989 Phinney et al.
4,876,944 A 10/1989 Wilson et al.
4,876,994 A 10/1989 Speil et al.
4,876,997 A 10/1989 Zorn et al.
4,883,027 A 11/1989 Oikawa et al.
4,887,561 A 12/1989 Kishi
4,887,563 A 12/1989 Ishida et al.
4,887,566 A 12/1989 Shida
4,896,635 A 1/1990 Willermet et al.
4,899,701 A 2/1990 Inoue et al.
4,905,639 A 3/1990 Konno
4,909,195 A 3/1990 Hasebe et al.
4,909,197 A 3/1990 Perr
4,917,056 A 4/1990 Yagi et al.
4,917,059 A 4/1990 Umeda
4,919,089 A 4/1990 Fujiyoshi et al.
4,920,935 A 5/1990 Shida
4,921,064 A 5/1990 Wazaki et al.
4,924,821 A 5/1990 Teerman
4,926,804 A 5/1990 Fukuo
4,930,465 A 6/1990 Wakeman et al.
4,940,048 A 7/1990 Mills
4,944,257 A 7/1990 Mills
4,951,619 A 8/1990 Schaeffler
4,957,076 A 9/1990 Inoue et al.
4,959,794 A 9/1990 Shiraishi et al.
RE33,411 E 10/1990 Inoue et al.
4,969,102 A 11/1990 Tamura et al.
4,971,164 A 11/1990 Fujita et al.
4,986,227 A 1/1991 Dewey, III
4,993,150 A 2/1991 Reinhardt et al.
4,995,281 A 2/1991 Allor et al.
5,003,939 A 4/1991 King
5,010,856 A 4/1991 Ojala
5,010,857 A 4/1991 Hempelmann et al.
5,018,487 A 5/1991 Shinkai
5,022,356 A 6/1991 Morel, Jr. et al.
5,025,761 A 6/1991 Chen
5,028,281 A 7/1991 Hayes et al.
5,033,420 A 7/1991 Matayoshi et al.
5,036,807 A 8/1991 Kaneko
5,040,651 A 8/1991 Hampton et al.
5,042,436 A 8/1991 Yamamoto et al.
5,042,437 A 8/1991 Sakuragi et al.
5,046,462 A 9/1991 Matayoshi et al.
5,048,475 A 9/1991 Mills
5,069,173 A 12/1991 Mallas
5,070,827 A 12/1991 Krieg et al.
5,074,260 A 12/1991 Yagi et al.
5,074,261 A 12/1991 Hamburg et al.
5,080,053 A 1/1992 Parsons
5,088,455 A 2/1992 Moretz
5,090,364 A 2/1992 McCarroll et al.
5,099,806 A 3/1992 Murata et al.
5,099,807 A 3/1992 Devine
5,107,806 A 4/1992 Döhring et al.
5,113,813 A 5/1992 Rosa
RE33,967 E 6/1992 Honda et al.
5,119,774 A 6/1992 Krieg et al.
5,127,374 A 7/1992 Morel, Jr. et al.
5,129,373 A 7/1992 Cuatt et al.
5,148,783 A 9/1992 Shinkai et al.
5,150,672 A 9/1992 Fischer et al.
5,161,493 A 11/1992 Ma
5,163,389 A 11/1992 Fujikawa et al.
5,178,107 A 1/1993 Morel, Jr. et al.
5,181,485 A 1/1993 Hirose et al.
5,184,581 A 2/1993 Aoyama et al.
5,186,130 A 2/1993 Melchior
5,188,067 A 2/1993 Fontichiaro et al.
5,188,068 A 2/1993 Gaterman, III et al.
5,189,997 A 3/1993 Schneider
5,193,496 A 3/1993 Kruger
5,199,393 A 4/1993 Baldassini
5,239,951 A 8/1993 Rao et al.
5,247,913 A 9/1993 Manolis
5,253,621 A 10/1993 Dopson et al.
5,259,346 A 11/1993 Mills
5,261,361 A 11/1993 Speil
5,263,386 A 11/1993 Campbell et al.
5,273,005 A 12/1993 Philo et al.
5,287,830 A 2/1994 Dopson et al.
5,301,636 A 4/1994 Nakamura
5,307,769 A 5/1994 Meagher et al.
5,320,082 A 6/1994 Murata et al.
5,343,833 A 9/1994 Shirai
5,345,898 A 9/1994 Krebs
5,347,965 A 9/1994 Decuir
5,351,662 A 10/1994 Dopson et al.
5,353,756 A 10/1994 Murata et al.
5,357,916 A 10/1994 Matterazzo
5,361,733 A 11/1994 Spath et al.
5,365,896 A 11/1994 Hara et al.
5,379,730 A 1/1995 Schaeffler
5,385,124 A 1/1995 Hillebrand et al.
5,386,806 A 2/1995 Allen et al.
5,394,843 A 3/1995 Decuir
5,398,648 A 3/1995 Spath et al.
5,402,756 A 4/1995 Bohme et al.
5,419,290 A 5/1995 Hurr et al.
5,429,079 A 7/1995 Murata et al.
5,430,934 A 7/1995 Groh et al.
5,431,133 A 7/1995 Spath et al.
5,454,353 A 10/1995 Elendt et al.
5,501,186 A 3/1996 Hara et al.
5,509,385 A 4/1996 LaVieri
5,520,144 A 5/1996 Philo et al.
5,544,626 A 8/1996 Diggs et al.
5,546,899 A 8/1996 Sperling et al.
5,549,081 A 8/1996 Ohlendorf et al.
5,553,584 A 9/1996 Konno
5,555,861 A 9/1996 Mayr et al.
5,560,265 A 10/1996 Miller

| | | | | | |
|---|---|---|---|---|---|
| 5,560,329 | A | | 10/1996 | Hayman | |
| 5,566,652 | A | | 10/1996 | Deppe | |
| 5,584,268 | A | | 12/1996 | Natkin et al. | |
| 5,592,907 | A | | 1/1997 | Hasebe et al. | |
| 5,603,294 | A | | 2/1997 | Kawai | |
| 5,613,469 | A | | 3/1997 | Rygiel | |
| 5,642,694 | A | | 7/1997 | Dura et al. | |
| 5,651,335 | A | | 7/1997 | Elendt et al. | |
| 5,653,198 | A | | 8/1997 | Diggs | |
| 5,655,487 | A | | 8/1997 | Maas et al. | |
| 5,655,488 | A | | 8/1997 | Hampton et al. | |
| 5,660,153 | A | | 8/1997 | Hampton et al. | |
| 5,673,661 | A | | 10/1997 | Jesel | |
| 5,678,514 | A | | 10/1997 | Mazzella et al. | |
| 5,697,333 | A | | 12/1997 | Church et al. | |
| 5,706,773 | A | | 1/1998 | Dura et al. | |
| 5,746,165 | A | | 5/1998 | Speil et al. | |
| 5,775,275 | A | | 7/1998 | Philo | |
| 5,797,364 | A | | 8/1998 | Meek et al. | |
| 5,806,475 | A | | 9/1998 | Hausknecht | |
| 5,862,785 | A | * | 1/1999 | Blowers et al. | 123/90.43 |
| 5,875,748 | A | | 3/1999 | Haas et al. | |
| 5,893,344 | A | | 4/1999 | Church | |
| 5,908,015 | A | | 6/1999 | Kreuter | |
| 5,924,396 | A | | 7/1999 | Ochiai et al. | |
| 5,934,232 | A | | 8/1999 | Greene et al. | |
| 5,960,756 | A | | 10/1999 | Miyachi et al. | |
| 5,983,848 | A | | 11/1999 | Calka | |
| 6,006,706 | A | | 12/1999 | Kanzaki | |
| 6,032,624 | A | | 3/2000 | Tsuruta et al. | |
| 6,058,895 | A | | 5/2000 | Hermsen | |
| 6,092,497 | A | | 7/2000 | Preston et al. | |
| 6,186,101 | B1 | | 2/2001 | Kreuter | |
| 6,196,175 | B1 | | 3/2001 | Church | |
| 6,257,185 | B1 | * | 7/2001 | Groh et al. | 123/90.16 |
| 6,273,039 | B1 | | 8/2001 | Church | |
| 6,321,704 | B1 | | 11/2001 | Church et al. | |
| 6,321,705 | B1 | | 11/2001 | Fernandez et al. | |
| 6,325,030 | B1 | | 12/2001 | Spath et al. | |
| 6,325,034 | B1 | | 12/2001 | Edelmayer | |
| 6,328,009 | B1 | | 12/2001 | Brothers | |
| 6,418,904 | B1 | | 7/2002 | Hannon et al. | |
| 6,439,179 | B1 | | 8/2002 | Hendriksma et al. | |
| 6,513,470 | B1 | | 2/2003 | Hendriksma et al. | |
| 2003/0196620 | A1 | | 10/2003 | Spath | |

OTHER PUBLICATIONS

"Eaton adds variability to Displacement on Demand," Frank Bokulich, Automotive Engineering International Tech Brief, Jan. 2002, 01471–01473.
"GM Power Train Displaces on Demand," Jean L. Broge, Automotive Engineering International Online, Jul. 2001, 01474–01476.
"GM Technology," Daniel J. Holt, Service Tech Magazine, Jul. 2001, 01477–01479.
"Eaton adds variability to Displacement on Demand," Frank Bokulich, Automotive Engineering International Tech Brief, Jan. 2002, 01480–01483.
Prints, Mar. 14, 2000, 01484–01485.
Prints, Nov. 30, 2000, 01486–01494.
Print, Feb. 25, 2000, 01495.
"Hydraulic Valve Lifter," Delphi, Jul. 2, 2002, 01511–01513.
Prints, Jul. 16, 2001, 01563–01565.
Prints, Aug. 24, 2001, 01566.
Prints, Jul. 16, 2001, 01567.
Prints, Aug. 24, 2001, 01568.
Prints, Jul. 17, 2001, 01572–01573.
Prints, Jan. 16, 2002, 01610.
Prints, Jun. 17, 2000, 01703.
Prints, May 30, 2001, 01704.
Prints, Jun. 21, 1999, 01721.
Prints, Jul. 16, 2001, 01732.
Prints, Aug. 24, 2001, 01767.
Prints, Jul. 17, 2001, 01768.
Prints, Sep. 5, 2001, 01769.
Prints, Jul. 16, 2001, 01770.
Prints, Jun. 21, 1999, 01771.
Prints, Sep. 9, 2001, 01789–01792.
Prints, Nov. 22, 2000, 01807.
Prints, Jul. 16, 2001, 01812.
Prints, Aug. 1, 2001, 01836.
Prints, Jul. 25, 2001, 01837.
Prints, Aug. 20, 2001, 01838.
Roller Lifter Body Powerpoint, Feb. 6, 2002, 01839–01843.
Prints, Aug. 20, 2001, 01844–01849.
Engineering Change Notice, Feb. 2, 1989, 01852.
Prints, Jan. 26, 1989, 01853–01854.
Prints, Oct. 7, 1985, 01856.
Prints, May 1, 1985, 01857.
Prints, May 31, 1985, 01859.
Prints, Mar. 6, 1986, 01860.
Prints, Oct. 7, 1985, 01862–01863.
Prints, Feb. 20, 1989, 01864.
Prints, Jan. 29, 1986, 01865.
Prints, Mar. 6, 1986, 01866.
Prints, May 30, 2001, 01921.
Prints, Mar. 14, 2000, 01922.
Prints, Jul. 17, 2000, 01946.
Prints, May 30, 2001, 01947.
Prints, Jul. 17, 2000, 01950.
Prints, Mar. 14, 2000, 01952.
Prints, Nov. 30, 2000, 01953–01961.
Prints, Feb. 25, 2000, 01962.
Prints, Jun. 21, 1999, 01966–01967.
Prints, Dec. 12, 2001, 02035.
Prints, Dec. 17, 2001, 02037.
Prints, Jun. 21, 1999, 02039.
Prints, Jun. 21, 1999, 02041.
Prints, Dec. 10, 2001, 02043.
Prints, Dec. 7, 2001, 02045.
Prints, Dec. 10, 2001, 02047.
Prints, Dec. 7, 2001, 02048.
Prints, Jul. 16, 2001, 02053.
Prints, Nov. 22, 2000, 02054.
Prints, Jul. 17, 2001, 02055.
Prints, Jun. 21, 1999, 02956.
Prints, Jul. 16, 2001, 02057.
Prints, Jul. 16, 2001, 02063.
Prints, Nov. 22, 2000, 02064.
Prints, Jul. 17, 2001, 02065.
Prints, Jun. 21, 1999, 02066.
Prints, Jul. 16, 2001, 02067.
Prints, Jun. 21, 1999, 02082.
Prints, Jun. 21, 1999, 02088–02089.
Prints, Jul. 16, 2001, 02097–2098.
Prints, Jul. 17, 2001, 02105.
Prints, Jul. 17, 2001, 02107.
Prints, Nov. 22, 2000, 02115–02116.
Prints, Jul. 16, 2001, 02124–02125.
Prints, Jul. 15, 1988, 02166.
Prints, Feb. 2, 1986, 02344–02345.

Engineering Change Notice, Feb. 12, 1986, 02434.
Prints, Oct. 7, 1985, 02445.
Prints, Feb. 12, 1986, 02446.
Prints, Jul. 16, 1986, 02448.
Prints, Apr. 11, 1990, 02449.
Prints, Jun. 18, 1992, 02451.
Prints, Jan. 26, 1989, 02452.
Prints, Mar. 16, 1984, 02462–02463.
Prints, Jul. 20, 1984, 02464.
Prints, Dec. 10, 1984, 02465.
Prints, Jan. 2, 1985, 02474.
Prints, Feb. 12, 1986, 02475–02478.
Prints, Jul. 10, 1985, 02483.
Prints, Jul. 8, 1985, 02484.
Print, May 18, 1985, 02486.
Print, Jun. 6, 1985, 02487.
Prints, Jul. 26, 1985, 02488–02489.
Print, Jan. 2, 1985, 02492.
Print, Dec. 10, 1984, 02493.
Print, Jan. 2, 1995, 02494.
Print, Mar. 6, 1985, 02520.
Prints, Jan. 26, 1989, 02521–02522.
Print, Jun. 23, 1969, 02543.
Prints, Jun. 12, 1967, 02544.
Print, Jun. 23, 1969, 02554.
Print, Jun. 12, 1967, 02555.
Print, Dec. 10, 1984, 02635.
Prints, Oct. 7, 1985, 02644–02645.
Print, Jul. 22, 1974, 02646.
Prints, Sep. 7, 1972, 02647.
Print, Nov. 9, 1982, 02655.
Print, Aug. 21, 1981, 02656.
Print, Sep. 3, 1986, 02657.
Prints, Apr. 19, 1982, 02659–02660.
Prints, Apr. 19, 1982, 02662–02663.
Print, Jan. 2, 1985, 02664.
Print, Sep. 5, 1985, 02665.
Print, Oct. 3, 1985, 02666–02669.
Prints, Sep. 11, 1985, 02670–02671.
Print, Oct. 7, 1985, 02672.
Print, Sep. 23, 1985, 02673.
Print, Jan. 2, 1985, 02674.
Print, Dec. 10, 1984, 02675.
Print, Mar. 4, 1985, 02676.
Print, Jul. 12, 1982, 02677.
Prints, Jan. 6, 1986, 02678–02679.
Print, May 7, 1984, 02680.
Print, Apr. 5, 1985, 02681.
Print, Sep. 17, 1985, 02682.
Print, Sep. 23, 1985, 02683.
Prints, Sep. 17, 1985, 02684–02686.
Print, Sep. 5, 1985, 02687.
Print, Dec. 10, 1984, 02688.
Print, Oct. 7, 1985, 02689.
Prints, Feb. 12, 1986, 02690–02691.
Prints, Oct. 7, 1985, 02692–02693.
Print, Feb. 12, 1986, 02694.
Print, Mar. 16, 1984, 02697.
Prints, May 7, 1981, 02698–02699.
Print, Jul. 11, 1984, 02700.
Print, Jun. 1, 1984, 02701.
Print, Mar. 16, 1984, 02702.
Print, Feb. 25, 1984, 02703.
Print, Mar. 21, 1984, 02704.
Print, Mar. 16, 1984, 02705.
Print, Mar. 27, 1986, 02706.
Prints, Sep. 17, 1985, 02707.
Print, Dec. 10, 1984, 02708.
Print, Jan. 26, 1989, 02709.
Prints, Mar. 23, 1989, 02710–02712.
Print, Sep. 7, 1972, 02713.
Print, Jul. 22, 1974, 02714.
Print, Oct. 7, 1985, 02715.
Print, Dec. 4, 1984, 02716.
Prints, Jan. 6, 1986, 02717–02718.
Print, Sep. 17, 1985, 02719.
Prints, Feb. 12, 1986, 02720–02723.
Prints, Jan. 6, 1986, 02724–02725.
Print, Jul. 15, 1982, 02726.
Prints, May 26, 1982, 02727–02735.
Print, Sep. 7, 1972, 02736.
Print, Jul. 22, 1974, 02738.
Print, Sep. 7, 1972, 02739.
Print, Apr. 3, 1982, 02740.
Print, May 16, 1980, 02742.
Print, Aug. 20, 1980, 02743.
Print, May 26, 1982, 02744.
Print, May 16, 1980, 02746.
Print, Aug. 20, 1980, 02747.
Prints, Dec. 10, 1984, 02748–02749.
Print, Jul. 16, 1984, 02750.
Print, Jul. 16, 1984, 02751.
Print, Feb. 18, 1980, 02753.
Print, May 7, 1981, 02754.
Prints, May 7, 1981, 02755–02758.
Print, Oct. 29, 1982, 02759.
Prints, Sep. 26, 1983, 02760–02761.
Print, Oct. 29, 1982, 02762.
Print, Aug. 22, 1985, 02763.
Print, Oct. 7, 1985, 02764.
Print, Mar. 23, 1989, 02765.
Print, Jan. 26, 1989, 02766.
Print, Oct. 7, 1985, 02770.
Print, Apr. 4, 1986, 02771.
Prints, Feb. 12, 1986, 02772–02773.
Print, Oct. 7, 1985, 02774.
Print, Oct. 18, 1985, 02775.
Prints, Mar. 23, 1989, 02777–02779.
Prints, Jun. 3, 1982, 02780–02781.
Print, Apr. 30, 1986, 02785.
Print, Jun. 23, 1986, 02786.
Print, Apr. 30, 1986, 02787.
Print, Jul. 11, 1984, 02788.
Print, Oct. 18, 1985, 02789.
Prints, Jul. 11, 1984, 02790–02791.
Prints, Sep. 16, 1986, 02792–02793.
Print, Jul. 10, 1984, 02794.
Surface Defects of Tappet Push Rod Seat Inserts, Oct. 4, 1965, 02795–02796.
Print, Apr. 30, 1987, 02797.
Prints, Oct. 4, 1966, 02798–02799.
Print, Oct. 4, 1966, 02802.
Print, Feb. 18, 1980, 02804.
Print, May 7, 1981, 02805.
Print, Oct. 4, 1966, 02807.
Print, Mar. 21, 1984, 02808.
Print, Feb. 18, 1980, 02810.
Print, May 7, 1981, 02811.

Prints, Apr. 1, 1986, 02813–02815.
Prints, Sep. 9, 1984, 02816.
Prints, Sep. 26, 1984, 02817.
Prints, Sep. 28, 1984, 02818.
Prints, Jan. 24, 1986, 02819–02822.
Prints, Sep. 28, 1984, 02823.
Prints, Sep. 26, 1984, 02824–02826.
Prints, Dec. 4, 1984, 02827.
Prints, Sep. 28, 1984, 02828.
Prints, Feb. 11, 1986, 02829.
Prints, Sep. 28, 1984, 02830.
Prints, Sep. 28, 1984, 02831–02833.
Prints, Sep. 26, 1984, 02834–02837.
Prints, Sep. 28, 1984, 02838.
Prints, Sep. 28, 1982, 02839.
Prints, Dec. 17, 1985, 02842.
Prints, Oct. 5, 1985, 02843.
Prints, Oct. 7, 1985, 02844.
Prints, Oct. 2, 1985, 02846.
Prints, Dec. 6, 1990, 02949.
Prints, Dec. 12, 1973, 02952.
Prints, Jun. 25, 1981, 02953.
Prints, Jun. 10, 1969, 02954.
Prints, Dec. 8, 1965, 02955–02956.
Prints, Jun. 10, 1969, 02957–02960.
Prints, Oct. 2, 1985, 02961.
Prints, Oct. 30, 1985, 02962.
Prints, Oct. 31, 1985, 02963–02964.
Prints, Apr. 16, 1985, 02966.
Prints, Aug. 8, 1988, 02867.
Print, Feb. 21, 1985, 02868.
Print, Oct. 31, 1985, 02869.
Print, Oct. 30, 1985, 02870.
Print, Oct. 31, 1985, 02871.
Print, Feb. 21, 1985, 02872.
Print, Mar. 21, 1984, 02881.
Print, Sep. 26, 1984, 02882.
Print, Sep. 25, 1984, 02883.
Prints, Jul. 24, 1981, 02889–02900.
Print, Oct. 22, 1985, 02901.
Print, Oct. 28, 1985, 02902.
Print, Oct. 30, 1985, 02904.
Print, Sep. 5, 1985, 02976.
Ford Motor Company Problem Report Worksheet, Nov. 20, 1989, 03153–03155.
Print, Mar. 23, 1989, 03211.
Engineering Change Notice, Jun. 26, 1989, 03224.
Print, Mar. 23, 1989, 03228.
Print, Mar. 23, 1989, 03309.
Print, Dec. 4, 1984, 03441.
Print, Dec. 4, 1984, 03443.
Print, May 1, 1985, 03498.
Print, Mar. 27, 1984, 03502.
Print, Date Stamped Nov. 13, 1989, 03644.
Print, Sep. 28, 1989, 03645.
Print, Date Stamped Feb. 2, 1990, 03646.
Print, Oct. 22, 1986, 03648.
Print, Oct. 7, 1985, 03649.
Print, Date Stamped Dec. 1, 1986, 03651.
Print, Aug. 29, 1985, 03652.
Print, Mar. 6, 1990, 03653–03655.
Print, Date Stamped Jul. 15, 1987, 03657.
Print, Date Stamped, Sep. 1, 1986, 03658.
Print, Date Stamped, Oct. 13, 1989, 03659.
Print, Feb. 6, 1990, 03660–03661.
Print, Date Stamped Feb. 2, 1990, 03662–03665.
Print, May 31, 1985, 03676.
Prints, Sep. 7, 1972, 03720–03721.
Print, Jul. 22, 1974, 03723.
Print, Aug. 21, 1981, 03726.
Print, Feb. 22, 1981, 03727.
Engineering Change Notice, Bill Hamilton, Jun. 17, 1985, 03732.
Print, May 1, 1985, 03733.
Print, Mar. 27, 1984, 03736–03737.
Engineering Change Notice, Bill Hamilton, May 30, 1985, 03738.
Print, Dec. 10, 1984, 03753.
Print, May 1, 1985, 03755–03756.
Print, Dec. 13, 1984, 03757.
Print, Dec. 3, 1985, 03758.
Print, Jan. 2, 1985, 03807.
Print, Jun. 12, 1973, 03809.
Print, Nov. 20, 1985, 03818.
Print, Oct. 4, 1966, 03825.
Print, Jun. 12, 1967, 03826.
Print, Dec. 4, 1984, 03843.
Print, Dec. 4, 1984, 03850.
Engineering Change Notice, Jun. 20, 1989, 03859.
Engineering Change Notice, Feb. 17, 1986, 03860.
Print, Oct. 4, 1966, 03879.
Print, Jun. 12, 1967, 03880.
Print, Undated, 03881.
Print, May 6, 1986, 03883.
Engineering Change Notice, Dec. 10, 1986, 03886.
Print, Oct. 4, 1966, 03898.
Print, Jun. 12, 1967, 03899.
Print, Feb. 18, 1967, 03902.
Engineering Change Notice, Jan. 14, 1986, 03931.
Print, Jun. 12, 1967, 03947.
Print, Dec. 18, 1967, 03950.
Print, Dec. 18, 1967, 03953–03954.
Print, Jun. 12, 1967, 03955–03956.
Engineering Change Notice, Aug. 1, 1991, 03957.
Engineering Change Notice, Jun. 26, 1989, 03960.
Prints, Sep. 28, 1984, 03972–03974.
Print, Dec. 4, 1984, 03988–03991.
Prints, Jan. 29, 1986, 03992–03993.
Print, Dec. 26, 1984, 03994.
Prints, Jan. 6, 1986, 03995–03996.
Print, May 1, 1965, 03997.
Print, Nov. 21, 1985, 03998.
Print, Dec. 3, 1985, 03999.
Print, Sep. 23, 1985, 04000.
Print, May 31, 1985, 04001.
Print, Mar. 6, 1986, 04002.
Print, Dec. 4, 1984, 04003.
Prints, May 1, 1985, 04004–04006.
Print, Dec. 4, 1984, 04007.
Print, May 1, 1985, 04008.
Print, Dec. 4, 1984, 04009–04010.
Print, May 1, 1985, 04011.
Print, May 3, 1984, 04012.
Print, Mar. 27, 1984, 04013.
Print, May 31, 1985, 04014.
Print, Mar. 6, 1986, 04015.
Print, May 1, 1985, 04016.
Print, May 1, 1985, 04022.

Print, May 1, 1985, 04023.
Print, Feb. 20, 1989, 04024.
Print, Feb. 25, 1984, 04025.
Print, Jun. 11, 1984, 04026.
Print, Sep. 27, 1984, 04027.
Print, Jan. 15, 1985, 04028.
Print, Feb. 8, 1985, 04029.
Print, Dec. 3, 1988, 04030.
Print, Jan. 29, 1986, 04031.
Print, Mar. 13, 1985, 04032.
Print, Feb. 20, 1989, 04033.
Print, Feb. 20, 1989, 04034.
Engineering Change Notice, Feb. 5, 1986, 04035.
Print, May 1, 1985, 04036.
Print, Mar. 27, 1984, 04037.
Prints, Dec. 4, 1984, 04038–04043.
Prints, Jan. 6, 1986, 04043–04046.
Print, Jun. 3, 1985, 04047.
Prints, Date Stamped Oct. 14, 1986, 04052–04054.
Print, Dec. 4, 1984, 04055–04061.
Print, Jul. 12, 1984, 04062.
Print, Jul. 12, 1984, 04063.
Print, Mar. 27, 1984, 04064.
Print, Mar. 27, 1984, 04065.
Print, Mar. 27, 1984, 04066.
Print, Mar. 27, 1984, 04067.
Print, Jul. 12, 1984, 04068.
Print, Mar. 27, 1984, 04069.
Print, Mar. 27, 1984, 04071.
Prints, Feb. 20, 1989, 04072–04073.
Print, May 31, 1985, 04074.

* cited by examiner

METERING SOCKET

FIELD OF THE INVENTION

This invention relates to sockets for push rods, and particularly to sockets for push rods used in combustion engines.

BACKGROUND OF THE INVENTION

Sockets for push rods are known in the art and are used in camshaft internal combustion engines. U.S. Pat. No. 5,855,191 to Blowers et al., the disclosure of which is hereby incorporated herein by reference, discloses a socket for a push rod. However, U.S. Pat. No. 5,855,191 to Blowers et al. does not disclose the forging of a socket for a push rod nor efficient manufacturing techniques in fabricating a socket for a push rod.

The present invention is directed to overcoming this and other disadvantages inherent in sockets presently manufactured.

SUMMARY OF THE INVENTION

The scope of the present invention is defined solely by the appended claims, and is not affected to any degree by the statements within this summary. Briefly stated, a socket, comprising, a body including a plurality of passages, a first surface, a second surface, and an outer surface; the first surface is configured to accommodate an insert; the second surface is configured to cooperate with an engine workpiece; the outer surface is configured to cooperate with the inner surface of an engine workpiece; and at least one of the surfaces is fabricated through forging.

BRIEF DESCRIPTION OF THE DRAWINGS RECEIVED

FIG. 57-*a* depicts the top view of a preferred embodiment of a roller follower body.

FIG. 57-*b* depicts the top view of a preferred embodiment of a roller follower body.

Figure 58:
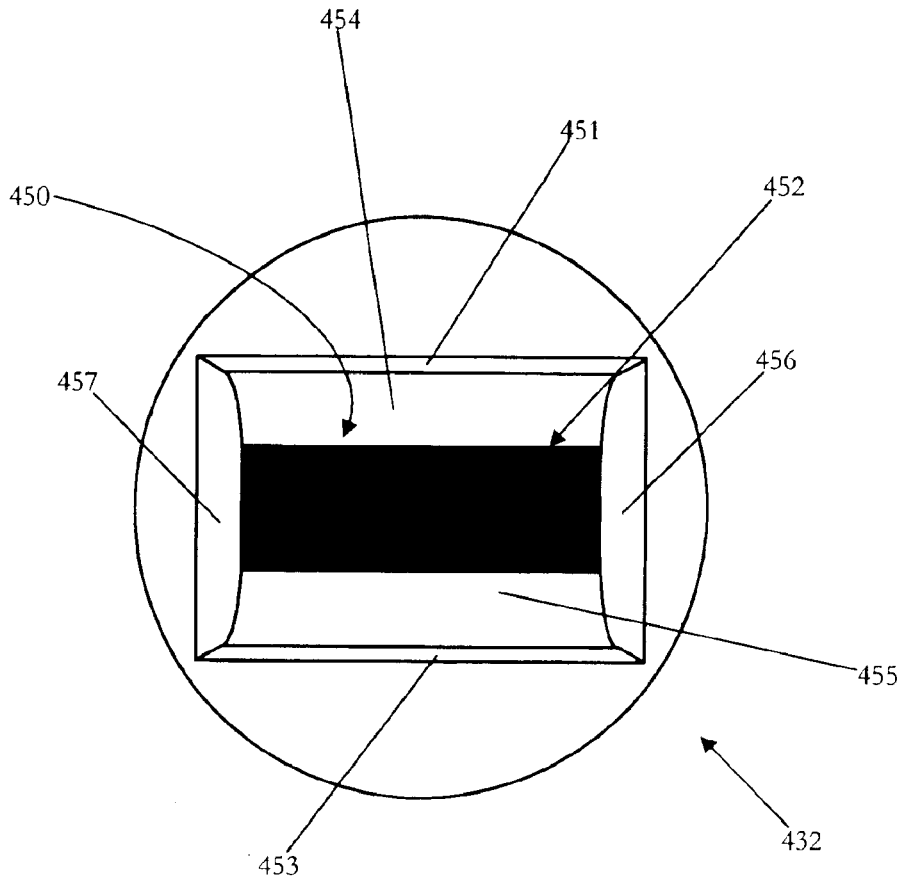

FIG. 58 depicts the top view of another preferred embodiment of a roller follower body.

Figure 59:
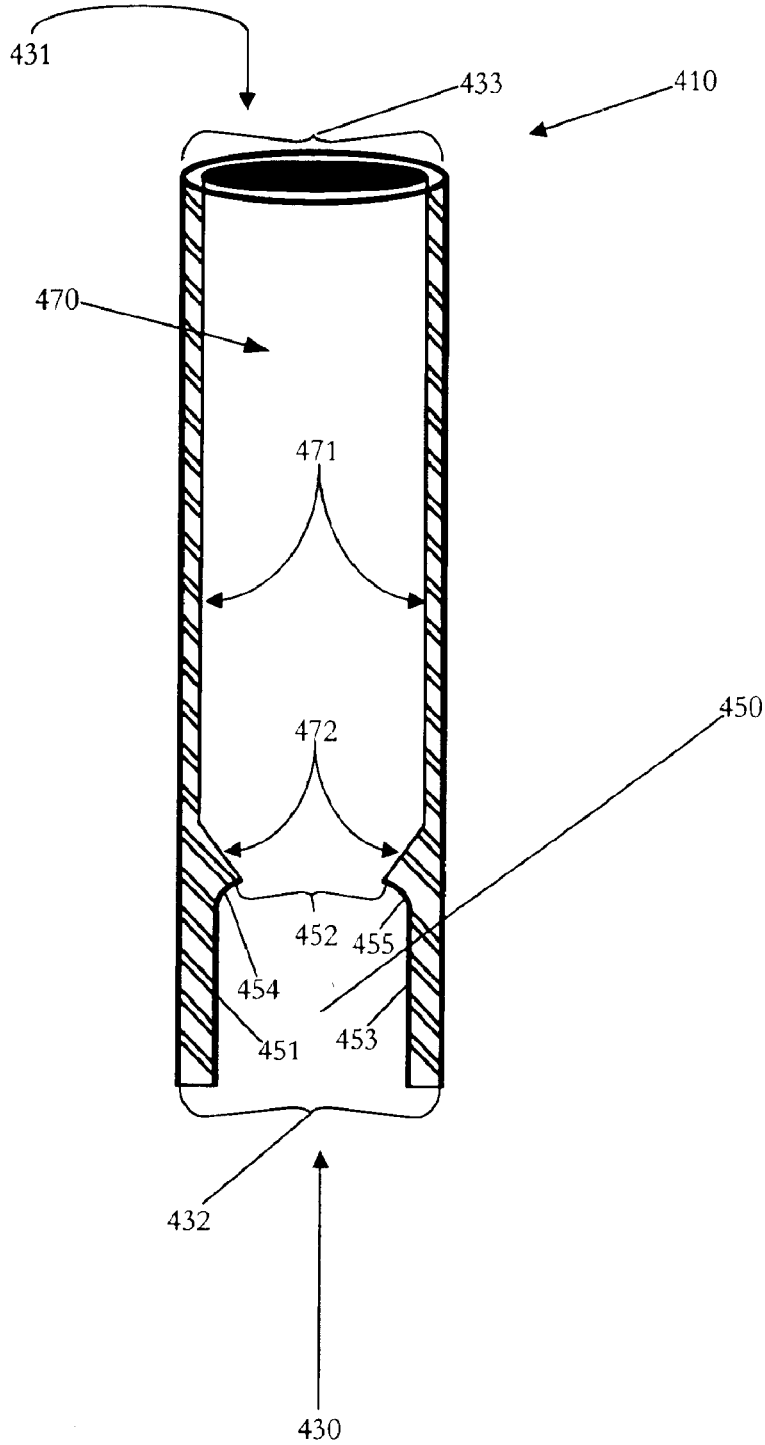

FIG. 59 depicts a second embodiment of a roller follower body.

Figure 60:
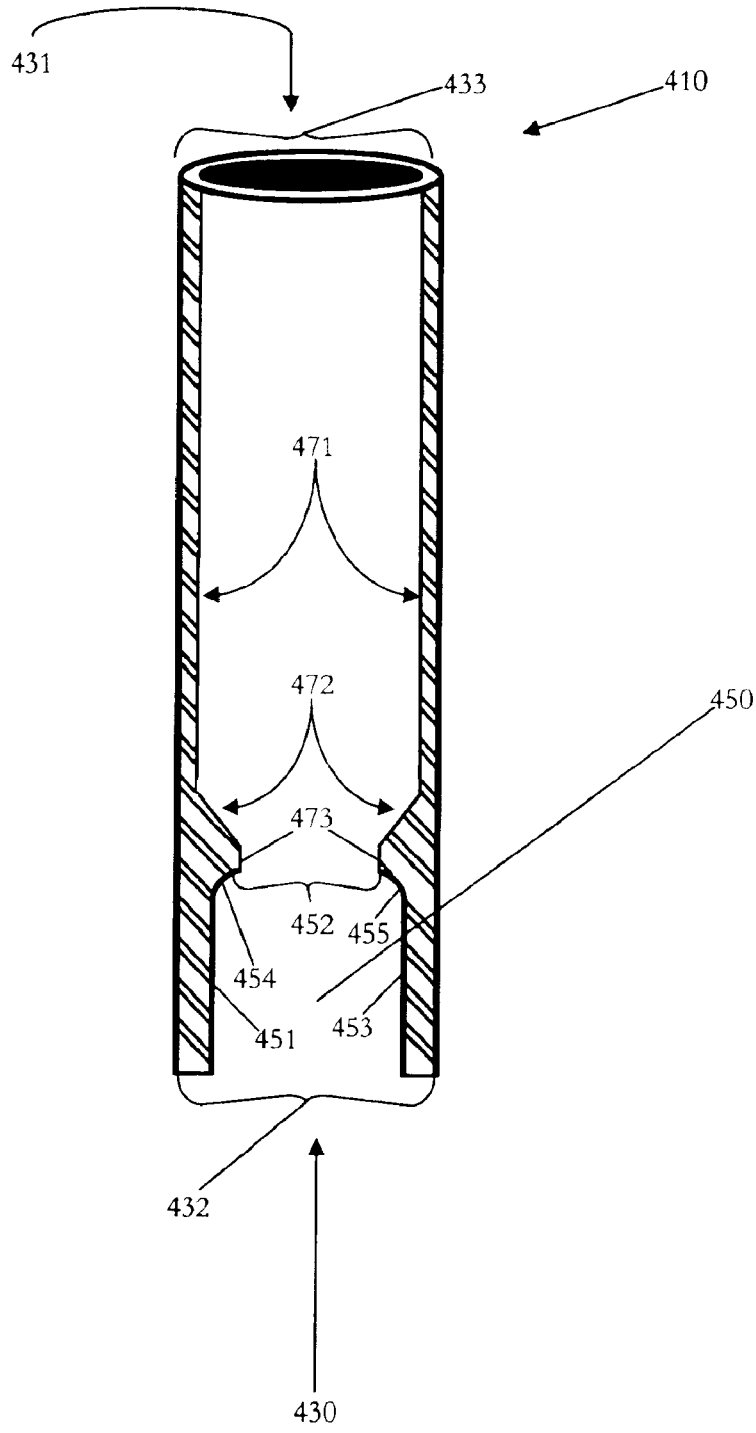

FIG. 60 depicts a third embodiment of a roller follower body.

Figure 61:
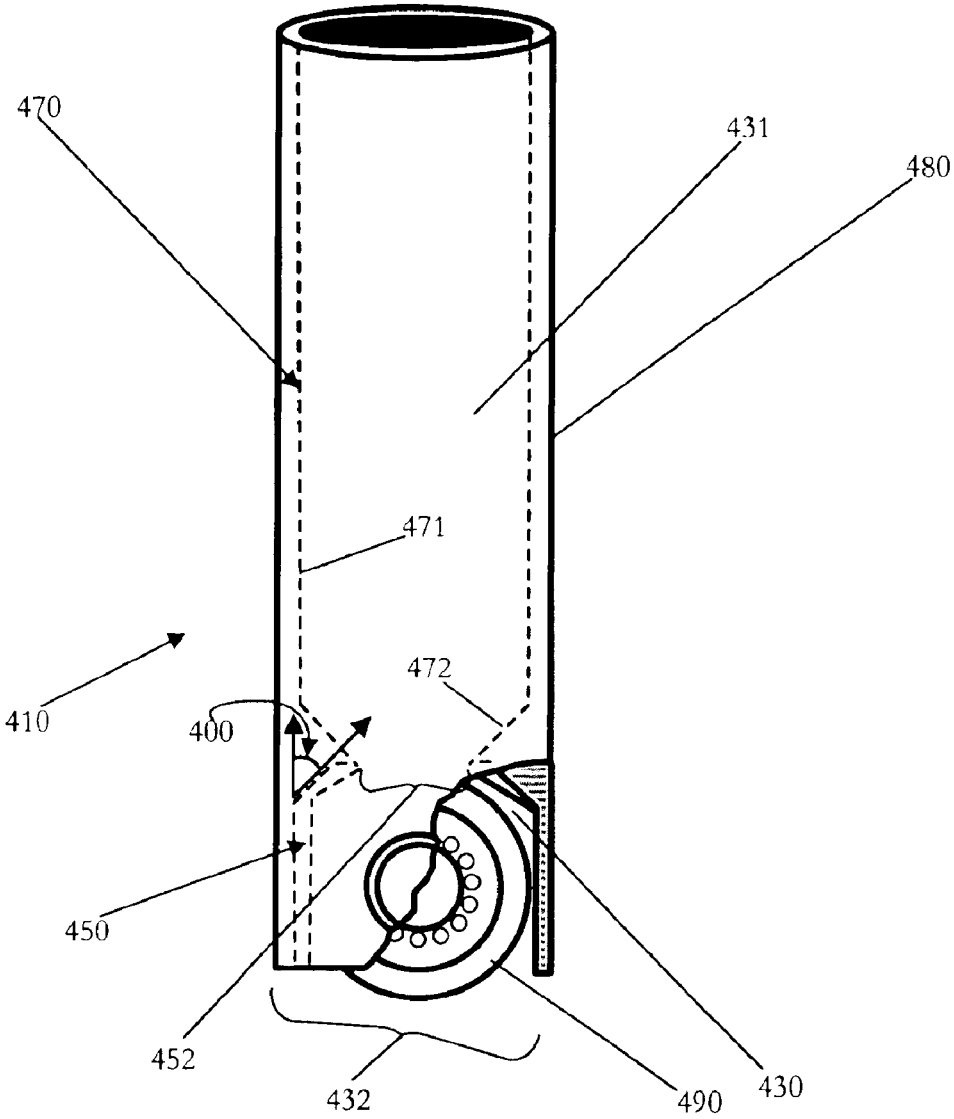

FIG. 61 depicts a fourth embodiment of a roller follower body.

Figure 62:
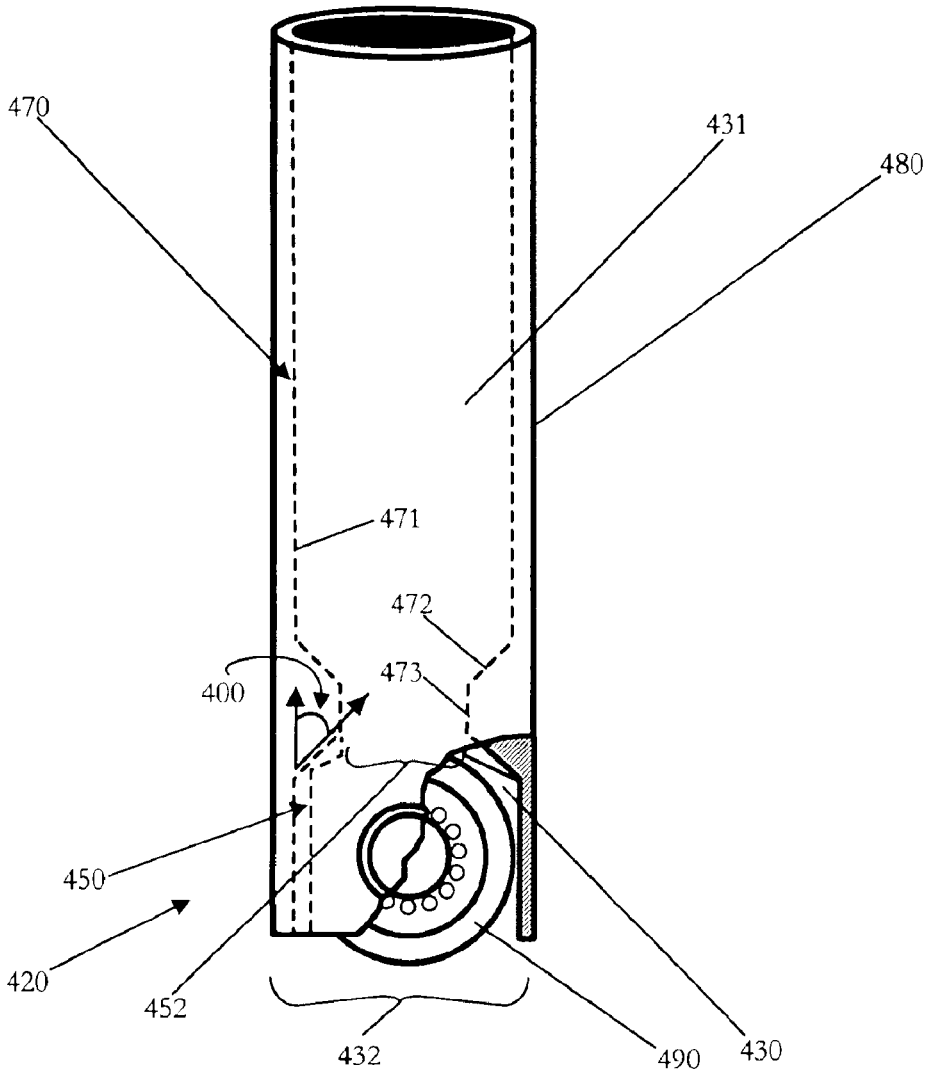

FIG. 62 depicts a fifth embodiment of a roller follower body.

Figure 63:
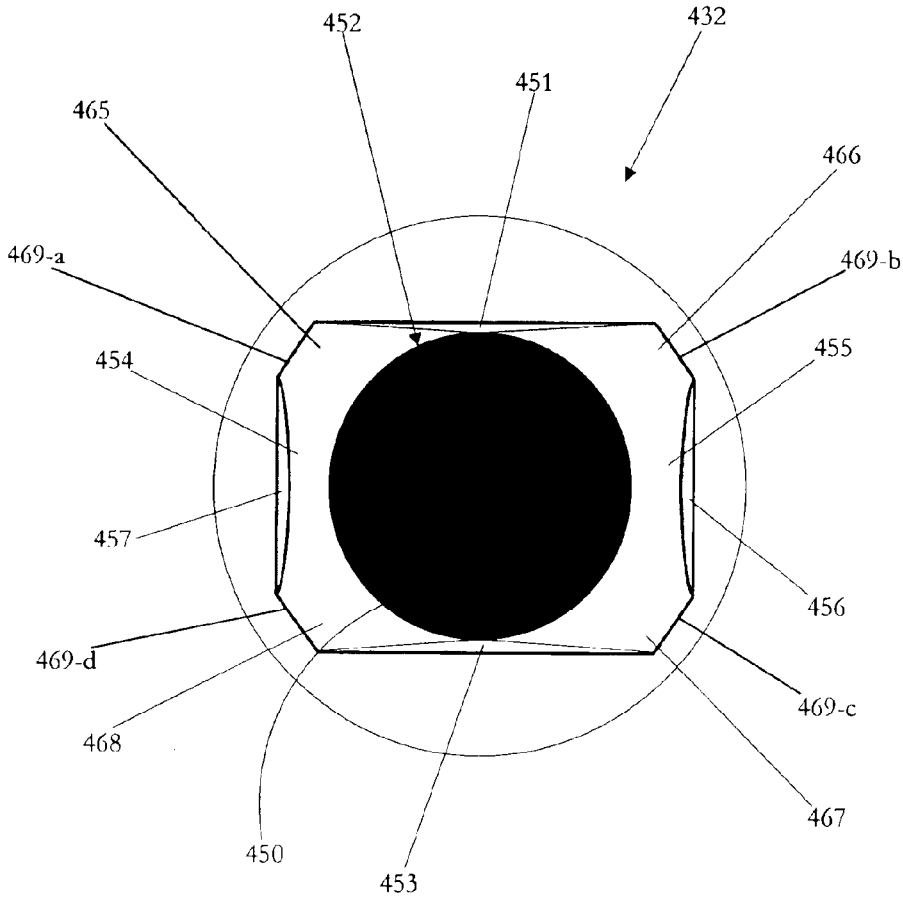

FIG. 63 depicts the top view of another preferred embodiment of a roller follower body.

Figure 64:
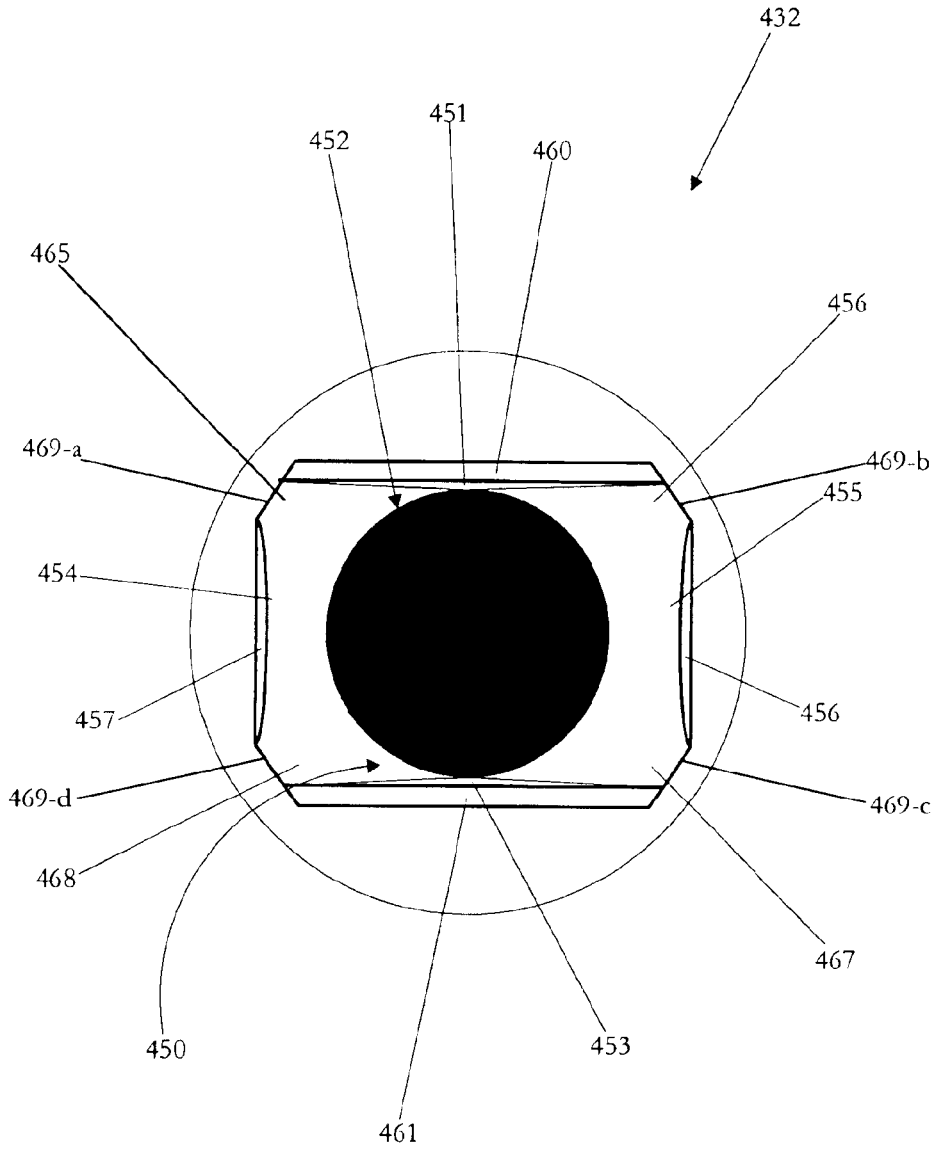

FIG. 64 depicts the top view of another preferred embodiment of a roller follower body.

Figure 65:
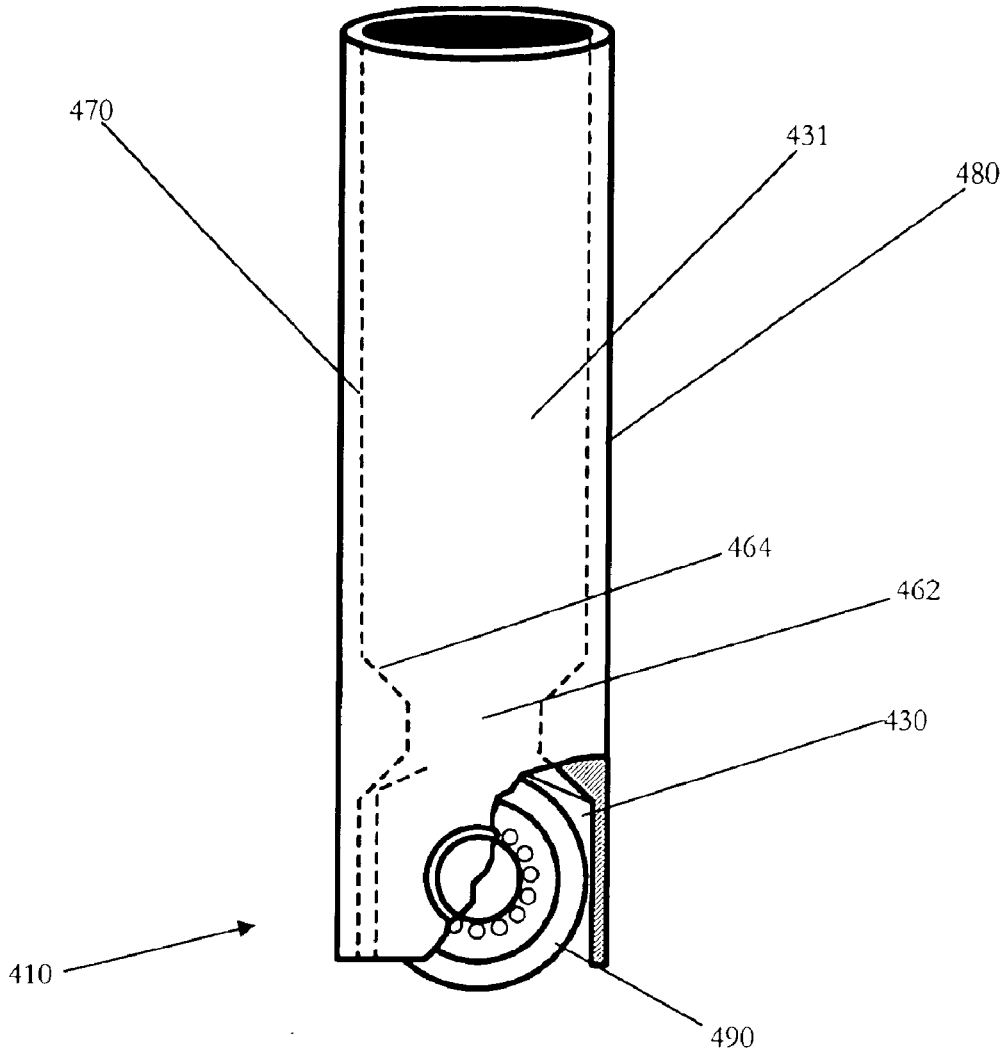

FIG. 65 depicts a sixth embodiment of a roller follower body.

Figure 66:
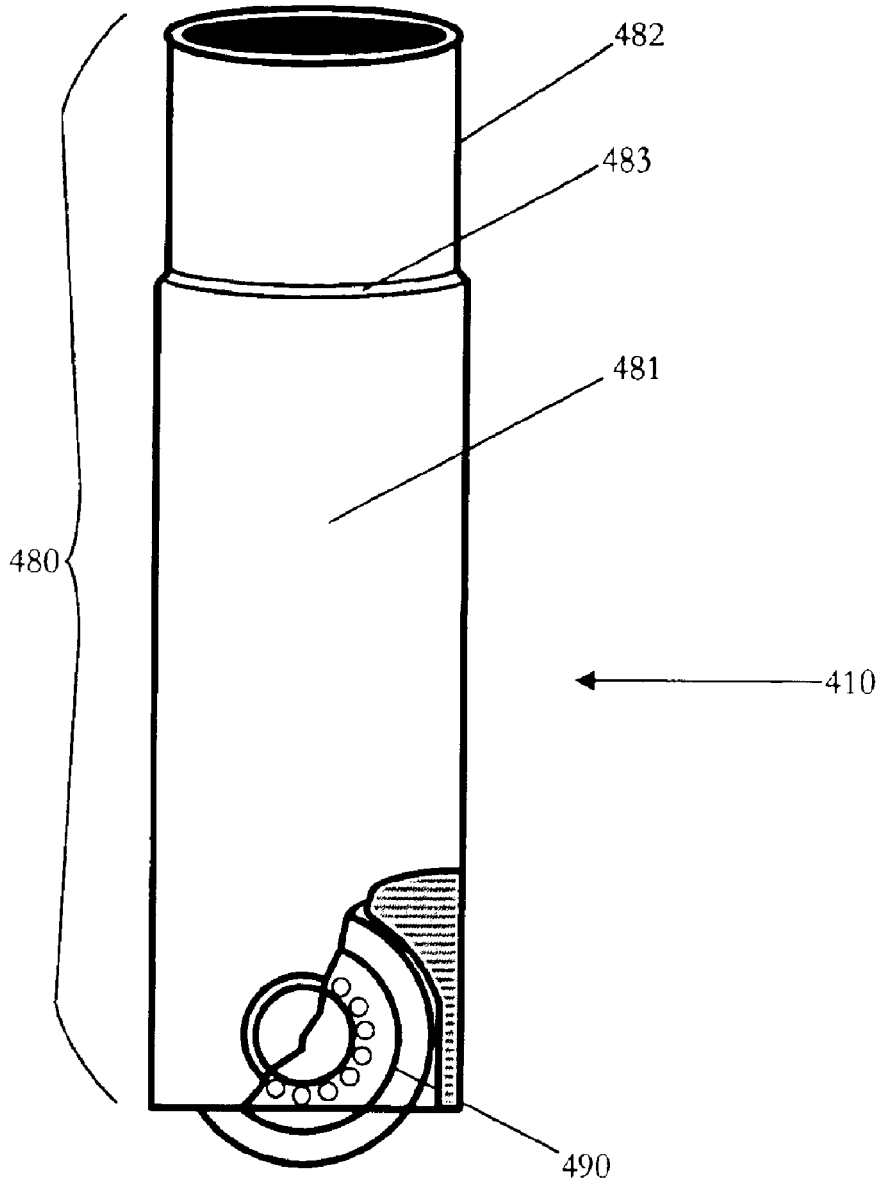

FIG. 66 depicts a seventh embodiment of a roller follower body.

Figure 67:
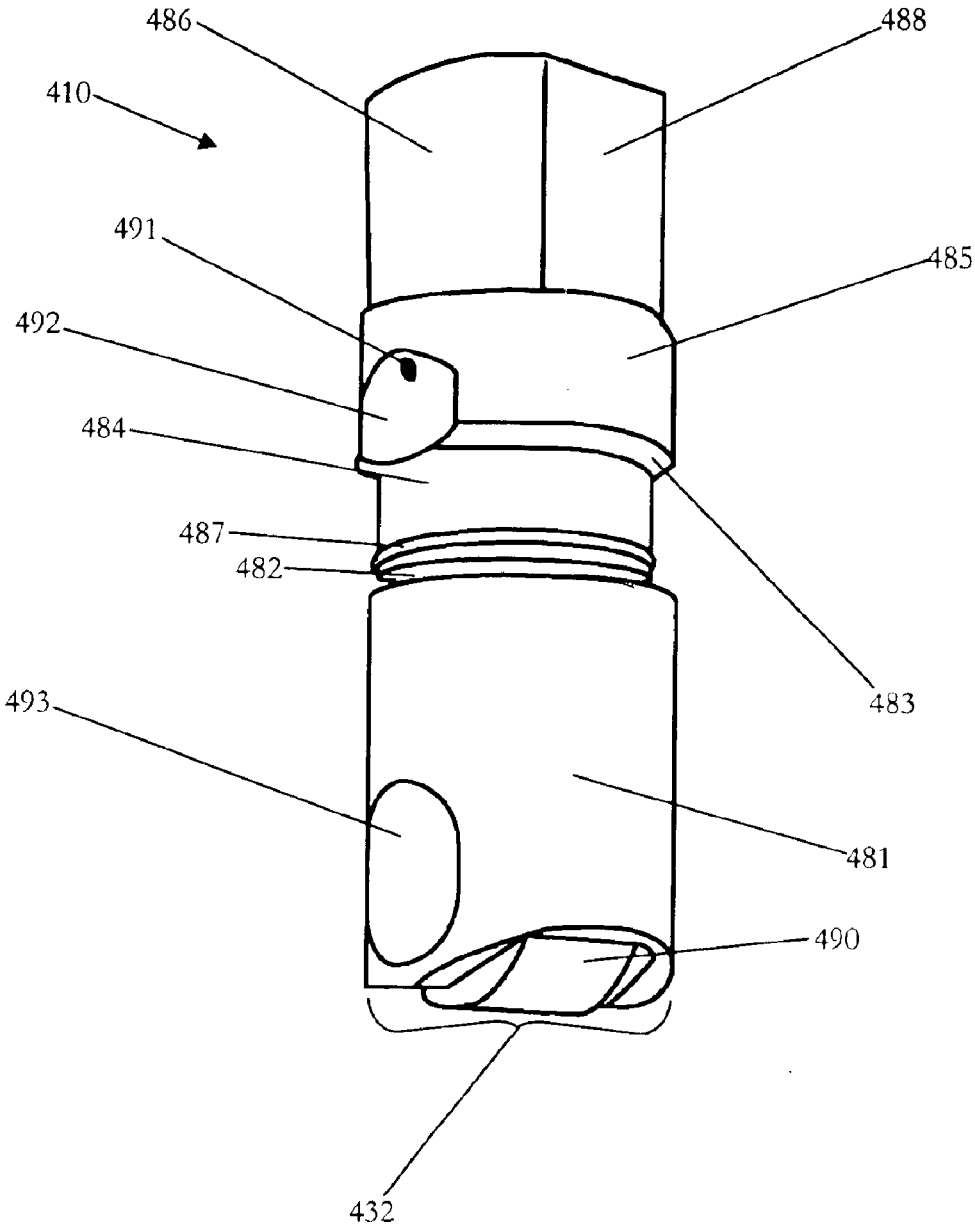

FIG. 67 depicts an eighth embodiment of a roller follower body.

DETAILED DESCRIPTION OF THE PRESENTLY PREFERRED EMBODIMENTS

Figure 1:
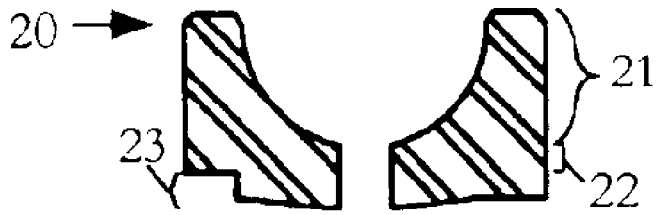
FIG. 1 depicts a preferred embodiment of a metering socket.
Figure 2:
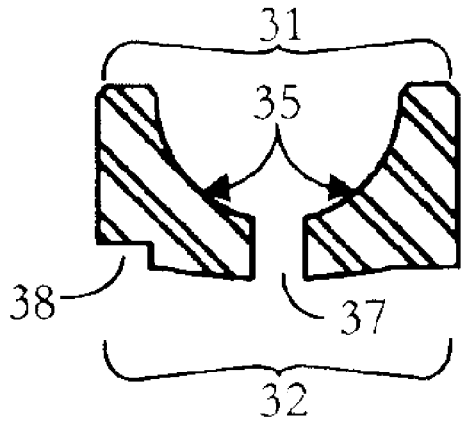
FIG. 2 depicts a preferred embodiment of a metering socket.
Figure 3:
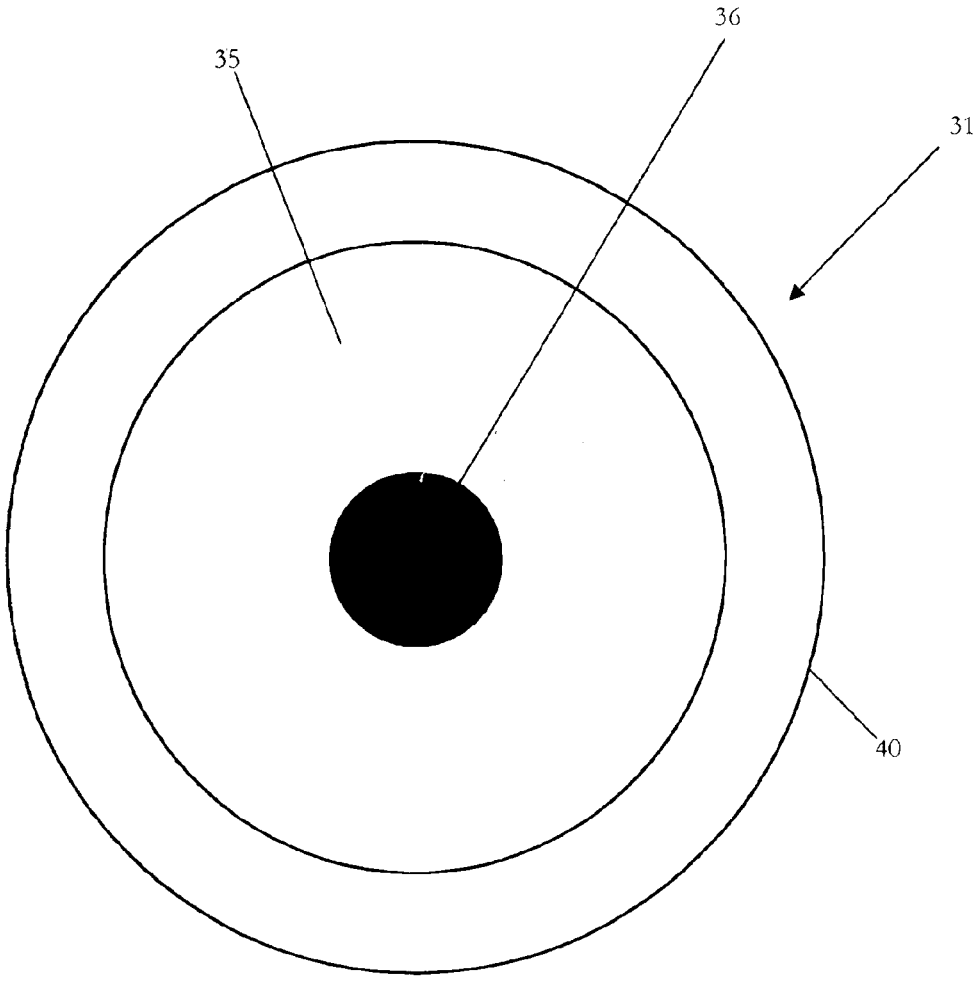
FIG. 3 depicts the top view of a surface of a metering socket.

Turning now to the drawings, FIGS. 1, 2, and 3 show a preferred embodiment of a metering socket 10. The metering socket 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the metering socket 10 is composed of pearlitic material. According to still another aspect of the present invention, the metering socket 10 is composed of austenitic material. According to another aspect of the present invention, the metal is a ferritic material.

The body 20 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 1 depicts a cross-sectional view of the metering socket 10 of the preferred embodiment of the present invention composed of a plurality of socket elements. FIG. 1 shows the body, generally designated 20. The body 20 functions to accept a liquid, such as a lubricant and is provided with a plurality of surfaces and passages. Referring now to FIG. 3, the first socket surface 31 functions to accommodate an insert, such as, for example, a push rod 96.

The body 20 of the preferred embodiment is fabricated from a single piece of metal wire or rod and is described herein as a plurality of socket elements. The body 20 includes a first hollow socket element 21, a second hollow socket element 22, and a third hollow socket element 23. As depicted in FIG. 1, the first hollow socket element 21 is located adjacent to the second hollow socket element 22. The second hollow socket element 22 is located adjacent to the third hollow socket element 23.

The first hollow socket element 21 functions to accept an insert, such as a push rod. The third hollow socket element 23 functions to conduct fluid. The second hollow socket element 22 functions to fluidly link the first hollow socket element 21 with the third hollow socket element 23.

Referring now to FIG. 2, the body 20 is provided with a plurality of outer surfaces and inner surfaces. FIG. 2 depicts a cross sectional view of the metering socket 10 of the preferred embodiment of the present invention. As shown in FIG. 2, the preferred embodiment of the present invention is provided with a first socket surface 31. The first socket surface 31 is configured to accommodate an insert. The metering socket 10 of the preferred embodiment is also provided with a second socket surface 32. The second socket surface 32 is configured to cooperate with an engine workpiece.

FIG. 3 depicts a top view of the first socket surface 31. As shown in FIG. 3, the first socket surface 31 is provided with a generally spherical push rod cooperating surface 35 defining a first socket hole 36. Preferably, the push rod cooperating surface 35 is concentric relative to the outer socket surface 40; however, such concentricity is not necessary. In the embodiment depicted in FIG. 3, the first socket hole 36 fluidly links the first socket surface 31 with a socket passage 37. The socket passage 37 is shaped to conduct fluid, preferably a lubricant. In the embodiment depicted in FIG. 3, the socket passage 37 is cylindrically shaped; however, those skilled in the art will appreciate that the socket passage 37 may assume any shape so long as it is able to conduct fluid.

Figure 4:
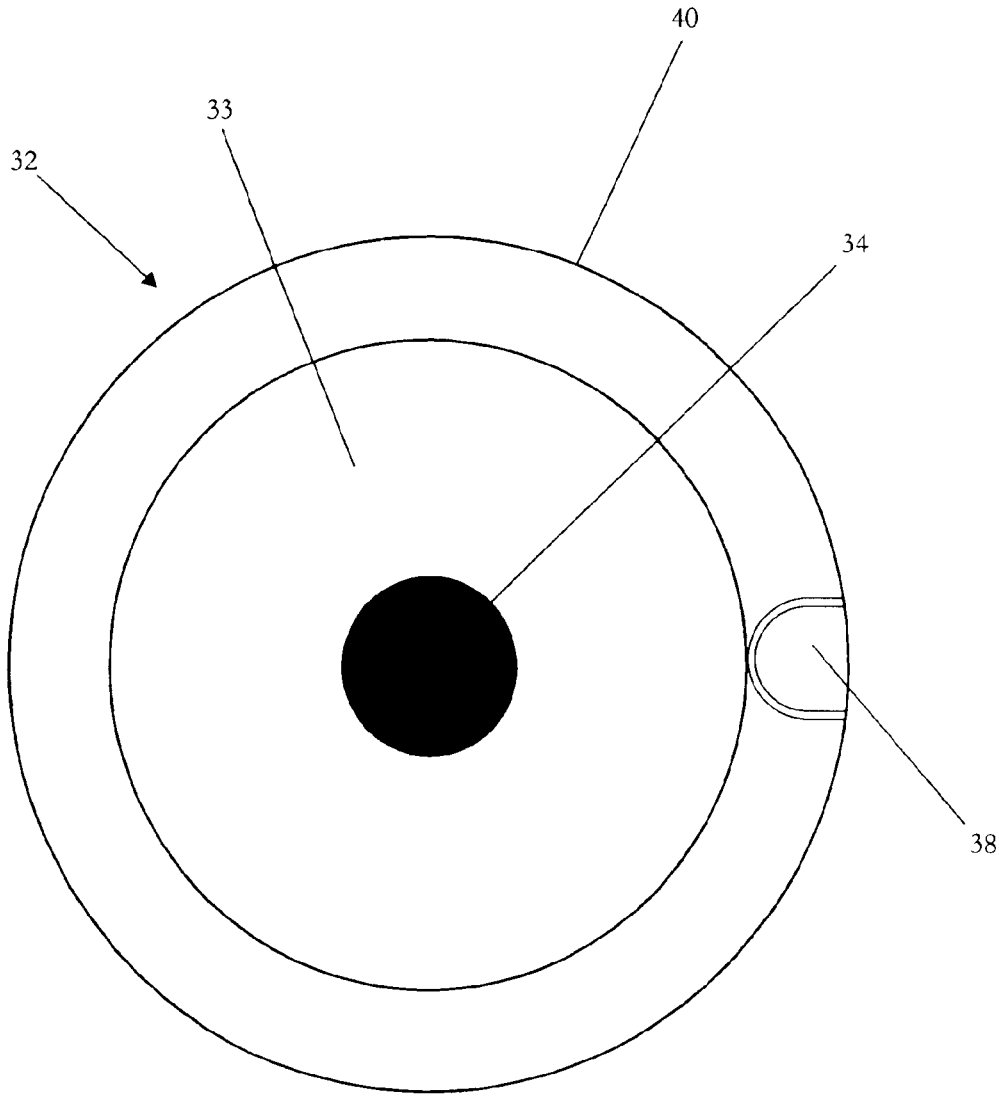
FIG. 4 depicts the top view of another surface of a metering socket.

FIG. 4 depicts a top view of the second socket surface 32. The second socket surface 32 is provided with a plunger reservoir passage 38. The plunger reservoir passage 38 is configured to conduct fluid, preferably a lubricant. As depicted in FIG. 4, the plunger reservoir passage 38 of the preferred embodiment is generally cylindrical in shape; however, those skilled in the art will appreciate that the plunger reservoir passage 38 may assume any shape so long as it conducts fluid.

The second socket surface 32 defines a second socket hole 34. The second socket hole 34 fluidly links the second socket surface 32 with socket passage 37. The second socket surface 32 is provided with a curved socket surface 33. The curved socket surface 33 is preferably concentric relative to the outer socket surface 40. However, those skilled in the art will appreciate that it is not necessary that the second socket surface 32 be provided with a curved socket surface 33 or that the curved socket surface 33 be concentric relative to the outer socket surface 40. The second socket surface 32 may be provided with any surface, and the curved socket surface 33 of the preferred embodiment may assume any shape so long as the second socket surface 32 cooperates with the opening of an engine workpiece.

Figure 5:
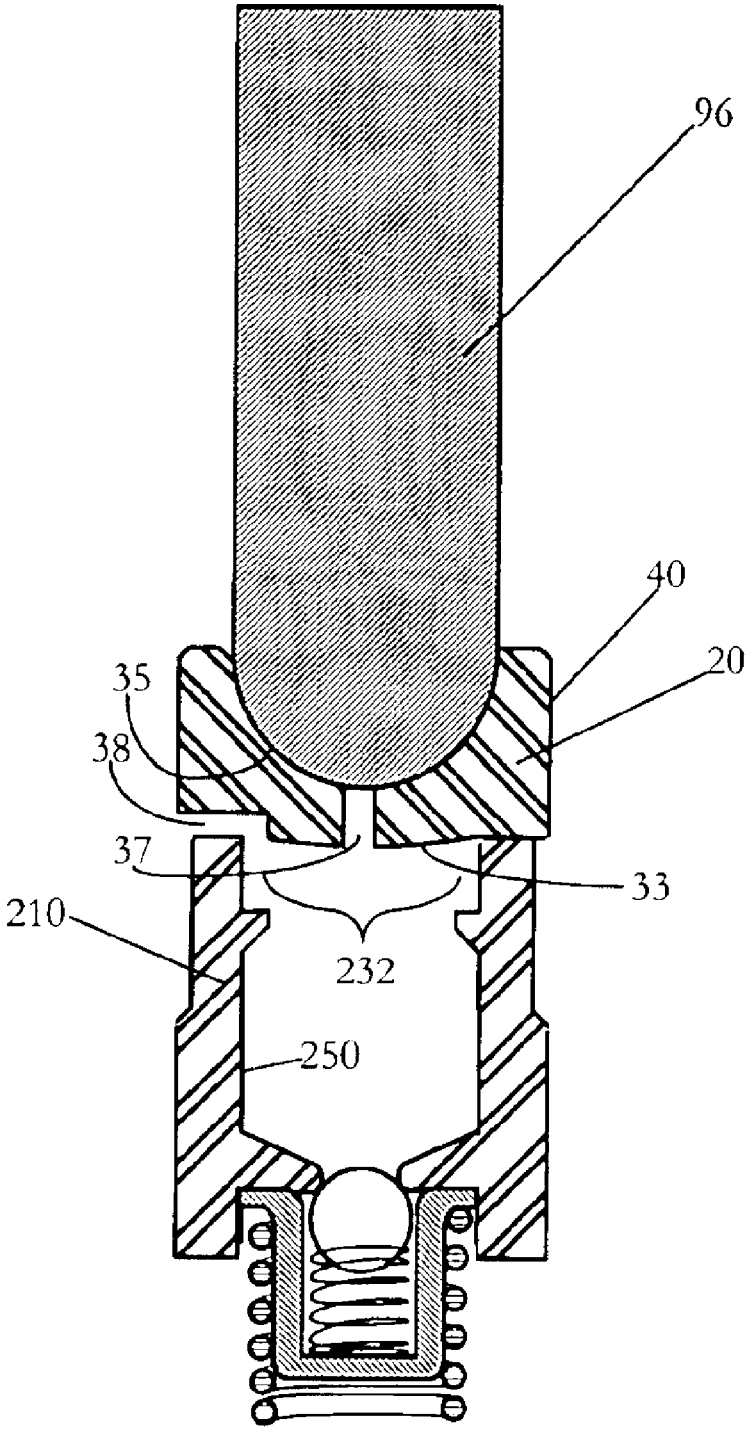
FIG. 5 depicts an embodiment of a metering socket accommodating an engine work piece.

Referring now to FIG. 5, the first socket surface 31 is depicted accommodating an insert. As shown in FIG. 5, that insert is a push rod 96. The second socket surface 32 is further depicted cooperating with an engine workpiece. In FIG. 5, that engine workpiece is a leakdown plunger 210, such as that disclosed in Applicants' "Leakdown Plunger," application Ser. No. 10/274,519 filed on Oct. 18, 2002, the disclosure of which is incorporated herein by reference. Those skilled in the art will appreciate that push rods other than the push rod 96 shown herein can be used without departing from the scope and spirit of the present invention. Furthermore, those skilled in the art will appreciate that leakdown plungers other than the leakdown plunger 210 shown herein can be used without departing from the scope and spirit of the present invention.

As depicted in FIG. 5, the curved socket surface 33 cooperates with a second plunger opening 232 of the leakdown plunger 210. According to one aspect of the present invention, the curved socket surface 33 preferably corresponds to the second plunger opening 232 of the leakdown plunger 210. According to another aspect of the present invention, the curved socket surface 33 preferably provides a closer fit between the second socket surface 32 of the body 20 and the second plunger opening 232 of the leakdown plunger 210.

In the embodiment depicted in FIG. 5, a socket passage 37 is provided. The socket passage 37 preferably functions to lubricate the push rod cooperating surface 35. The embodiment depicted in FIG. 5 is also provided with a plunger reservoir passage 38. The plunger reservoir passage 38 is configured to conduct fluid, preferably a lubricant.

The plunger reservoir passage 38 performs a plurality of functions. According to one aspect of the present invention, the plunger reservoir passage 38 fluidly links the second plunger opening 232 of the leakdown plunger 210 and the outer socket surface 40 of the body 20. According to another aspect of the present invention, the plunger reservoir passage 38 fluidly links the inner plunger surface 250 of the leakdown plunger 210 and the outer socket surface 40 of the body 20.

Those skilled in the art will appreciate that the plunger reservoir passage 38 can be extended so that it joins socket passage 37 within the body 20. However, it is not necessary that the passages 37, 38 be joined within the body 20. As depicted in FIG. 5, the plunger reservoir passage 38 of an embodiment of the present invention is fluidly linked to socket passage 37. Those skilled in the art will appreciate that the outer socket surface 40 is fluidly linked to the first socket surface 31 in the embodiment depicted in FIG. 5.

Figure 6:
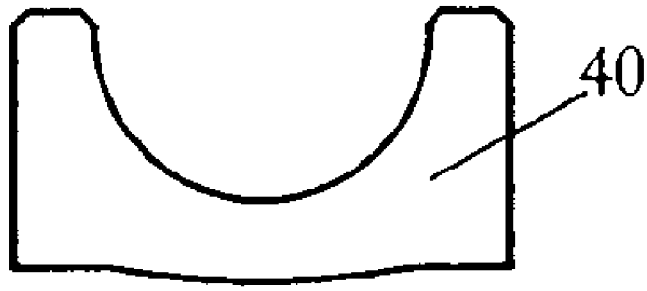
FIG. 6 depicts an outer surface of an embodiment of a metering socket.

As depicted in FIG. 6, the preferred embodiment of the metering socket 10 is provided with an outer socket surface 40. The outer socket surface 40 is configured to cooperate with the inner surface of an engine workpiece. The outer socket surface 40 of the presently preferred embodiment is cylindrically shaped. However, those skilled in the art will appreciate that the outer socket surface 40 may assume any shape so long as it is configured to cooperate with the inner surface of an engine workpiece.

Figure 7:
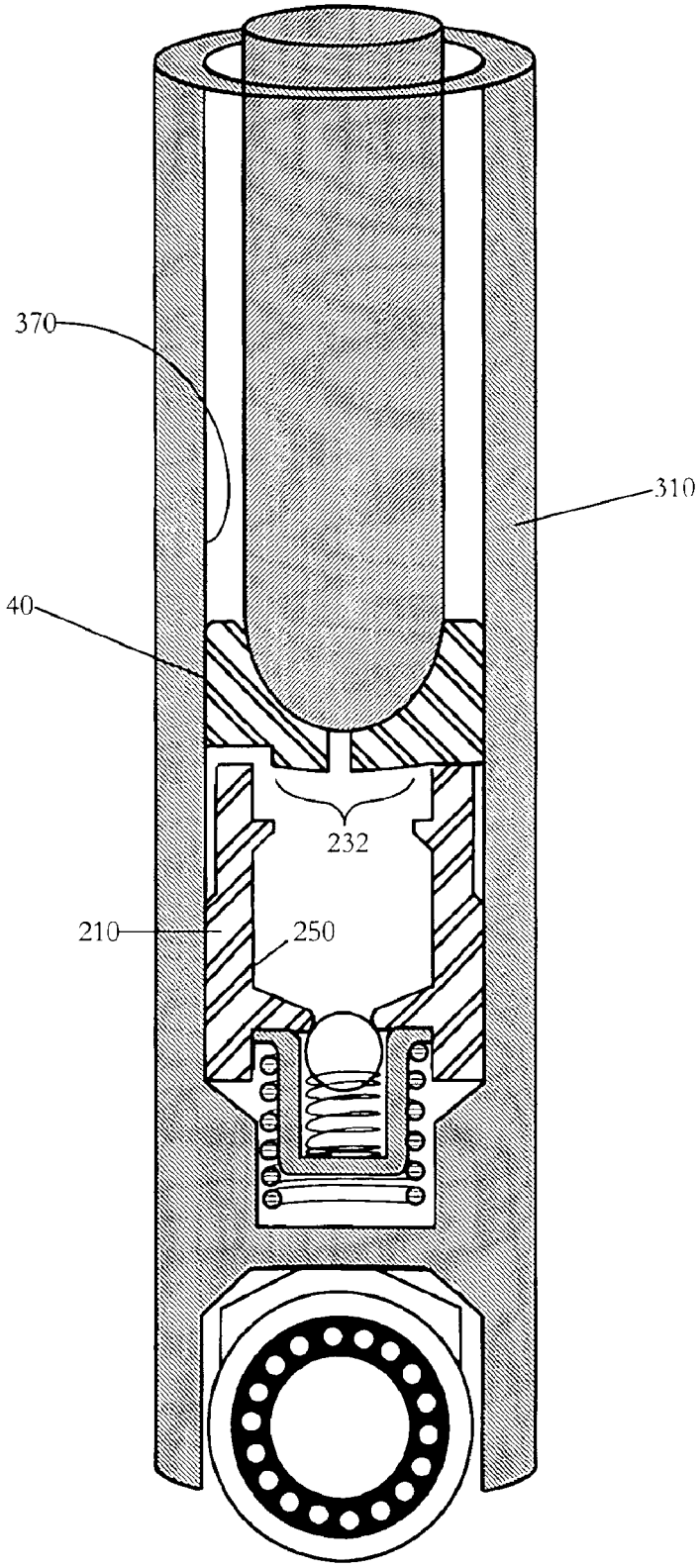
FIG. 7 depicts an embodiment of a metering socket cooperating with an engine work piece.

As depicted in FIG. 7, the outer socket surface 40 may advantageously be configured to cooperate with the inner surface of an engine workpiece. As shown in FIG. 7, the outer socket surface 40 is configured to cooperate with the second inner lifter surface 370 of a valve lifter body 310. Those skilled in the art will appreciate that the outer socket surface 40 may advantageously be configured to cooperate with the inner surfaces of other lifter bodies, such as, for example, the lifter bodies disclosed in Applicants' "Valve Lifter Body," application Ser. No. 10/316,263 filed on Oct. 18, 2002, the disclosure of which is incorporated herein by reference.

Figure 8:
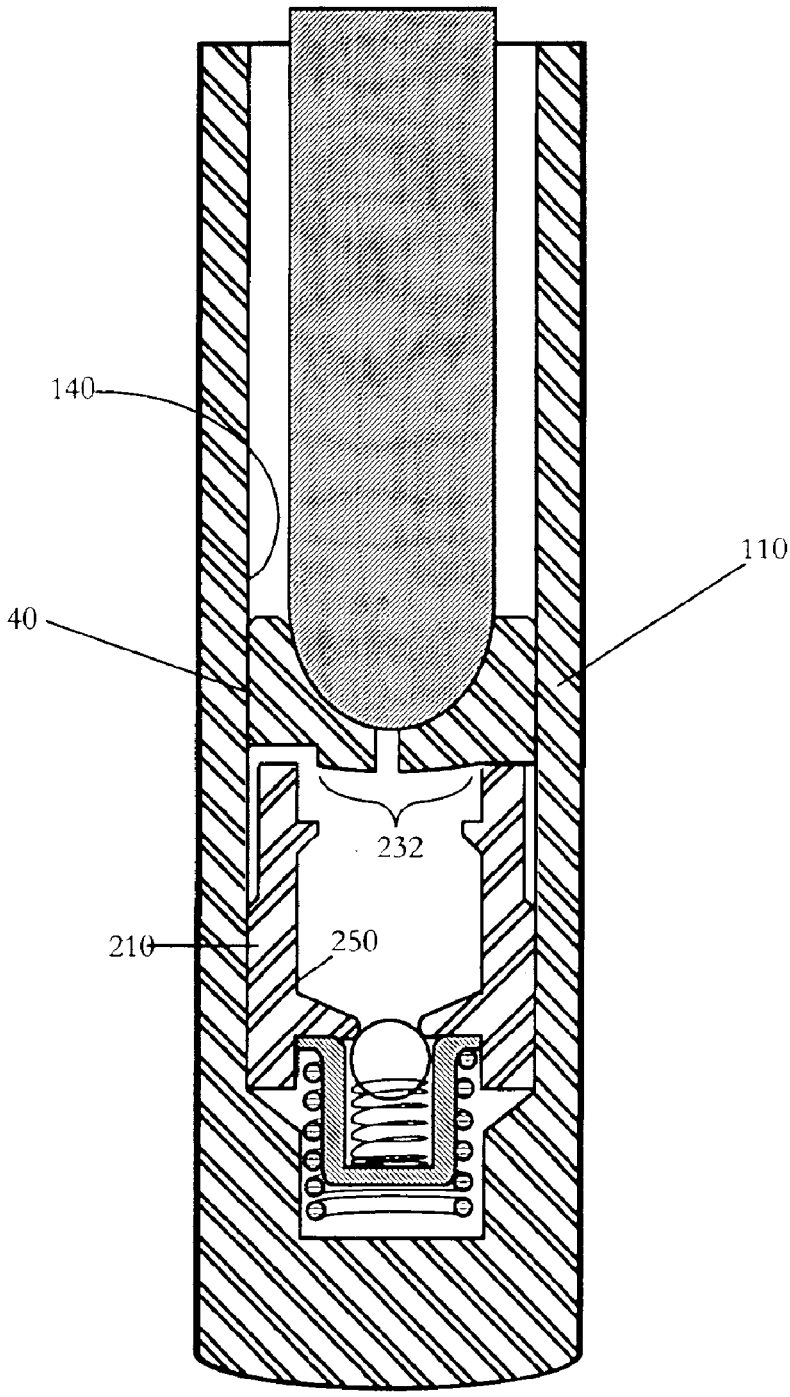
FIG. 8 depicts an embodiment of a metering socket cooperating with an engine work piece.
Figure 9:
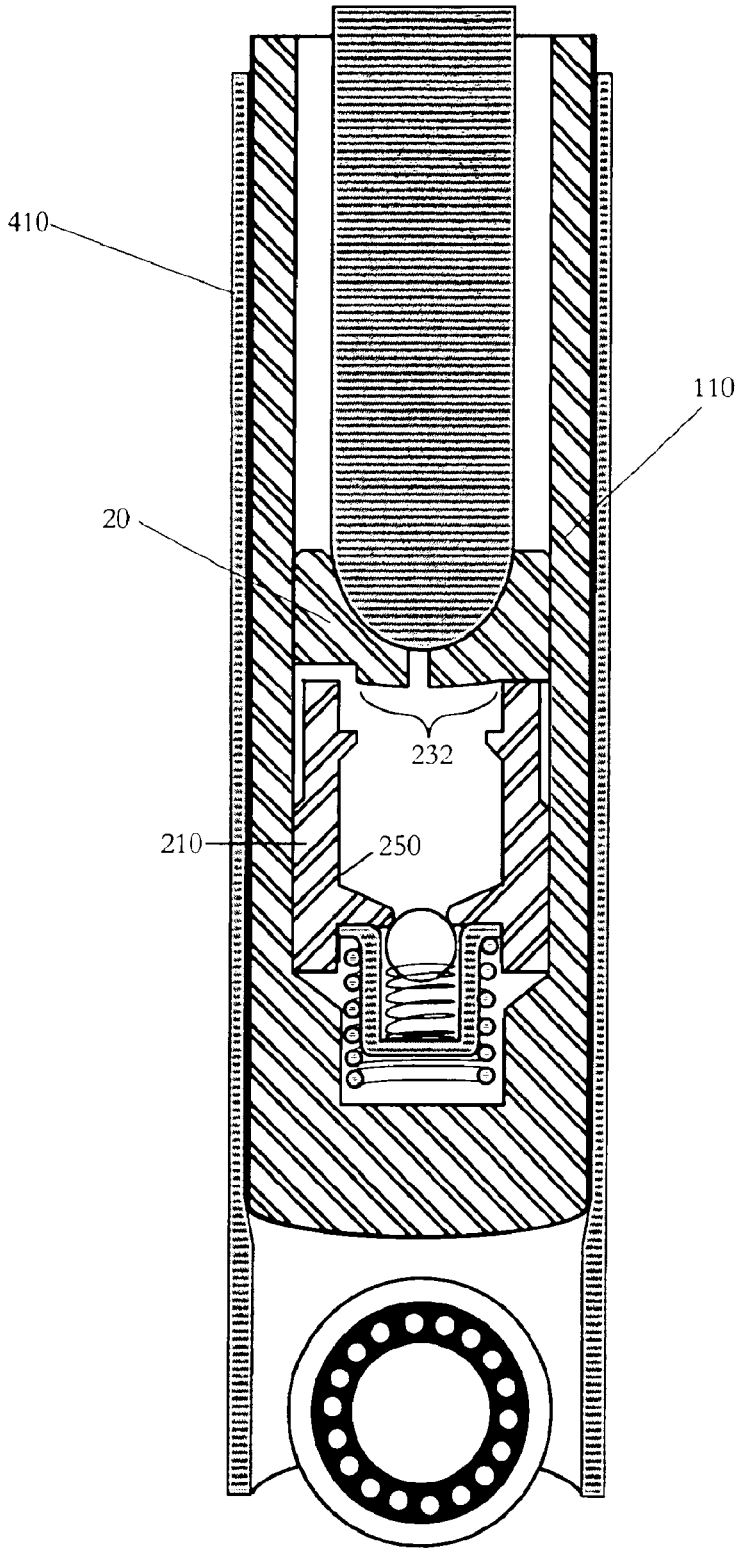
FIG. 9 depicts an embodiment of a metering socket cooperating with an engine work piece.

FIG. 8 depicts the outer socket surface 40 configured to cooperate with the inner surface of another workpiece. As shown in FIG. 8, the outer socket surface 40 is configured to cooperate with the inner lash adjuster surface 140 of a lash adjuster body 110. Those skilled in the art will appreciate that the outer socket surface 40 may be configured to cooperate with a lash adjuster, such as that disclosed in Applicants' "Lash Adjuster Body," application Ser. No. 10/316,264 filed on Oct. 18, 2002, the disclosure of which is incorporated herein by reference. As depicted in FIG. 9, the lash adjuster body 110, with the body 20 of the present invention located therein, may be inserted into a roller follower body 410, such as that disclosed in Applicants' "Roller Follower Body," application Ser. No. 10/316,261 filed on Oct. 18, 2002, the disclosure of which is incorporated herein by reference.

Referring now to FIG. 10 to FIG. 14, the presently preferred method of fabricating a metering socket 10 is disclosed. FIGS. 10 to 14 depict what is known in the art as a "slug progression" that shows the fabrication of the present invention from a rod or wire to a finished or near-finished body. In the slug progression shown herein, pins are shown on the punch side; however, those skilled in the art will appreciate that the pins can be switched to the die side without departing from the scope of the present invention.

The metering socket 10 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 10:
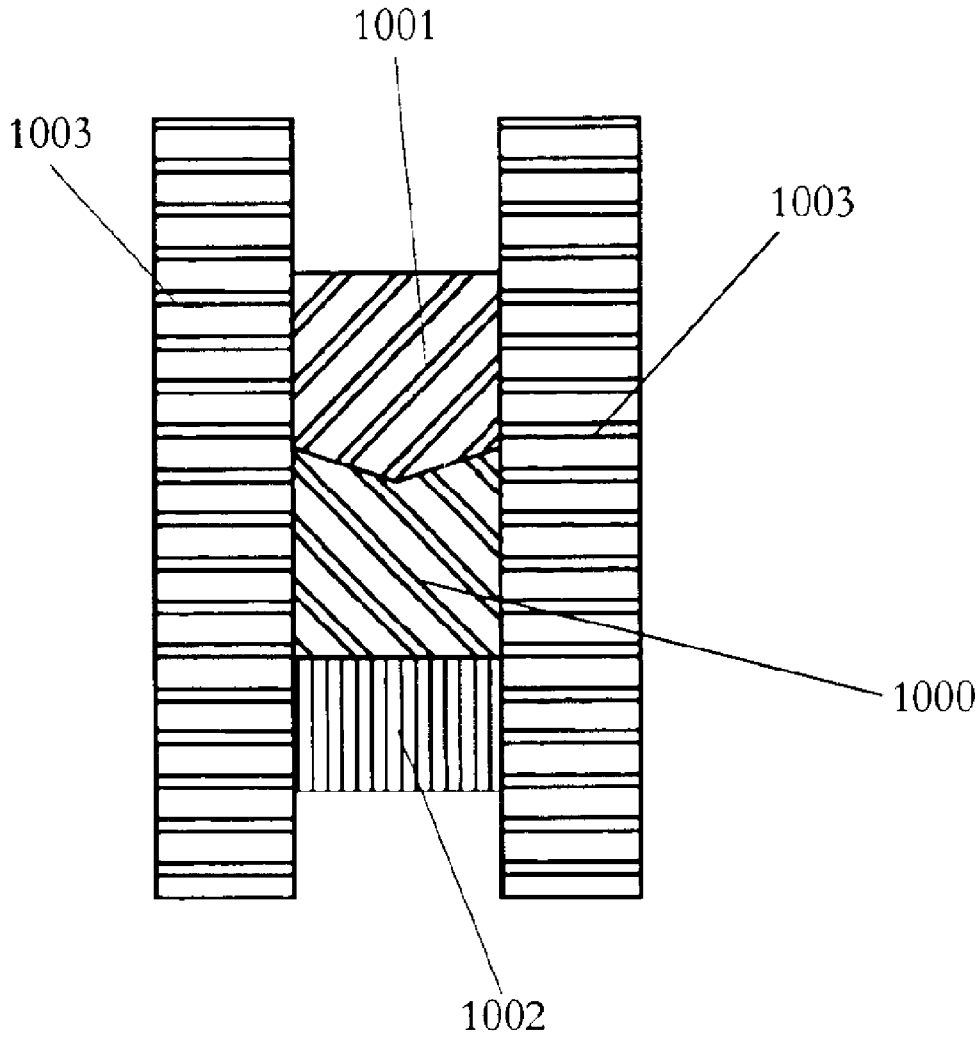
FIGS. 10–14 depict a preferred method of fabricating a metering socket.

The process of forging an embodiment of the present invention begins with a metal wire or metal rod 1000 which is drawn to size. The ends of the wire or rod are squared off. As shown in FIG. 10, this is accomplished through the use of a first punch 1001, a first die 1002, and a first knock out pin 1003.

Figure 11:
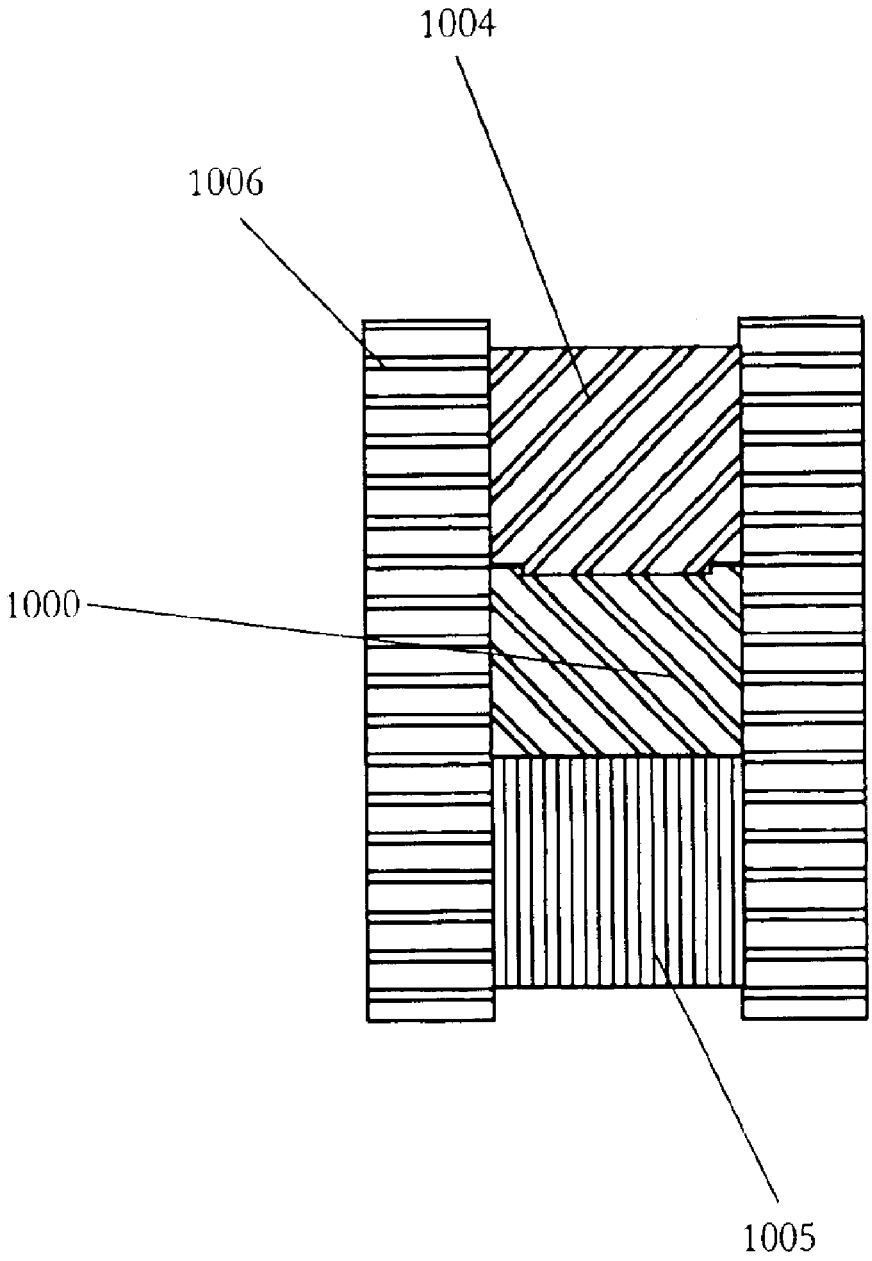

After being drawn to size, the wire or rod 1000 is run through a series of dies or extrusions. As depicted in FIG. 11, the fabrication of the first socket surface 31, the outer socket surface 40, and the second socket surface 32 is preferably commenced through use of a second punch 1004, a second knock out pin 1005, and a second die 1006. The second punch 1004 is used to commence fabrication of the first socket surface 31. The second die 1006 is used against the outer socket surface 40. The second knock out pin 1005 is used to commence fabrication of the second socket surface 32.

Figure 12:
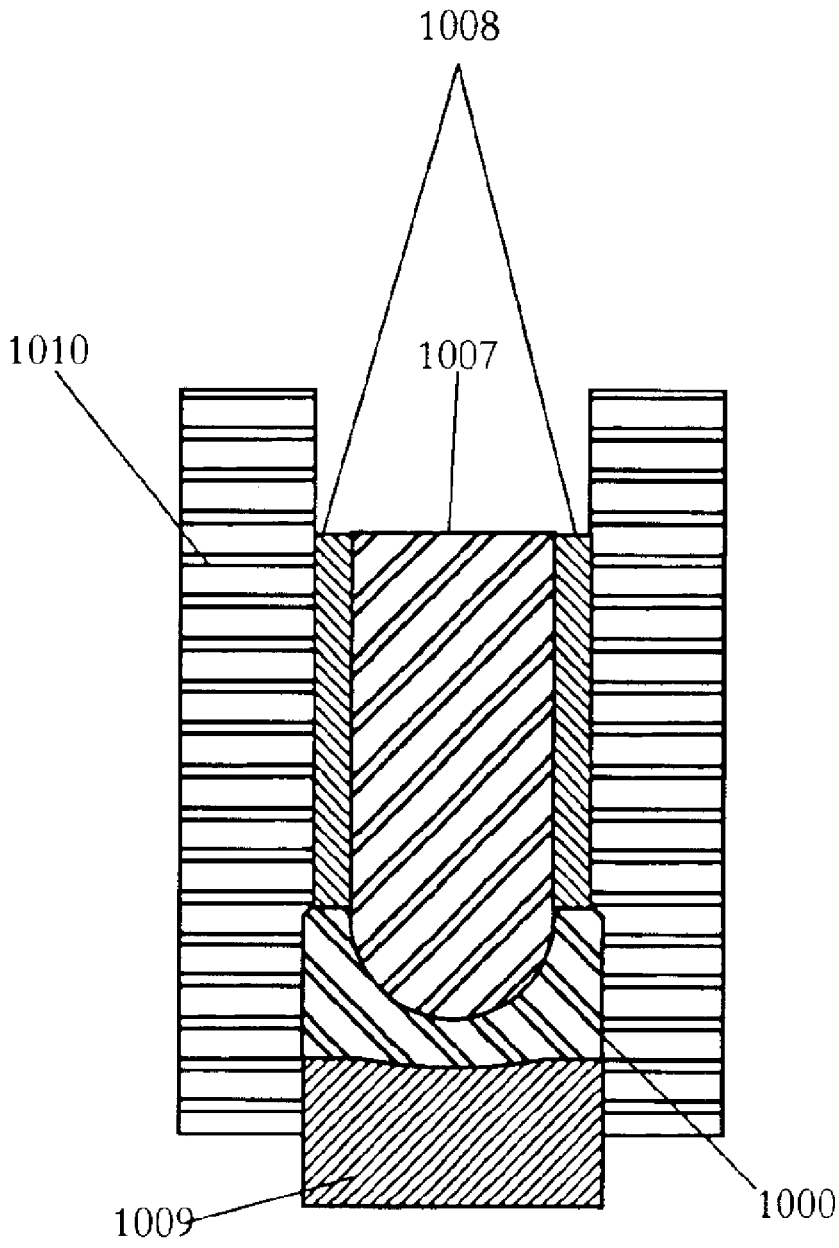

FIG. 12 depicts the fabrication of the first socket surface 31, the second socket surface 32, and the outer socket surface 40 through use of a third punch 1007, a first stripper sleeve 1008, a third knock out pin 1009, and a third die 1010. The first socket surface 31 is fabricated using the third punch 1007. The first stripper sleeve 1008 is used to remove the third punch 1007 from the first socket surface 31. The second socket surface 32 is fabricated through use of the third knock out pin 1009, and the outer socket surface 40 is fabricated through use of the third die 1010.

Figure 13:
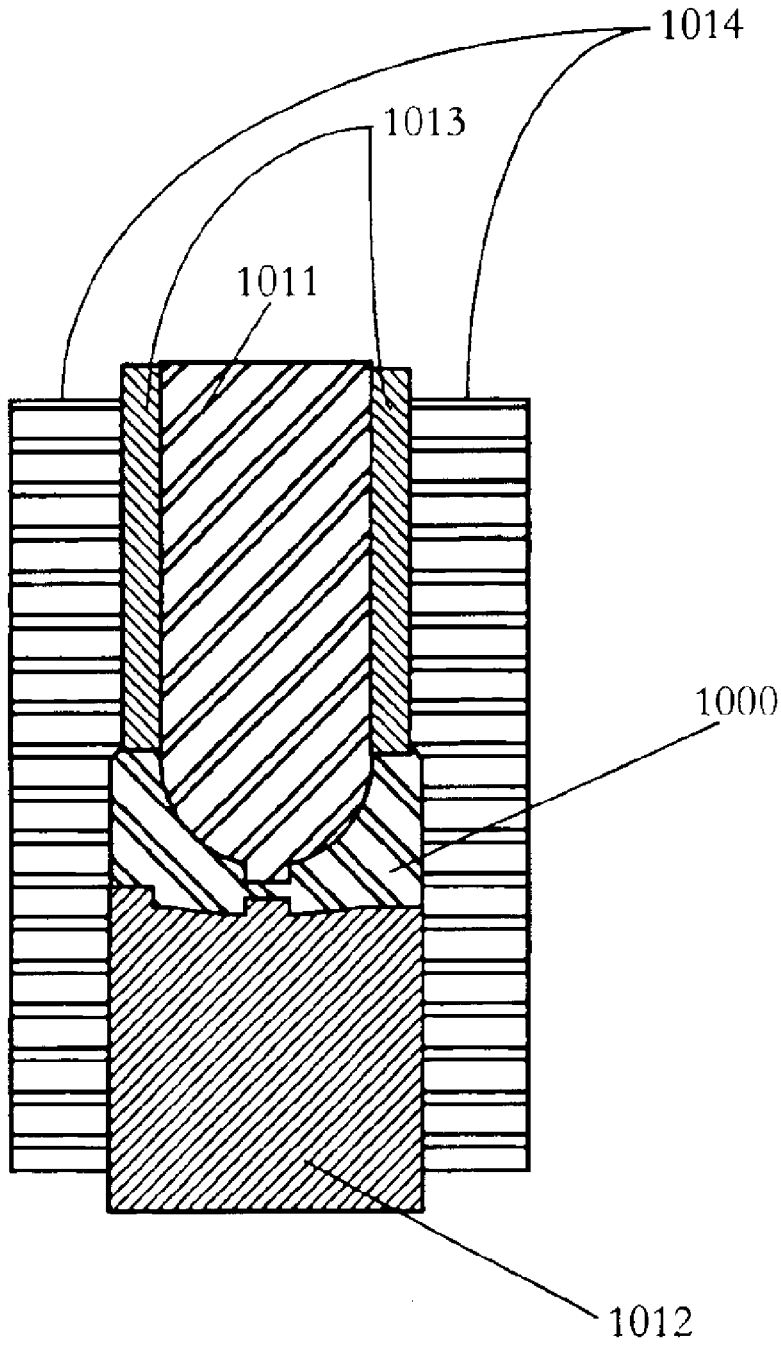

As depicted in FIG. 13, the fabrication of the passages 37, 38 is commenced through use of a punch pin 1011 and a fourth knock out pin 1012. A second stripper sleeve 1013 is used to remove the punch pin 1011 from the first socket surface 31. The fourth knock out pin 1012 is used to fabricate the plunger reservoir passage 38. A fourth die 1014 is used to prevent change to the outer socket surface 40 during the fabrication of the passages 37, 38.

Figure 14:
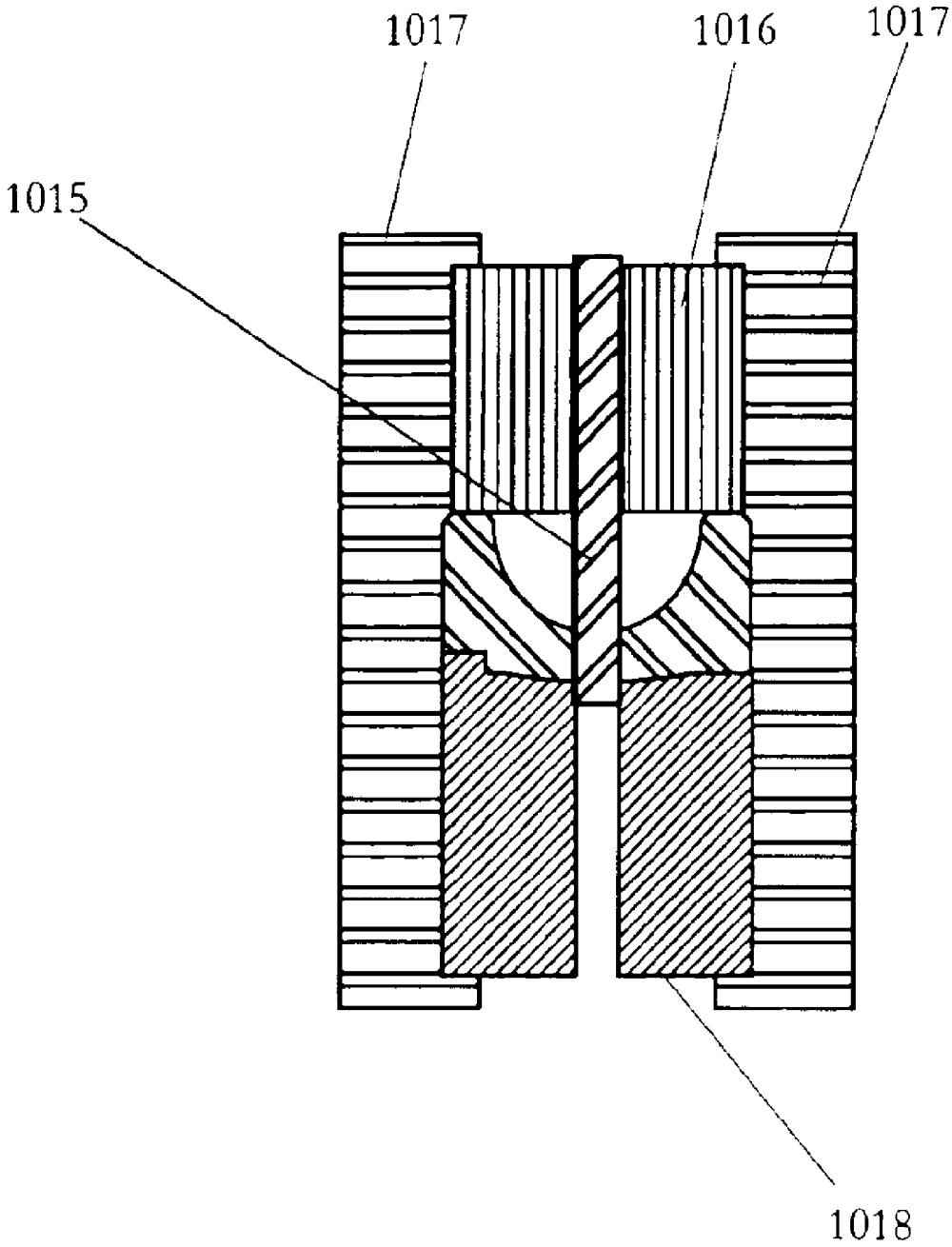

Referring now to FIG. 14, fabrication of socket passage 37 is completed through use of pin 1015. A third stripper sleeve 1016 is used to remove the pin 1015 from the first socket surface 31. A fifth die 1017 is used to prevent change to the outer socket surface 40 during the fabrication of socket passage 37. A tool insert 1018 is used to prevent change to the second socket surface 32 and the plunger reservoir passage 38 during the fabrication of socket passage 37.

Those skilled in the art will appreciate that further desirable finishing may be accomplished through machining. For example, passages 37, 38 may be enlarged and other passages may be drilled. However, such machining is not necessary.

Figure 15:
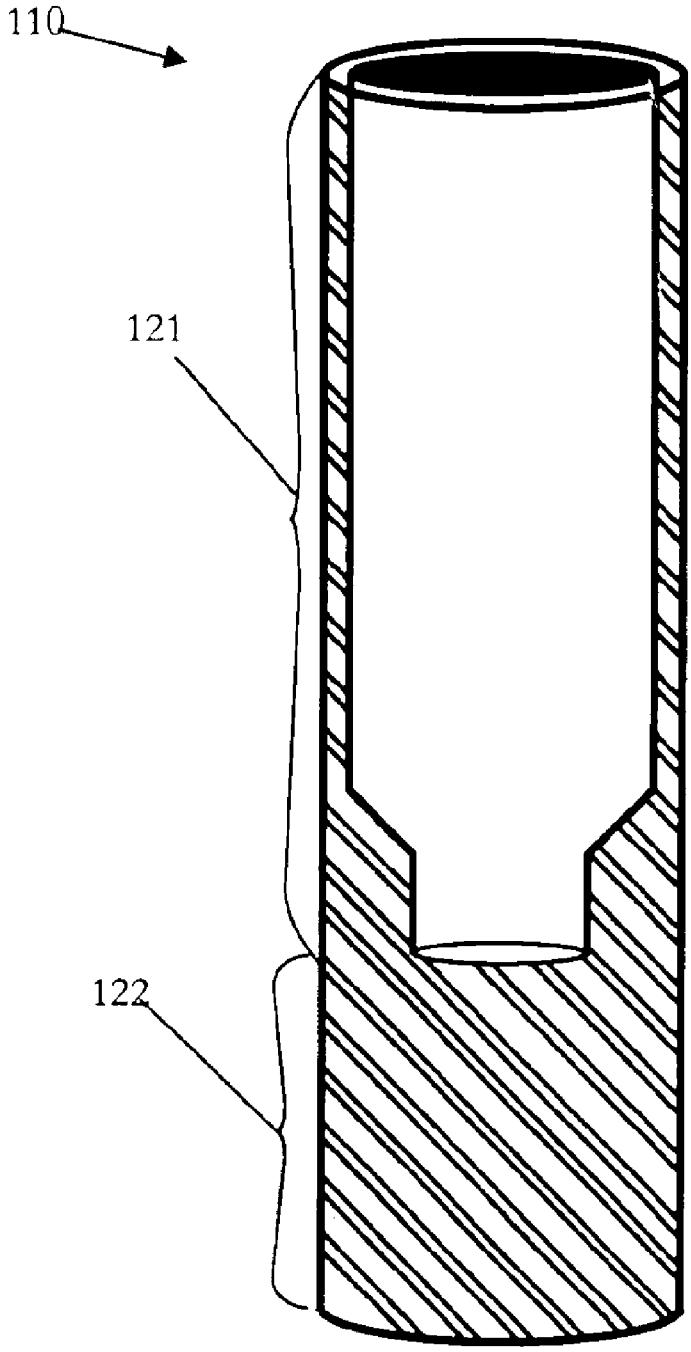
FIG. 15 depicts a preferred embodiment of a lash adjuster body.
Figure 16:
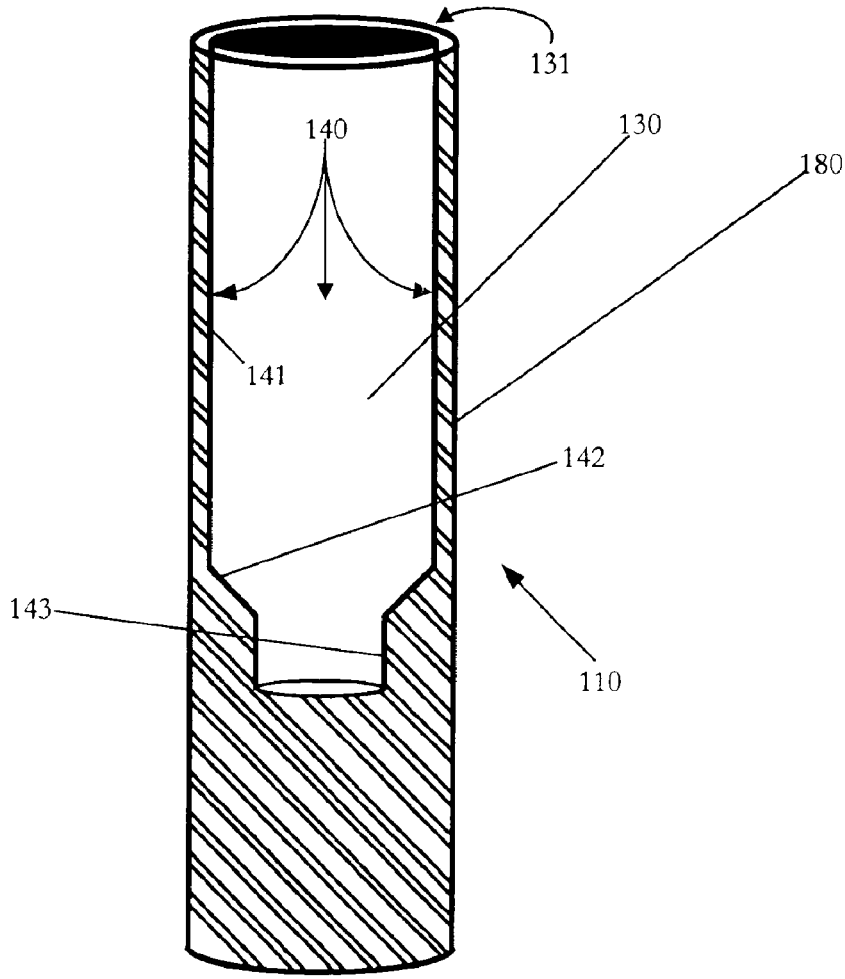
FIG. 16 depicts a preferred embodiment of a lash adjuster body.
Figure 17:
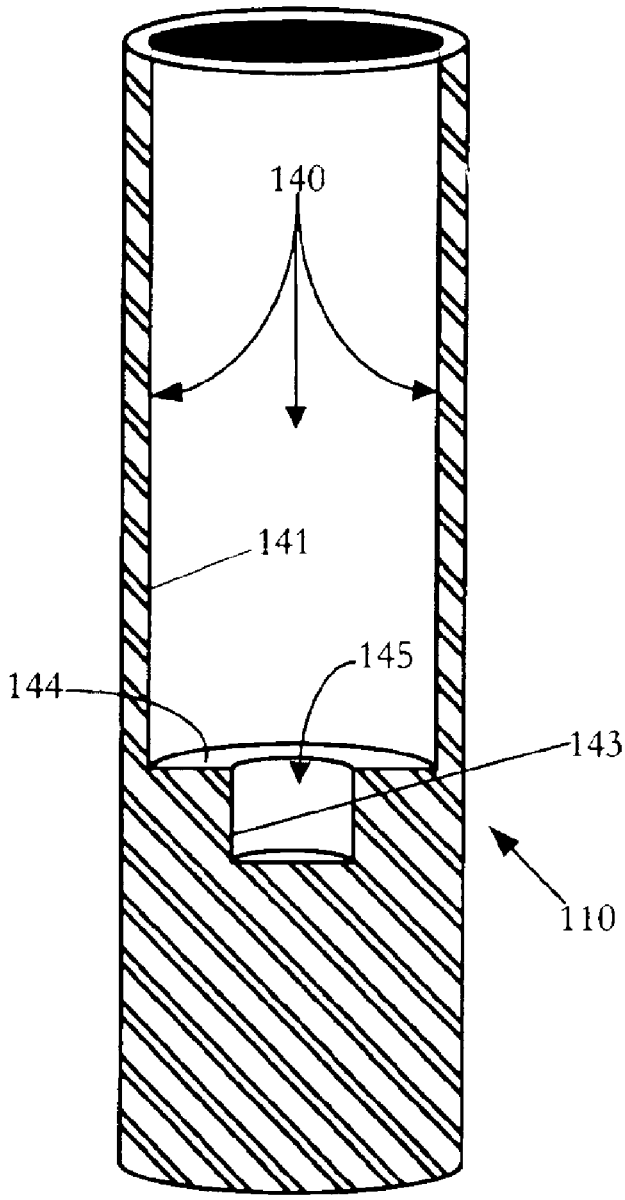
FIG. 17 depicts another embodiment of a lash adjuster body.

FIGS. 15, 16, and 17 show a preferred embodiment of the lash adjuster body 110. The lash adjuster body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the lash adjuster body 110 is composed of pearlitic material. According to still another aspect of the present invention, the lash adjuster body 110 is composed of austenitic material. According to another aspect of the present invention, the metal is a ferritic material.

The lash adjuster body 110 is composed of a plurality of lash adjuster elements. According to one aspect of the present invention, the lash adjuster element is cylindrical in shape. According to another aspect of the present invention, the lash adjuster element is conical in shape. According to yet another aspect of the present invention, the lash adjuster element is solid. According to still another aspect of the present invention, the lash adjuster element is hollow.

FIG. 15 depicts a cross-sectional view of the lash adjuster 110 composed of a plurality of lash adjuster elements. FIG. 15 shows the lash adjuster body, generally designated 110. The lash adjuster body 110 of the preferred embodiment is fabricated from a single piece of metal wire or rod and is described herein as a plurality of lash adjuster elements. The lash adjuster body 110 includes a hollow lash adjuster element 121 and a solid lash adjuster element 122. In the preferred embodiment, the solid lash adjuster element 122 is located adjacent to the hollow lash adjuster element 121.

The lash adjuster body 110 functions to accommodate a plurality of inserts. According to one aspect of the present invention, the lash adjuster body 110 accommodates a leakdown plunger, such as the leakdown plunger 210. According to another aspect of the present invention, the lash adjuster body 110 accommodates a push rod seat (not shown). According to yet another aspect of the present invention, the lash adjuster body 110 accommodates a socket, such as the metering socket 10.

The lash adjuster body 110 is provided with a plurality of outer surfaces and inner surfaces. FIG. 16 depicts a cross-sectional view of the preferred embodiment of the present invention. As shown in FIG. 16, the lash adjuster body 110 is provided with an outer lash adjuster surface 180 which is configured to be inserted into another body. According to one aspect of the present invention, the outer lash adjuster surface 180 is configured to be inserted into a valve lifter body, such as the valve lifter body 310. According to another aspect of the present invention, the outer lash adjuster surface 180 is configured to be inserted into a roller follower, such as the roller follower body 410.

The outer lash adjuster surface 180 encloses at least one cavity. As depicted in FIG. 16, the outer lash adjuster surface 180 encloses a lash adjuster cavity 130. The lash adjuster cavity 130 is configured to cooperate with a plurality of inserts. According to one aspect of the present invention, the lash adjuster cavity 130 is configured to cooperate with a leakdown plunger. In the preferred embodiment, the lash adjuster cavity 130 is configured to cooperate with the leakdown plunger 210. According to another aspect of the present invention, the lash adjuster cavity 130 is configured to cooperate with a socket. In the preferred embodiment, the lash adjuster cavity 130 is configured to cooperate with the metering socket 10. According to yet another aspect of the present invention, the lash adjuster cavity 130 is configured to cooperate with a push rod. According to still yet another aspect of the present invention, the lash adjuster cavity is configured to cooperate with a push rod seat.

Referring to FIG. 16, the lash adjuster body 110 of the present invention is provided with a lash adjuster cavity 130 that includes a lash adjuster opening 131. The lash adjuster opening 131 is in a circular shape. The lash adjuster cavity 130 is provided with the inner lash adjuster surface 140.

The inner lash adjuster surface 140 includes a plurality of surfaces. According to one aspect of the present invention, the inner lash adjuster surface 140 includes a cylindrical lash adjuster surface. According to another aspect of the present invention, the inner lash adjuster surface 140 includes a conical or frustoconical surface.

As depicted in FIG. 16, the inner lash adjuster surface 140 is provided with a first cylindrical lash adjuster surface 141, preferably concentric relative to the outer lash adjuster surface 180. Adjacent to the first cylindrical lash adjuster surface 141 is a conical lash adjuster surface 142. Adjacent to the conical lash adjuster surface 142 is a second cylindrical lash adjuster surface 143. However, those skilled in the art will appreciate that the inner lash adjuster surface 140 can be fabricated without the conical lash adjuster surface 142.

FIG. 17 depicts a cut-away view of the lash adjuster body 110 of the preferred embodiment. The inner lash adjuster surface 140 is provided with a first cylindrical lash adjuster surface 141. The first cylindrical lash adjuster surface 141 abuts an annular lash adjuster surface 144 with an annulus 145. The annulus 145 defines a second cylindrical lash adjuster surface 143.

The lash adjuster body 110 of the present invention is fabricated through a plurality of processes. According to one aspect of the present invention, the lash adjuster body 110 is machined. According to another aspect of the present invention, the lash adjuster body 110 is forged. According to yet another aspect of the present invention, the lash adjuster body 110 is fabricated through casting. The preferred embodiment of the present invention is forged. As used herein, the term "forge," "forging," or "forged" is intended to encompass what is known in the art as "cold forming," "cold heading," "deep drawing," and "hot forging."

In the preferred embodiment, the lash adjuster body 110 is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The lash adjuster cavity 130 is extruded through use of a punch and an extruding pin. After the lash adjuster cavity 130 has been extruded, the lash adjuster cavity 130 is forged. The lash adjuster cavity 130 is extruded through use of an extruding punch and a forming pin.

Alternatively, the lash adjuster body 110 is fabricated through machining. As used herein, machining means the use of a chucking machine, a drilling machine, a grinding machine, or a broaching machine. Machining is accomplished by first feeding the lash adjuster body 110 into a chucking machine, such as an ACME-Gridley automatic chucking machine. Those skilled in the art will appreciate that other machines and other manufacturers of automatic chucking machines can be used.

To machine the lash adjuster cavity 130, the end containing the lash adjuster opening 131 is faced so that it is substantially flat. The lash adjuster cavity 130 is bored. Alternatively, the lash adjuster cavity 130 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the lash adjuster cavity 130 is ground using an internal diameter grinding machine, such as a Heald grinding machine. Those skilled in the art will appreciate that the lash adjuster cavity 130 can be ground using other grinding machines.

Figure 18:
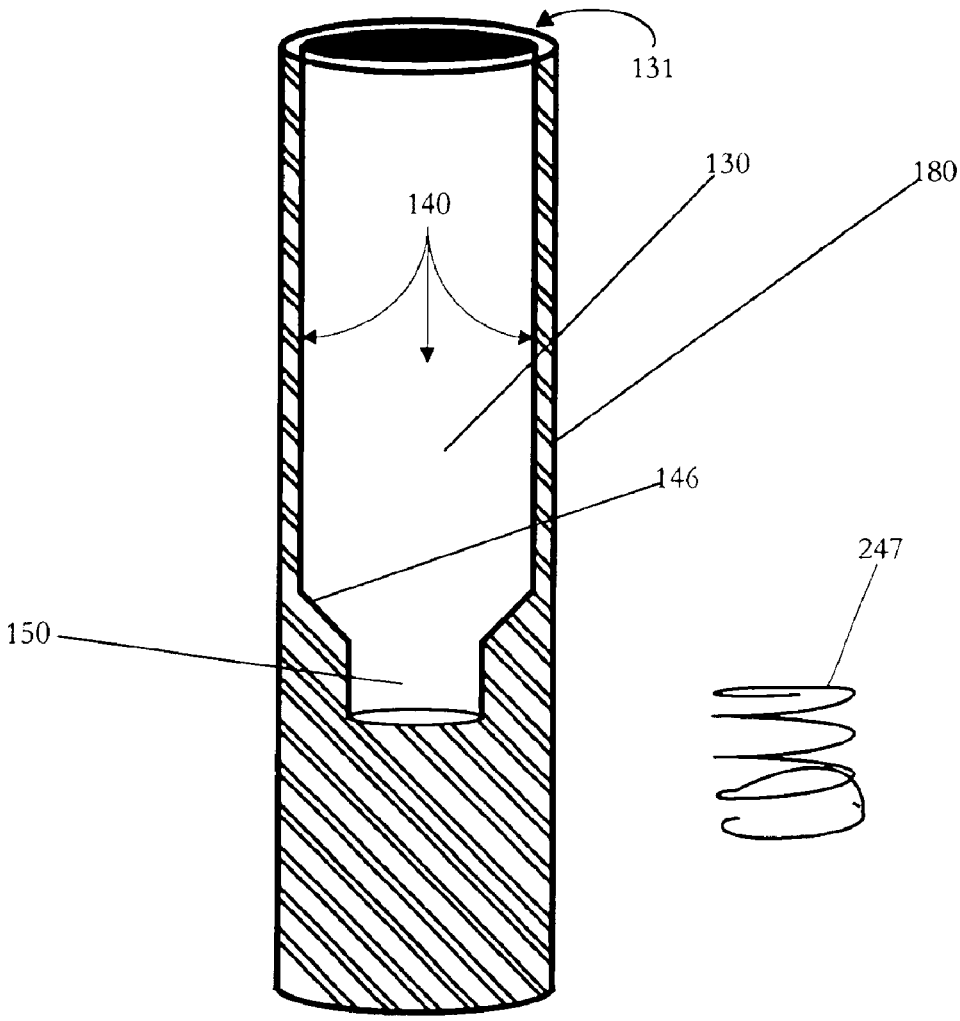
FIG. 18 depicts another embodiment of a lash adjuster body.

FIG. 18 depicts the inner lash adjuster surface 140 provided with a lash adjuster well 150. The lash adjuster well 150 is shaped to accommodate a cap spring 247. In the embodiment depicted in FIG. 18, the lash adjuster well 150 is cylindrically shaped at a diameter that is smaller than the diameter of the inner lash adjuster surface 140. The cylindrical shape of the lash adjuster well 150 is preferably concentric relative to the outer lash adjuster surface 180. The lash adjuster well 150 is preferably forged through use of an extruding die pin.

Alternatively, the lash adjuster well 150 is machined by boring the lash adjuster well 150 in a chucking machine. Alternatively, the lash adjuster well 150 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lash adjuster well 150 is ground using an internal diameter grinding machine, such as a Heald grinding machine. Those skilled in the art will appreciate that the lash adjuster well 150 can be ground using other grinding machines.

Adjacent to the lash adjuster well 150, in the embodiment depicted in FIG. 18, is a lash adjuster lead surface 146 which is conically shaped and can be fabricated through forging or machining. However, those skilled in the art will appreciate that the present invention can be fabricated without the lash adjuster lead surface 146.

Figure 19:
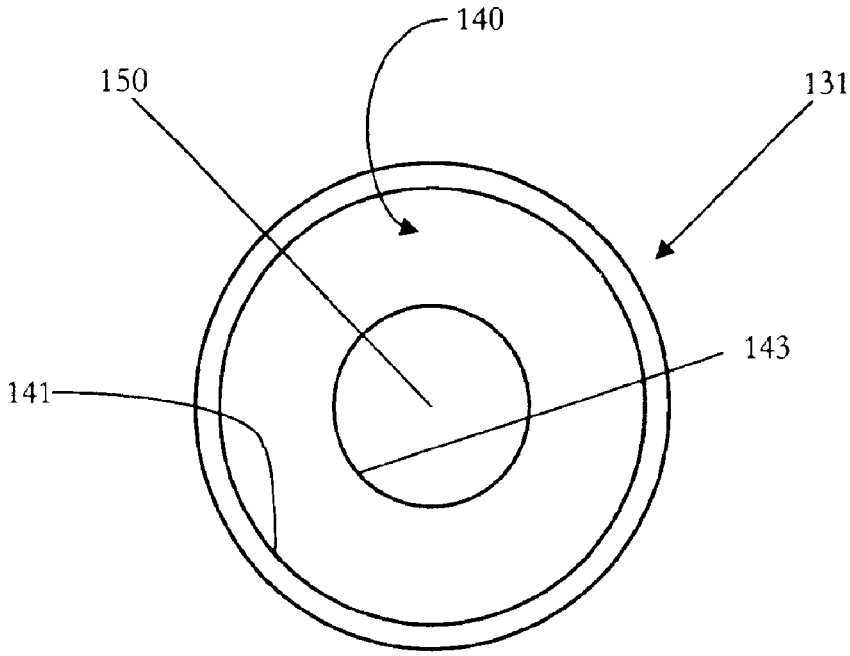
FIG. 19 depicts a top view of an embodiment of a lash adjuster body.

FIG. 19 depicts a view of the lash adjuster opening 131 that reveals the inner lash adjuster surface 140 of the preferred embodiment of the present invention. The inner lash adjuster surface 140 is provided with a first cylindrical lash adjuster surface 141. A lash adjuster well 150 is defined by a second cylindrical lash adjuster surface 143. As shown in FIG. 19, the second cylindrical lash adjuster surface 143 is concentric relative to the first cylindrical lash adjuster surface 141.

Figure 20:
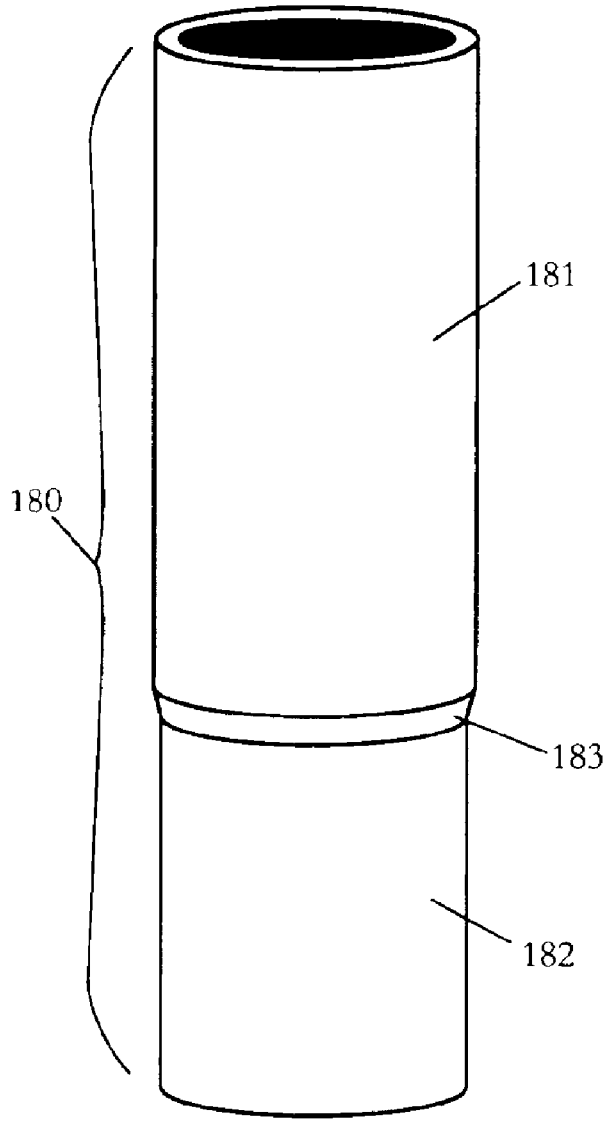
FIG. 20 depicts the top view of another preferred embodiment of a lash adjuster body.

Depicted in FIG. 20 is a lash adjuster body 110 of an alternative embodiment. As shown in FIG. 20, the lash adjuster body 110 is provided with an outer lash adjuster surface 180. The outer lash adjuster surface 180 includes a plurality of surfaces. In the embodiment depicted in FIG. 20, the outer lash adjuster surface 180 includes an outer cylindrical lash adjuster surface 181, an undercut lash adjuster surface 182, and a conical lash adjuster surface 183. As depicted in FIG. 20, the undercut lash adjuster surface 182 extends from one end of the lash adjuster body 110 and is cylindrically shaped. The diameter of the undercut lash adjuster surface 182 is smaller than the diameter of the outer cylindrical lash adjuster surface 181.

The undercut lash adjuster surface 182 is forged through use of an extruding die. Alternatively, the undercut lash adjuster surface 182 is fabricated through machining. Machining the undercut lash adjuster surface 182 is accomplished through use of an infeed centerless grinding machine, such as a Cincinnati grinder. The surface is first heat-treated and then the undercut lash adjuster surface 182 is ground via a grinding wheel. Those skilled in the art will appreciate that additional surfaces can be ground into the outer lash adjuster surface 180 with minor alterations to the grinding wheel.

As depicted in FIG. 20, the conical lash adjuster surface 183 is located between the outer cylindrical lash adjuster surface 181 and the undercut lash adjuster surface 182. The conical lash adjuster surface 183 is forged through use of an extruding die. Alternatively, the conical lash adjuster surface 183 is fabricated through machining. Those with skill in the art will appreciate that the outer lash adjuster surface 180 can be fabricated without the conical lash adjuster surface 183 so that the outer cylindrical lash adjuster surface 181 and the undercut lash adjuster surface 182 abut one another.

Those skilled in the art will appreciate that the features of the lash adjuster body 110 may be fabricated through a combination of machining, forging, and other methods of fabrication. By way of example and not limitation, aspects of the lash adjuster cavity 130 can be machined; other aspects of the lash adjuster cavity can be forged.

Figure 21:
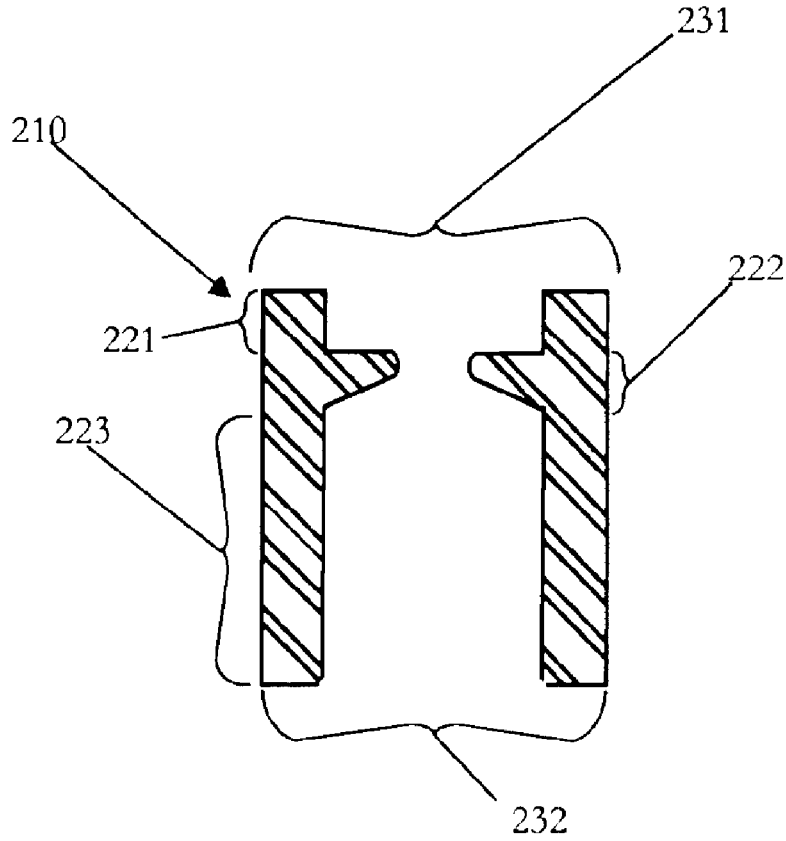
FIG. 21 depicts a preferred embodiment of a leakdown plunger.
Figure 22:
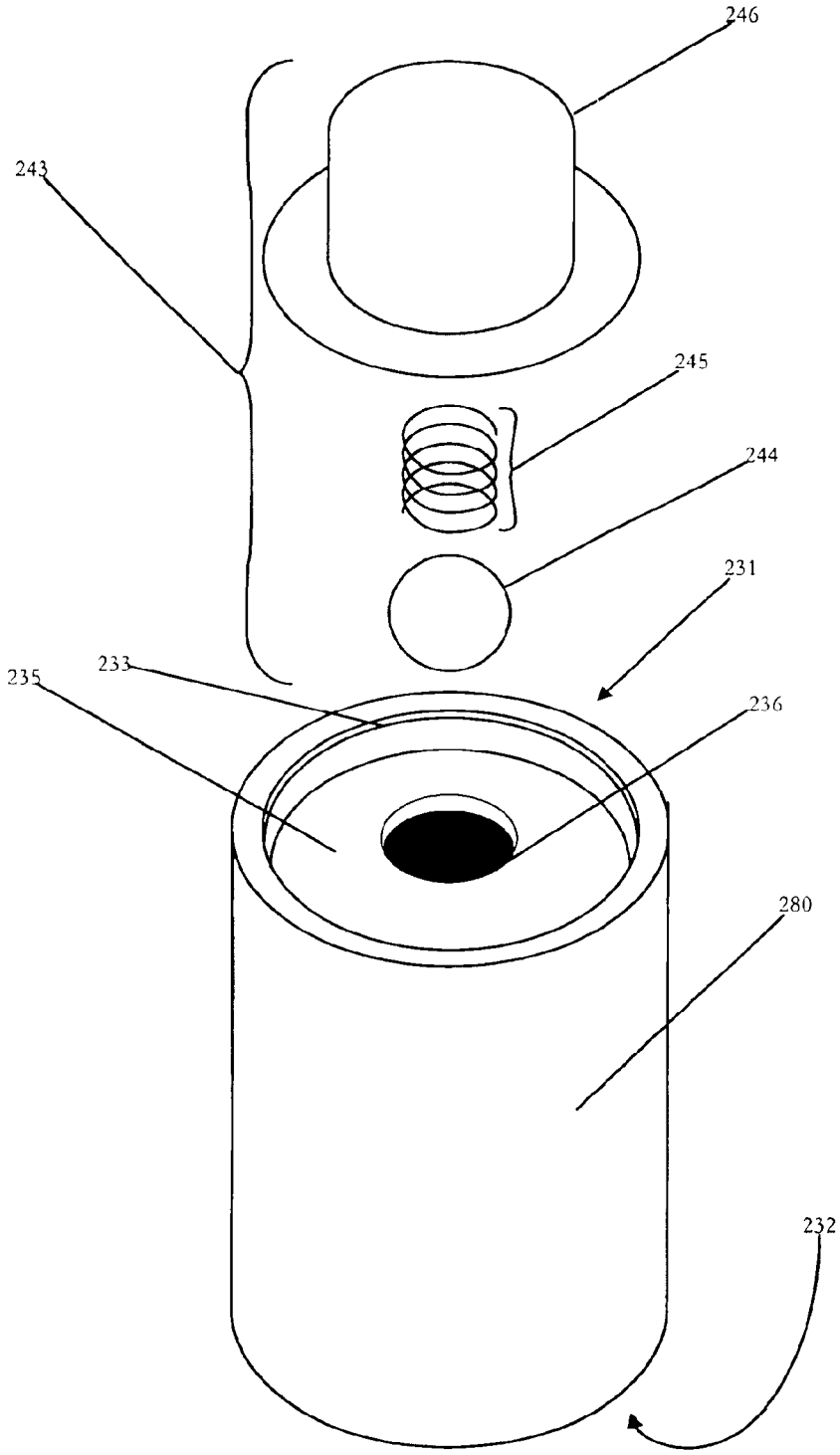
FIG. 22 depicts a preferred embodiment of a leakdown plunger.
Figure 23:
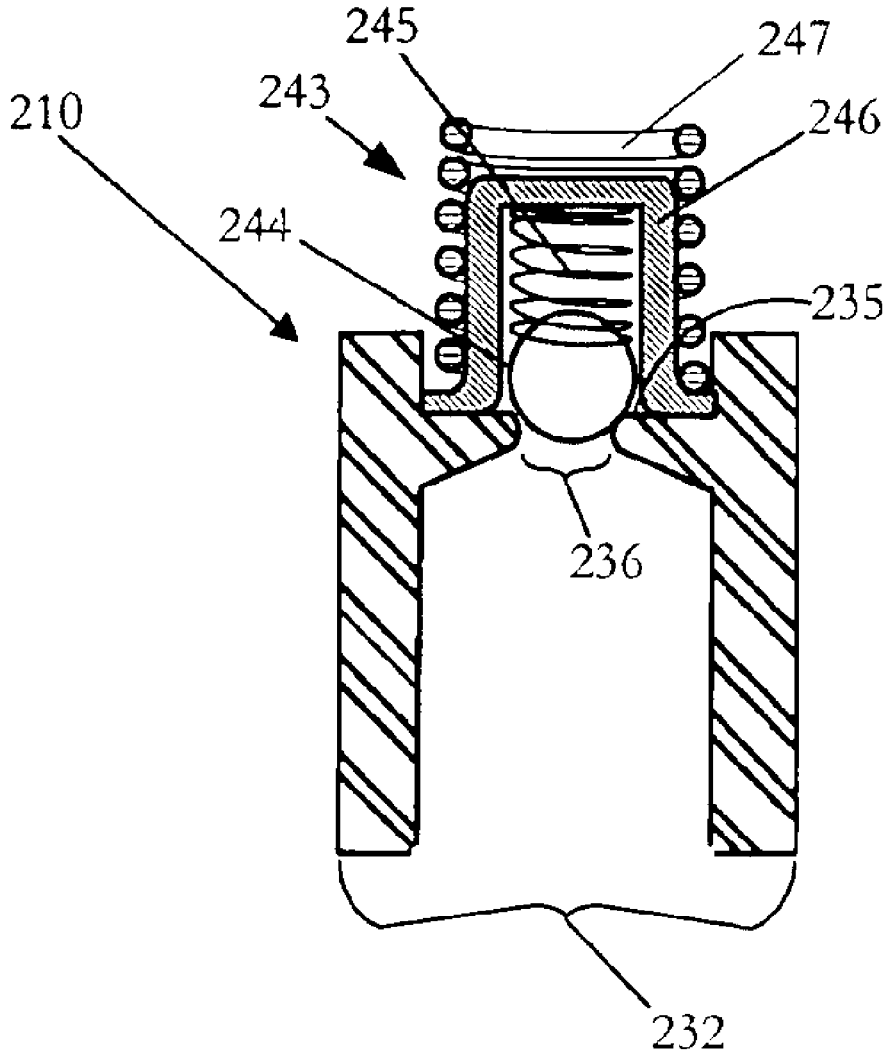
FIG. 23 depicts a cross-sectional view of a preferred embodiment of a leakdown plunger.

FIGS. 21, 22, and 23 show a preferred embodiment of the leakdown plunger 210. The leakdown plunger 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 210 is composed of pearlitic material. According to still another aspect of the present invention, the leakdown plunger 210 is composed of austenitic material. According to another aspect of the present invention, the metal is a ferritic material.

The leakdown plunger 210 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 21 depicts a cross-sectional view of the leakdown plunger 210 composed of a plurality of plunger elements. FIG. 21 shows the leakdown plunger, generally designated 210. The leakdown plunger 210 functions to accept a liquid, such as a lubricant and is provided with a first plunger opening 231 and a second plunger opening 232. The first plunger opening 231 functions to accommodate an insert.

The leakdown plunger 210 of the preferred embodiment is fabricated from a single piece of metal wire or rod and is described herein as a plurality of plunger elements. The leakdown plunger 210 includes a first hollow plunger element 221, a second hollow plunger element 223, and an insert-accommodating plunger element 222. As depicted in FIG. 21, the first hollow plunger element 221 is located adjacent to the insert-accommodating plunger element 222. The insert-accommodating plunger element 222 is located adjacent to the second hollow plunger element 223.

The leakdown plunger 210 is provided with a plurality of outer surfaces and inner surfaces. FIG. 22 depicts the first plunger opening 231 of an alternative embodiment. The first plunger opening 231 of the embodiment depicted in FIG. 22 is advantageously provided with a chamfered plunger surface 233, however a chamfered plunger surface 233 is not necessary. When used herein in relation to a surface, the term "chamfered" shall mean a surface that is rounded or angled.

The first plunger opening 231 depicted in FIG. 22 is configured to accommodate an insert. The first plunger opening 231 is shown in FIG. 22 accommodating a valve insert 243. In the embodiment depicted in FIG. 22, the valve insert 243 is shown in an exploded view and includes a generally spherically shaped valve insert member 244, an insert spring 245, and a cap 246. Those skilled in the art will appreciate that valves other than the valve insert 243 shown herein can be used without departing from the scope and spirit of the present invention.

As shown in FIG. 22, the first plunger opening 231 is provided with an annular plunger surface 235 defining a plunger hole 236. The plunger hole 236 is shaped to accommodate an insert. In the embodiment depicted in FIG. 22, the plunger hole 236 is shaped to accommodate the spherical valve insert member 244. The spherical valve insert member 244 is configured to operate with the insert spring 245 and the cap 246. The cap 246 is shaped to at least partially cover the spherical valve insert member 244 and the insert spring 245. The cap 246 is preferably fabricated through stamping. However, the cap 246 may be forged or machined without departing from the scope or spirit of the present invention.

FIG. 23 shows a cross-sectional view of the leakdown plunger 210 depicted in FIG. 16 in a semi-assembled state. In FIG. 23 the valve insert 243 is shown in a semi-assembled state. As depicted in FIG. 23, a cross-sectional view of a cap spring 247 is shown around the cap 246. Those skilled in the art will appreciate that the cap spring 247 and the cap 246 are configured to be inserted into the well of another body. According to one aspect of the present invention, the cap spring 247 and the cap 246 are configured to be inserted into the well of a lash adjuster, such as the lash adjuster well 150 of the lash adjuster 110. According to another aspect of the present invention, the cap spring 247 and the cap 246 are configured to be inserted into the well of a valve lifter, such as the lifter well 362 of the valve lifter body 310.

The cap 246 is configured to at least partially depress the insert spring 245. The insert spring 245 exerts a force on the spherical valve insert member 244. In FIG. 23, the annular plunger surface 235 is shown with the spherical valve insert member 244 partially located within the plunger hole 236.

Figure 31:
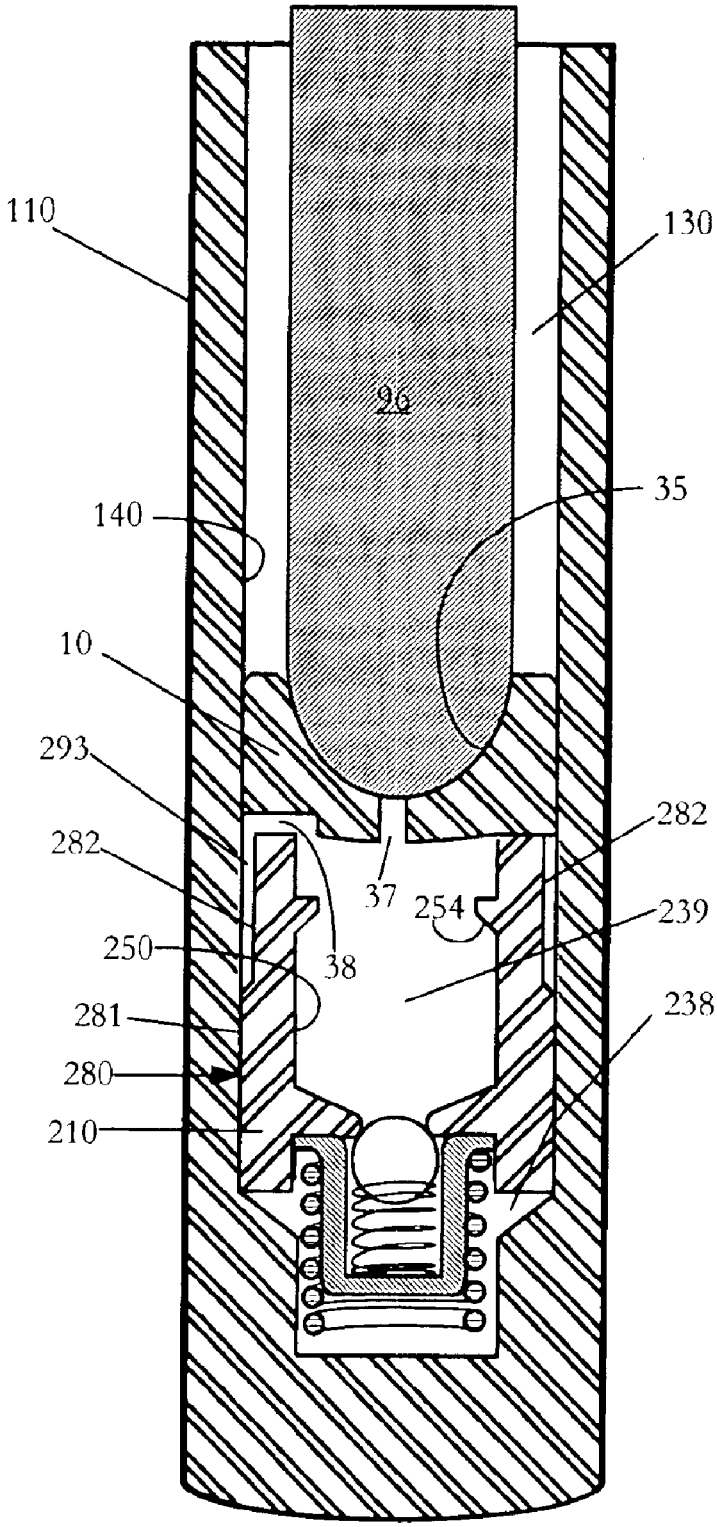
FIG. 31 depicts a sixth embodiment of a leakdown plunger.

Referring now to FIG. 22, leakdown plunger 210 is provided with an outer plunger surface 280. The outer plunger surface 280 is preferably shaped so that the leakdown plunger 210 can be inserted into a lash adjuster body, such as the lash adjuster body 110. Depicted in FIG. 31 is a lash adjuster body 110 having an inner lash adjuster surface 140 defining a lash adjuster cavity 130. An embodiment of the leakdown plunger 210 is depicted in FIG. 31 within the lash adjuster cavity 130 of the lash adjuster body 110. As shown in FIG. 31, the leakdown plunger 210 is preferably provided with an outer plunger surface 280 that is cylindrically shaped.

Figure 24:
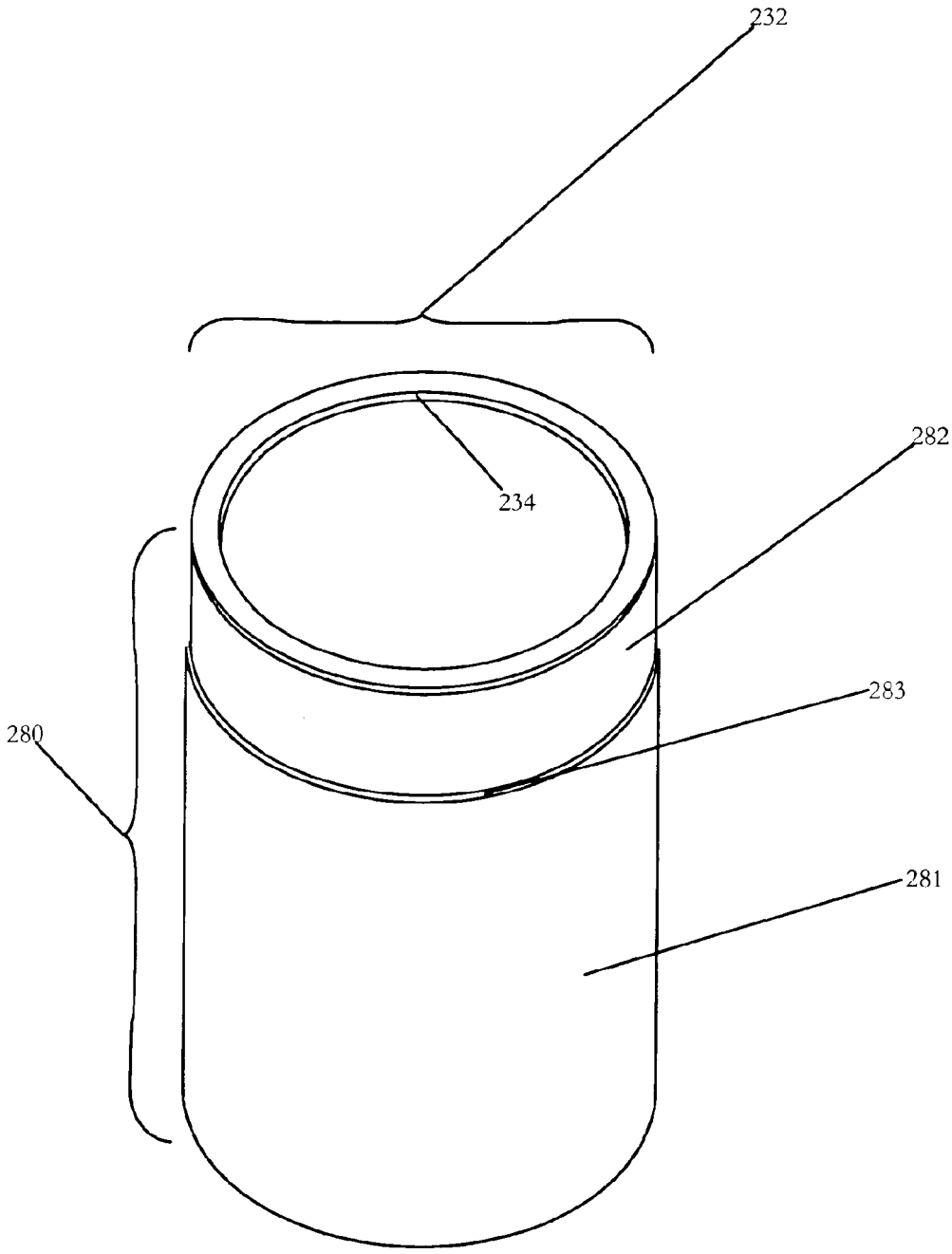
FIG. 24 depicts a perspective view of another preferred embodiment of a leakdown plunger.

FIG. 24 depicts a leakdown plunger 210 of an alternative embodiment. FIG. 24 depicts the second plunger opening 232 in greater detail. The second plunger opening 232 is shown with a chamfered plunger surface 234. However, those with skill in the art will appreciate that the second plunger opening 232 may be fabricated without the chamfered plunger surface 234.

In FIG. 24, the leakdown plunger 210 is provided with a plurality of outer surfaces. As shown therein, the embodiment is provided with an outer plunger surface 280. The outer plunger surface 280 includes a plurality of surfaces. FIG. 24 depicts a cylindrical plunger surface 281, an undercut plunger surface 282, and a conical plunger surface 283. As depicted in FIG. 24, the undercut plunger surface 282 extends from one end of the leakdown plunger 210 and is cylindrically shaped. The diameter of the undercut plunger surface 282 is smaller than the diameter of the cylindrical plunger surface 281.

The undercut plunger surface 282 is preferably forged through use of an extruding die. Alternatively, the undercut plunger surface 282 is fabricated through machining. Machining the undercut plunger surface 282 is accomplished through use of an infeed centerless grinding machine, such as a Cincinnati grinder. The surface is first heat-treated and then the undercut plunger surface 282 is ground via a grinding wheel. Those skilled in the art will appreciate that additional surfaces can be ground into the outer plunger surface 280 with minor alterations to the grinding wheel.

Referring again to FIG. 24, the conical plunger surface 283 is located between the cylindrical plunger surface 281 and the undercut plunger surface 282. Those with skill in the art will appreciate that the outer plunger surface 280 can be fabricated without the conical plunger surface 283 so that the cylindrical plunger surface 281 and the undercut plunger surface 282 abut one another.

Figure 26:
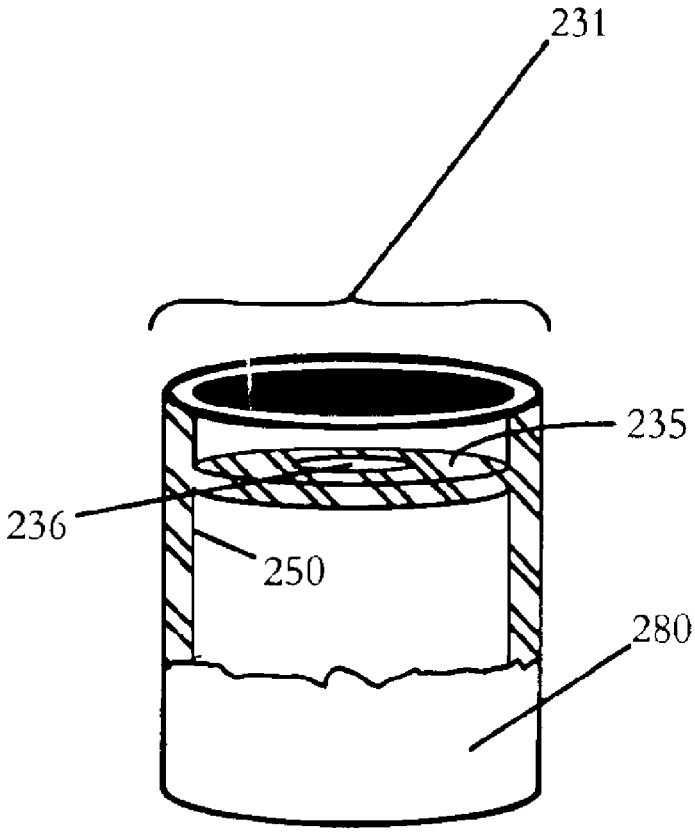
FIG. 26 depicts a third embodiment of a leakdown plunger.

FIG. 26 depicts an embodiment of the leakdown plunger 210 with a section of the outer plunger surface 280 broken away. The embodiment depicted in FIG. 26 is provided with a first plunger opening 231. As shown in FIG. 26, the outer plunger surface 280 encloses an inner plunger surface 250. The inner plunger surface 250 includes an annular plunger surface 235 that defines a plunger hole 236.

Figure 27:
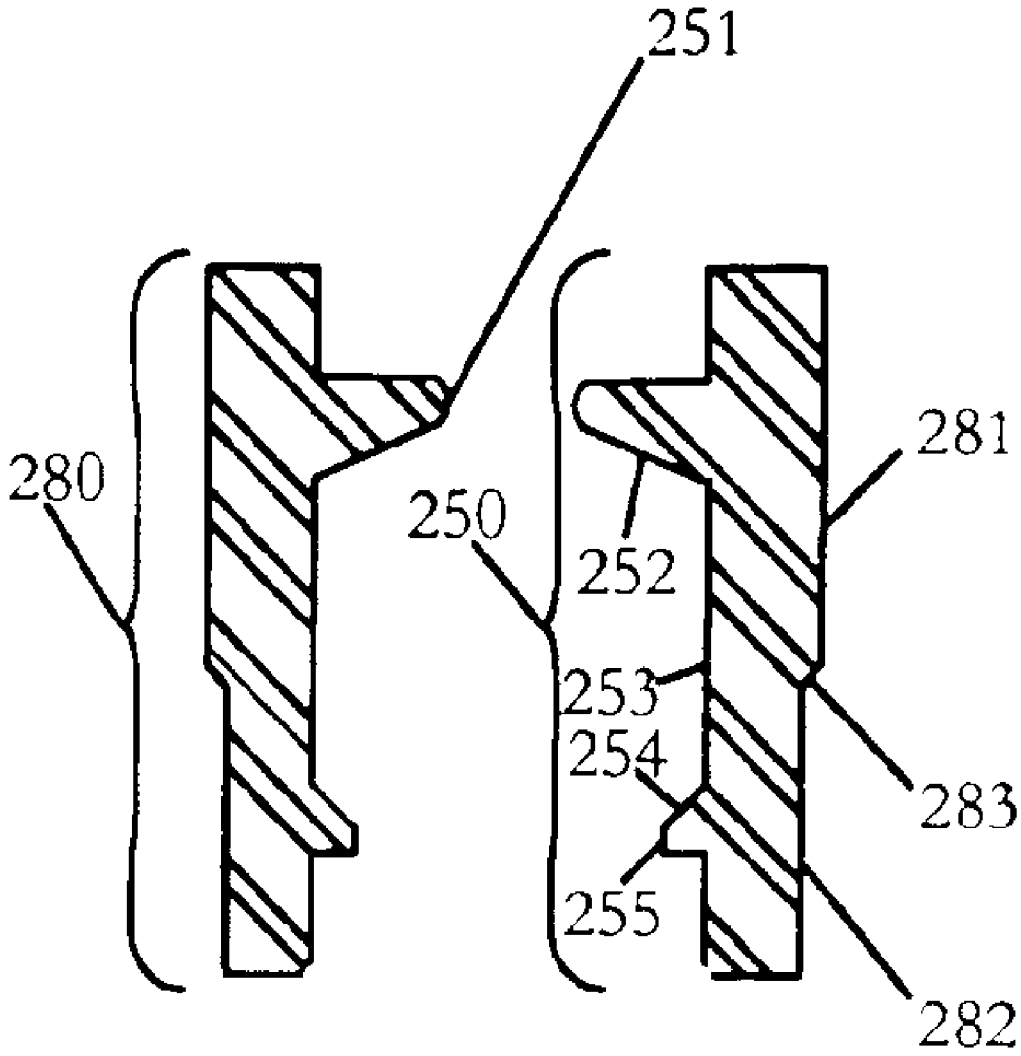
FIG. 27 depicts a fourth embodiment of a leakdown plunger.

FIG. 27 depicts a cross-sectional view of a leakdown plunger of an alternative embodiment. The leakdown plunger 210 shown in FIG. 27 is provided with an outer plunger surface 280 that includes a plurality of cylindrical and conical surfaces. In the embodiment depicted in FIG. 27, the outer plunger surface 280 includes an outer cylindrical plunger surface 281, an undercut plunger surface 282, and an outer conical plunger surface 283. As depicted in FIG. 27, the undercut plunger surface 282 extends from one end of the leakdown plunger 210 and is cylindrically shaped. The diameter of the undercut plunger surface 282 is smaller than, and preferably concentric relative to, the diameter of the outer cylindrical plunger surface 281. The outer conical plunger surface 283 is located between the outer cylindrical plunger surface 281 and the undercut plunger surface 282. Those with skill in the art will appreciate that the outer plunger surface 280 can be fabricated without the conical plunger surface 283 so that the outer cylindrical plunger surface 281 and the undercut plunger surface 282 abut one another.

Figure 28:
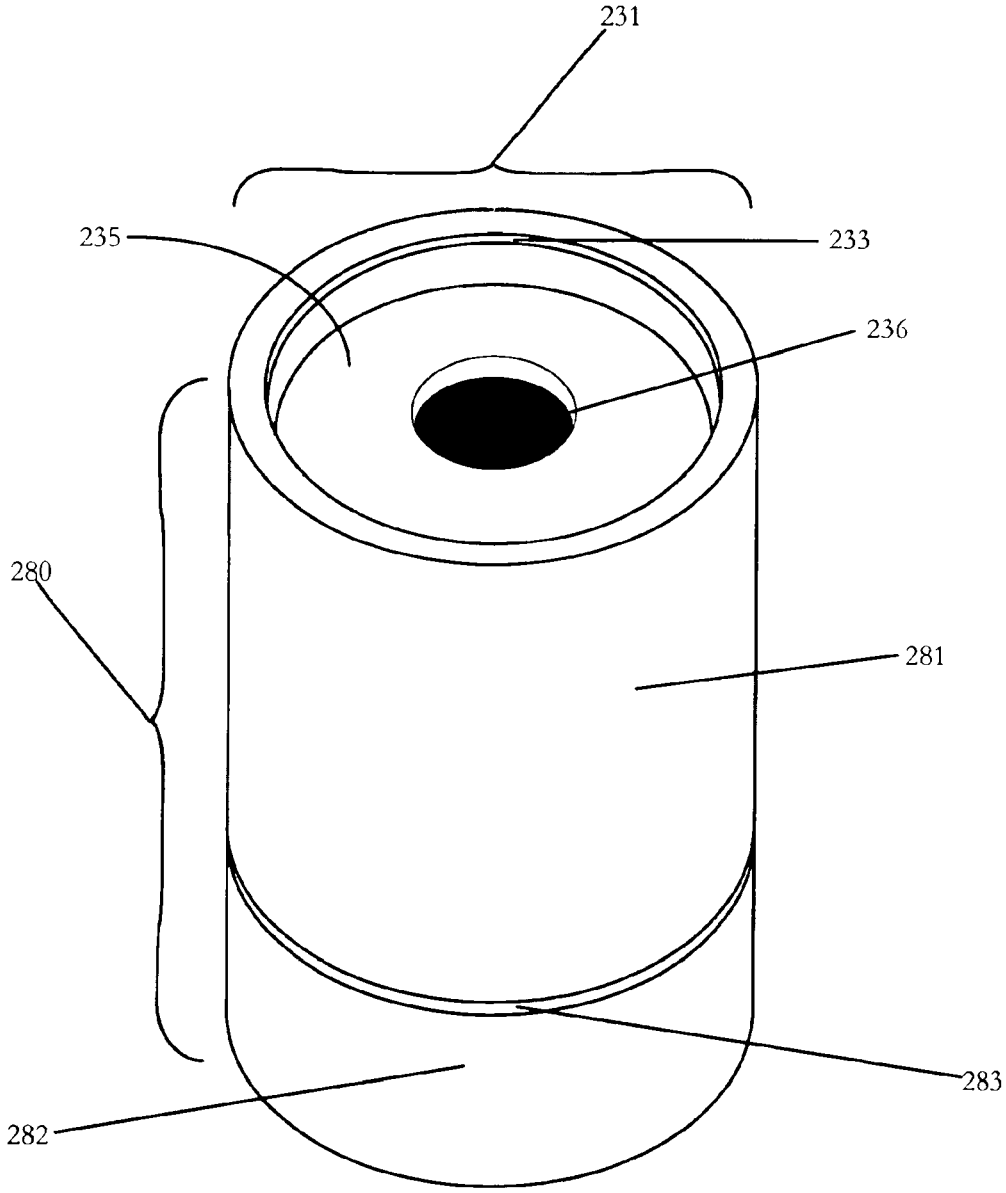
FIG. 28 depicts a fifth embodiment of a leakdown plunger.

FIG. 28 depicts in greater detail the first plunger opening 231 of the embodiment depicted in FIG. 27. The first plunger opening 231 is configured to accommodate an insert and is preferably provided with a first chamfered plunger surface 233. Those skilled in the art, however, will appreciate that the first chamfered plunger surface 233 is not necessary. As further shown in FIG. 28, the first plunger opening 231 is provided with a first annular plunger surface 235 defining a plunger hole 236.

The embodiment depicted in FIG. 28 is provided with an outer plunger surface 280 that includes a plurality of surfaces. The outer plunger surface 280 includes a cylindrical plunger surface 281, an undercut plunger surface 282, and a conical plunger surface 283. As depicted in FIG. 28, the undercut plunger surface 282 extends from one end of the leakdown plunger 210 and is cylindrically shaped. The diameter of the undercut plunger surface 282 is smaller than the diameter of the cylindrical plunger surface 281. The conical plunger surface 283 is located between the cylindrical plunger surface 281 and the undercut plunger surface 282. However, those with skill in the art will appreciate that the outer plunger surface 280 can be fabricated without the conical plunger surface 283 so that the cylindrical plunger surface 281 and the undercut plunger surface 282 abut one another. Alternatively, the cylindrical plunger surface 281 may abut the undercut plunger surface 282 so that the conical plunger surface 283 is an annular surface.

Figure 29:
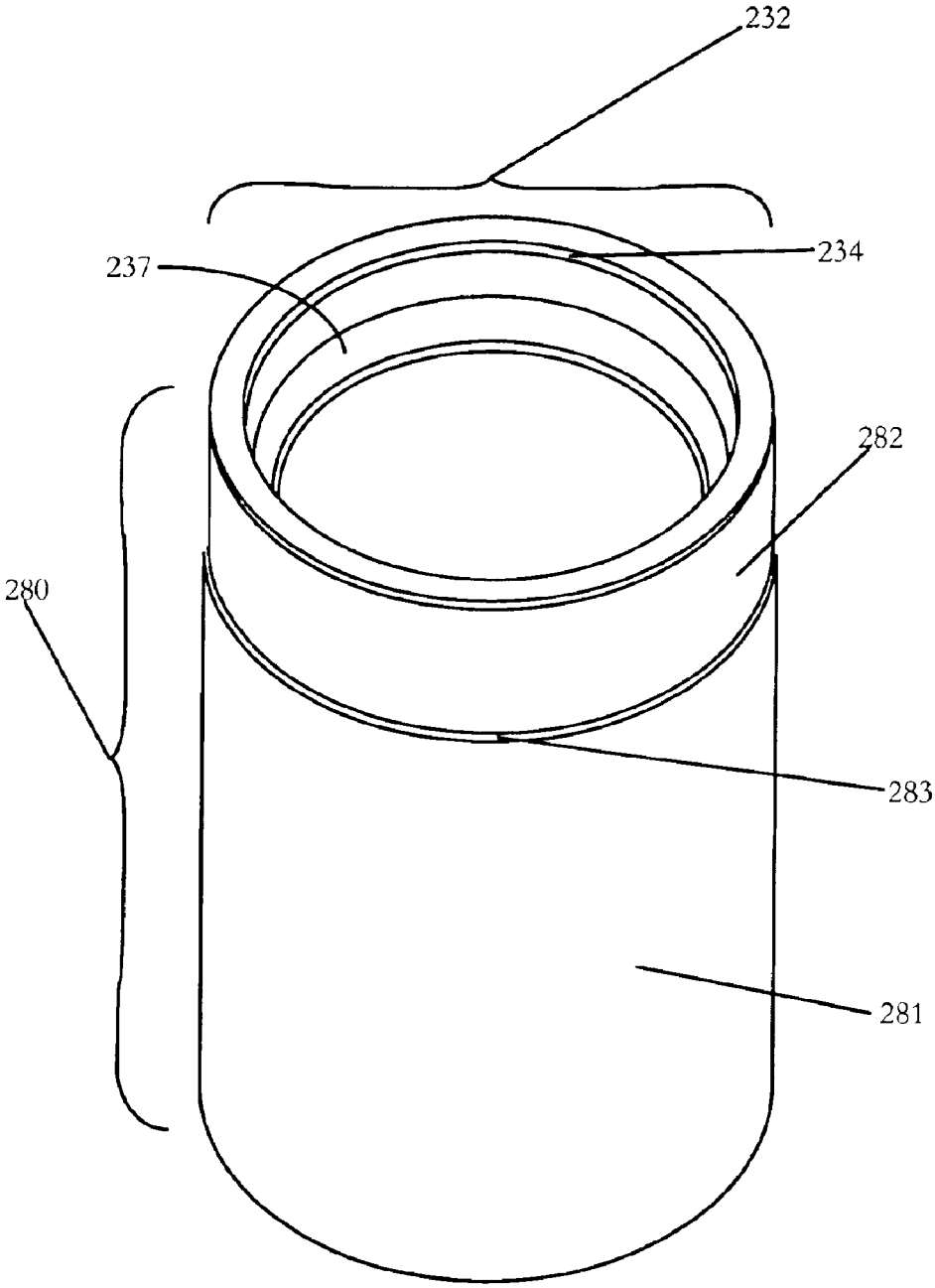
FIG. 29 depicts a perspective view of another preferred embodiment of a leakdown plunger.

FIG. 29 depicts the second plunger opening 232 of the embodiment depicted in FIG. 27. The second plunger opening 232 is shown with a second chamfered plunger surface 234. However, those with skill in the art will appreciate that the second plunger opening 232 may be fabricated without the second chamfered plunger surface 234. The second plunger opening 232 is provided with a second annular plunger surface 237.

Figure 30:
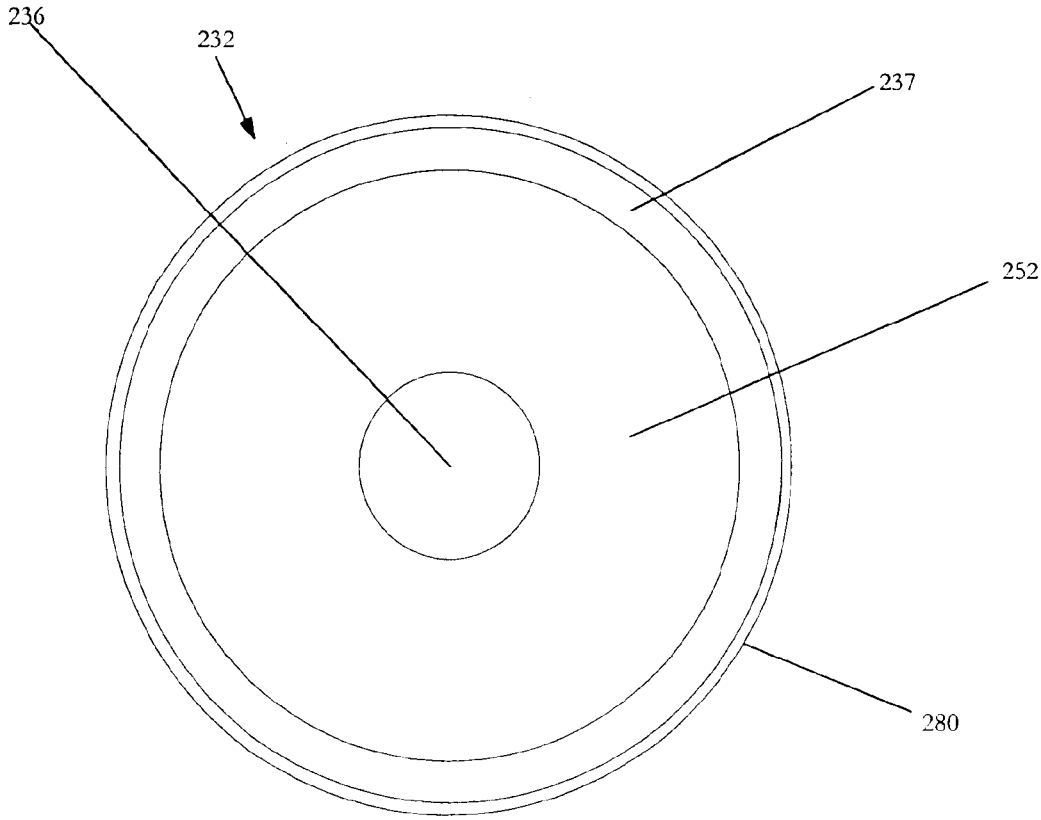
FIG. 30 depicts the top view of another preferred embodiment of a leakdown plunger.

FIG. 30 depicts a top view of the second plunger opening 232 of the embodiment depicted in FIG. 27. In FIG. 30, the second annular plunger surface 237 is shown in relation to the first inner conical plunger surface 252 and the plunger hole 236. As shown in FIG. 30, the plunger hole 236 is concentric relative to the outer plunger surface 280 and the annulus formed by the second annular plunger surface 237.

Figure 25:
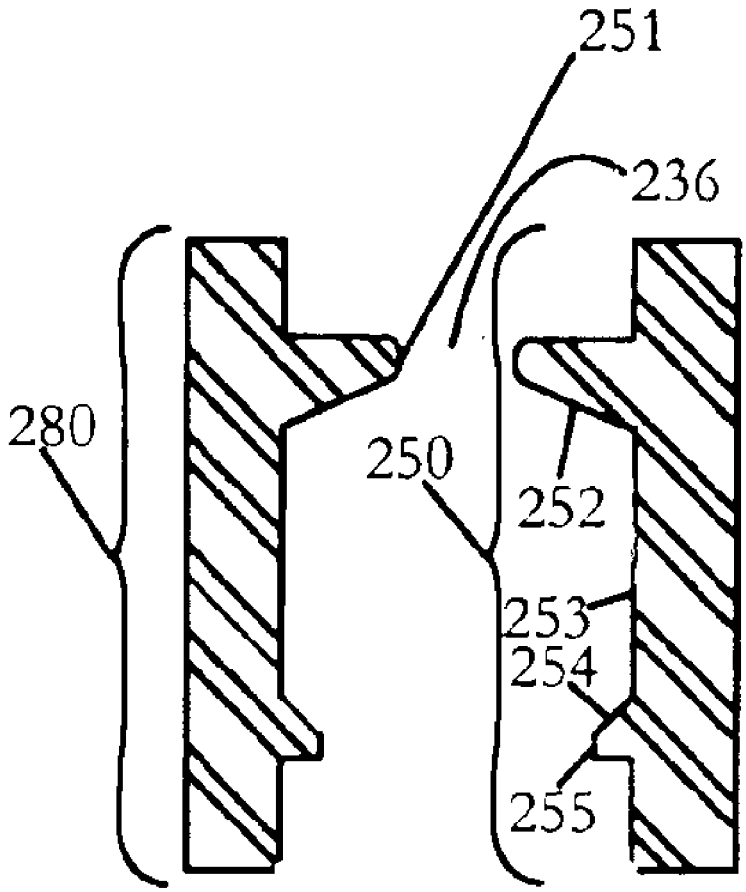
FIG. 25 depicts a second embodiment of a leakdown plunger.

Referring now to FIG. 25, the outer plunger surface 280 encloses an inner plunger surface 250. The inner plunger surface 250 includes a plurality of surfaces. In the alternative embodiment depicted in FIG. 25, the inner plunger surface 250 includes a rounded plunger surface 251 that defines a plunger hole 236. Those skilled in the art will appreciate that the rounded plunger surface 251 need not be rounded, but may be flat. The inner plunger surface 250 includes a first inner conical plunger surface 252 and a second inner conical plunger surface 254, a first inner cylindrical plunger surface 253, and a second inner cylindrical plunger surface 255. The first inner conical plunger surface 252 is located adjacent to the rounded plunger surface 251. Adjacent to the first inner conical plunger surface 252 is the first inner cylindrical plunger surface 253. The first inner cylindrical plunger surface 253 is adjacent to the second inner conical plunger surface 254. The second inner conical plunger surface 254 is adjacent to the second inner cylindrical plunger surface 255.

FIG. 31 depicts an embodiment of the leakdown plunger 210 within another body cooperating with a plurality of inserts. The undercut plunger surface 282 preferably cooperates with another body, such as a lash adjuster body or a valve lifter, to form a leakdown path 293. FIG. 31 depicts an embodiment of the leakdown plunger 210 within a lash adjuster body 110; however, those skilled in the art will appreciate that the leakdown plunger 210 may be inserted within other bodies, such as roller followers and valve lifters.

As shown in FIG. 31, in the preferred embodiment, the undercut plunger surface 282 is configured to cooperate with the inner lash adjuster surface 140 of a lash adjuster body 110. The undercut plunger surface 282 and the inner lash adjuster surface 140 of the lash adjuster body 110 cooperate to define a leakdown path 293 for a liquid such as a lubricant.

The embodiment depicted in FIG. 31 is further provided with a cylindrical plunger surface 281. The cylindrical plunger surface 281 cooperates with the inner lash adjuster surface 140 of the lash adjuster body 110 to provide a first chamber 238. Those skilled in the art will appreciate that the first chamber 238 functions as a high pressure chamber for a liquid, such as a lubricant.

The second plunger opening 232 is configured to cooperate with a socket, such as the metering socket 10. The metering socket 10 is configured to cooperate with a push rod 96. As shown in FIG. 31, the metering socket 10 is provided with a push rod cooperating surface 35. The push rod cooperating surface 35 is configured to function with a push rod 96. Those skilled in the art will appreciate that the push rod 96 cooperates with the rocker arm (not shown) of an internal combustion engine (not shown).

The metering socket 10 cooperates with the leakdown plunger 210 to define at least in part a second chamber 239 within the inner plunger surface 250. Those skilled in the art will appreciate that the second chamber 239 may advantageously function as a reservoir for a lubricant. The inner plunger surface 250 of the leakdown plunger 210 functions to increase the quantity of retained fluid in the second chamber 239 through the damming action of the second inner conical plunger surface 254.

The metering socket 10 is provided with a plurality of passages that function to fluidly communicate with the lash adjuster cavity 130 of the lash adjuster body 110. In the embodiment depicted in FIG. 31, the metering socket 10 is provided with a socket passage 37 and a plunger reservoir passage 38. The plunger reservoir passage 38 functions to fluidly connect the second chamber 239 with the lash adjuster cavity 130 of the lash adjuster body 110. As shown in FIG. 31, the socket passage 37 functions to fluidly connect the metering socket 10 and the lash adjuster cavity 130 of the lash adjuster body 110.

FIGS. 32 to 36 illustrate the presently preferred method of fabricating a leakdown plunger. FIGS. 32 to 36 depict what is known in the art as "slug progressions" that show the fabrication of the leakdown plunger 210 of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 210 of the preferred embodiment is forged with use of a National®750 parts former machine. However, those skilled in the art will appreciate that other part formers, such as, for example, a Waterbury machine can be used those skilled in the art will further appreciate that other forging methods can be used as well.

Figure 32:
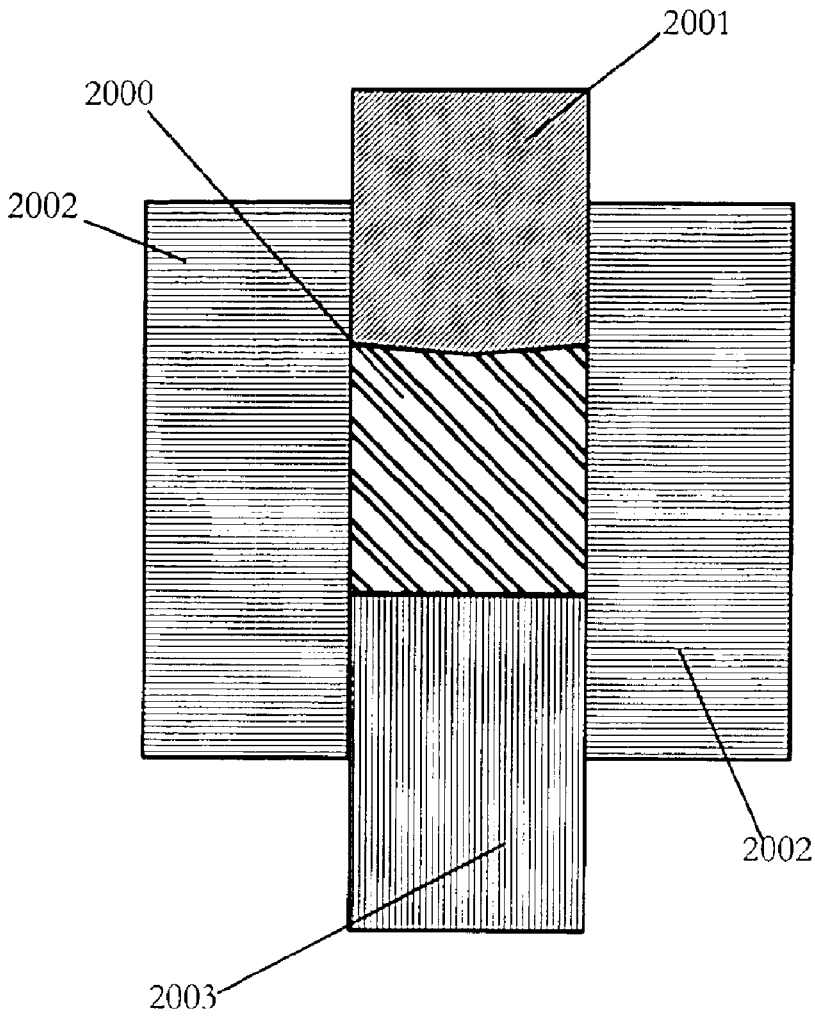
FIGS. 32–36 depict a preferred method of fabricating a leakdown plunger.

The process of forging the leakdown plunger 210 of an embodiment of the present invention begins with a metal wire or metal rod 2000 which is drawn to size. The ends of the wire or rod are squared off. As shown in FIG. 32, this is accomplished through the use of a first punch 2001, a first die 2002, and a first knock out pin 2003.

Figure 33:
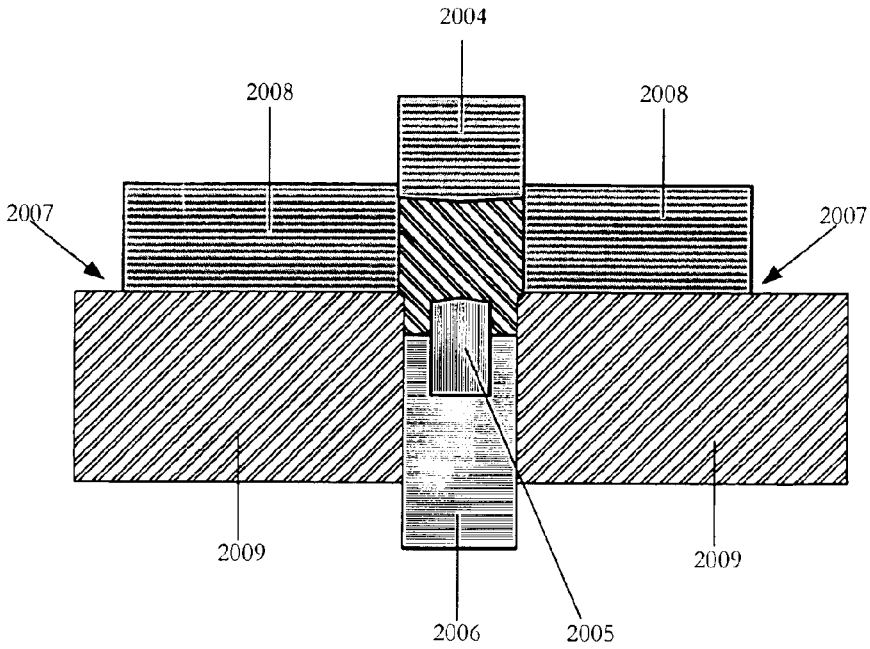

After being drawn to size, the wire or rod 2000 is run through a series of dies or extrusions. As depicted in FIG. 33, the fabrication of the second plunger opening 232 and the outer plunger surface 280 is preferably commenced through use of a second punch 2004, a second knock out pin 2005, a first sleeve 2006, and a second die 2007. The second plunger opening 232 is fabricated through use of the second knock out pin 2005 and the first sleeve 2006. The second die 2007 is used to fabricate the outer plunger surface 280. As shown in FIG. 33, the second die 2007 is composed of a second die top 2008 and a second die rear 2009. In the preferred forging process, the second die rear 2009 is used to form the undercut plunger surface 282 and the conical plunger surface 283.

Figure 34:
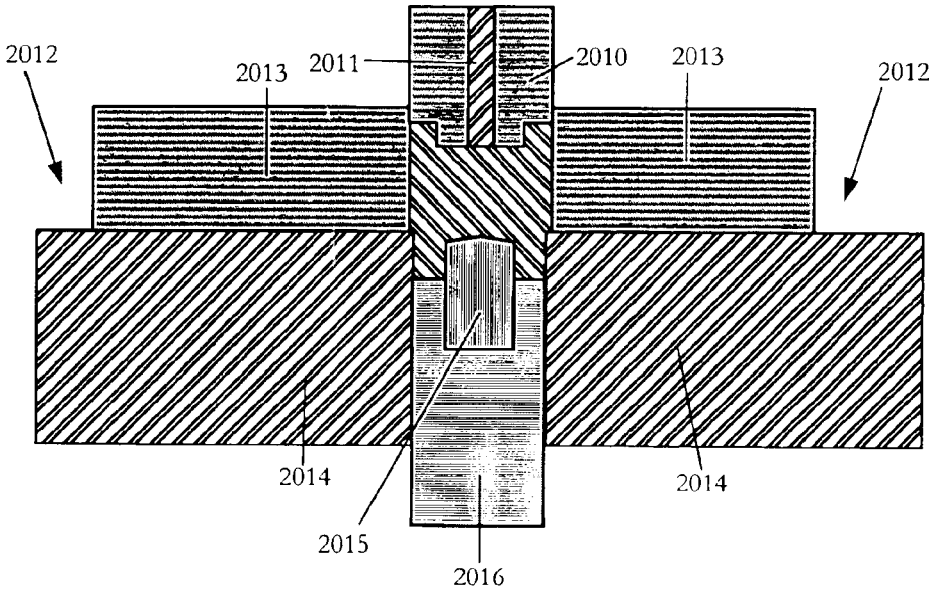

As depicted in FIG. 34, the first plunger opening 231 is fabricated through use of a third punch 2010. Within the third punch 2010 is a first pin 2011. The third punch 2010 and the first pin 2011 are used to fabricate at least a portion of the annular plunger surface 235. As shown in FIG. 34, it is desirable to preserve the integrity of the outer plunger surface 280 through use of a third die 2012. The third die 2012 is composed of a third die top 2013 and a third die rear 2014. Those skilled in the art will appreciate the desirability of using a third knock out pin 2015 and a second sleeve 2016 to preserve the forging of the second opening.

Figure 35:
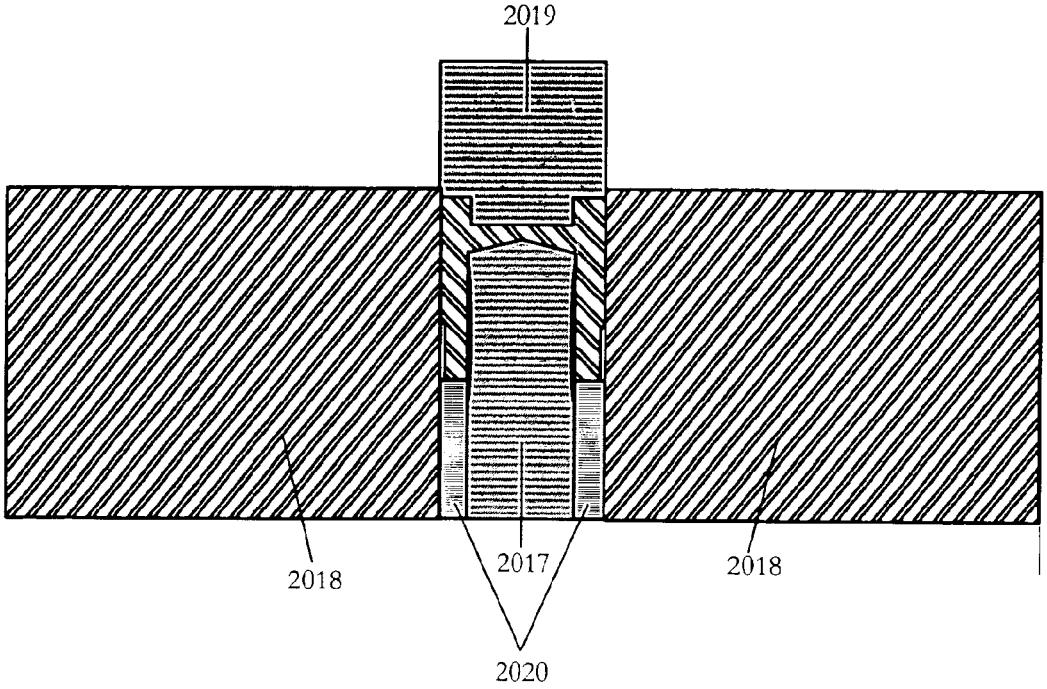

FIG. 35 depicts the forging of the inner plunger surface 250. As depicted, the inner plunger surface 250 is forged through use of a punch extrusion pin 2017. Those skilled in the art will appreciate that it is advantageous to preserve the integrity of the first plunger opening 231 and the outer plunger surface 280. This function is accomplished through use of a fourth die 2018 and a fourth knock out pin 2019. A punch stripper sleeve 2020 is used to remove the punch extrusion pin 2017 from the inner plunger surface 250.

Figure 36:
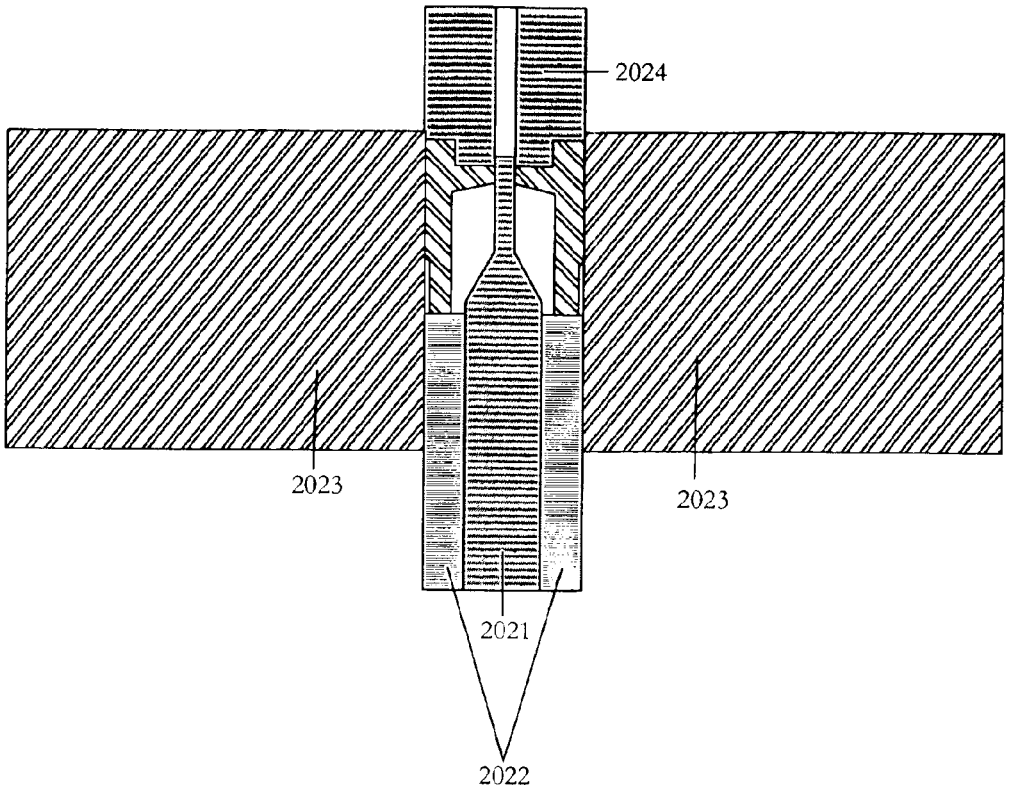

As shown in FIG. 36, the plunger hole 236 is fabricated through use of a piercing punch 2021 and a stripper sleeve 2022. To assure that other forging operations are not affected during the fabrication of the plunger hole 236, a fifth die 2023 is used around the outer plunger surface 280 and a tool insert 2024 is used at the first plunger opening 231.

Figure 37:
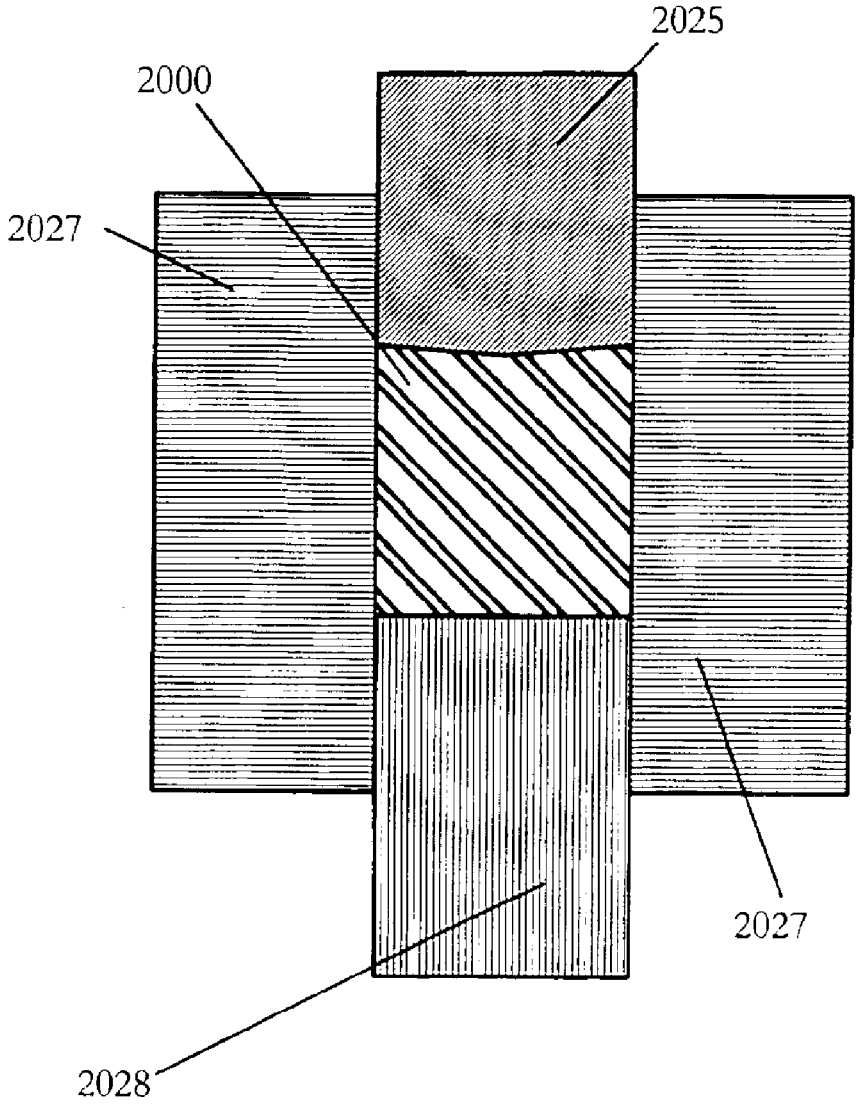
FIGS. 37–41 depict an alternative method of fabricating a leakdown plunger.

FIGS. 37 to 41 illustrate an alternative method of fabricating a leakdown plunger. FIG. 37 depicts a metal wire or metal rod 2000 drawn to size. The ends of the wire or rod 2000 are squared off through the use of a first punch 2025, a first die 2027, and a first knock out pin 2028.

Figure 38:
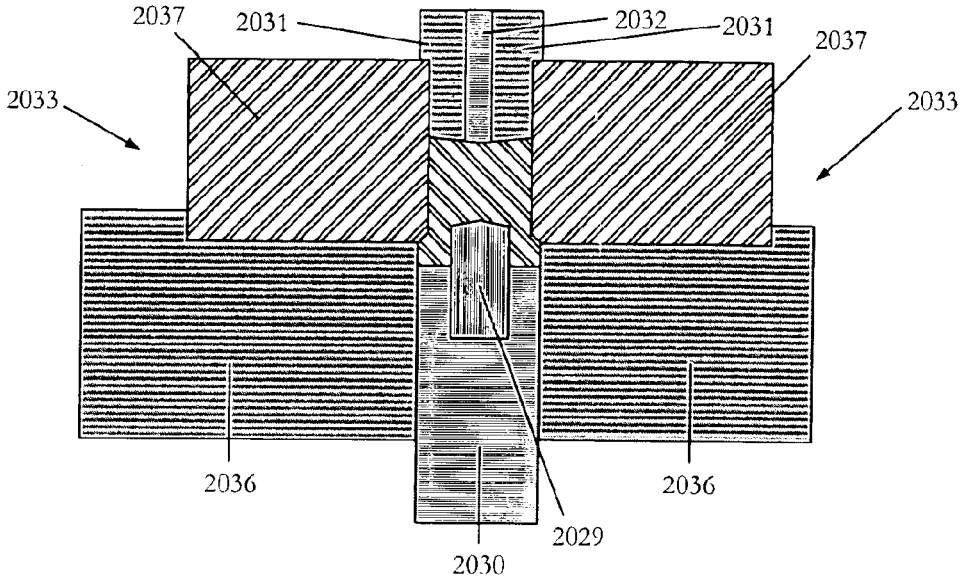

As depicted in FIG. 38, the fabrication of the first plunger opening 231, the second plunger opening 232, and the outer plunger surface 280 is preferably commenced through use of a punch pin 2029, a first punch stripper sleeve 2030, second knock out pin 2031, a stripper pin 2032, and a second die 2033. The first plunger opening 231 is fabricated through use of the second knock out pin 2031. The stripper pin 2032 is used to remove the second knock out pin 2031 from the first plunger opening 231.

The second plunger opening 232 is fabricated, at least in part, through the use of the punch pin 2029. A first punch stripper sleeve 2030 is used to remove the punch pin 2029 from the second plunger opening 232. The outer plunger surface 280 is fabricated, at least in part, through the use of a second die 2033. The second die 2033 is composed of a second die top 2036 and a second die rear 2037.

Figure 39:
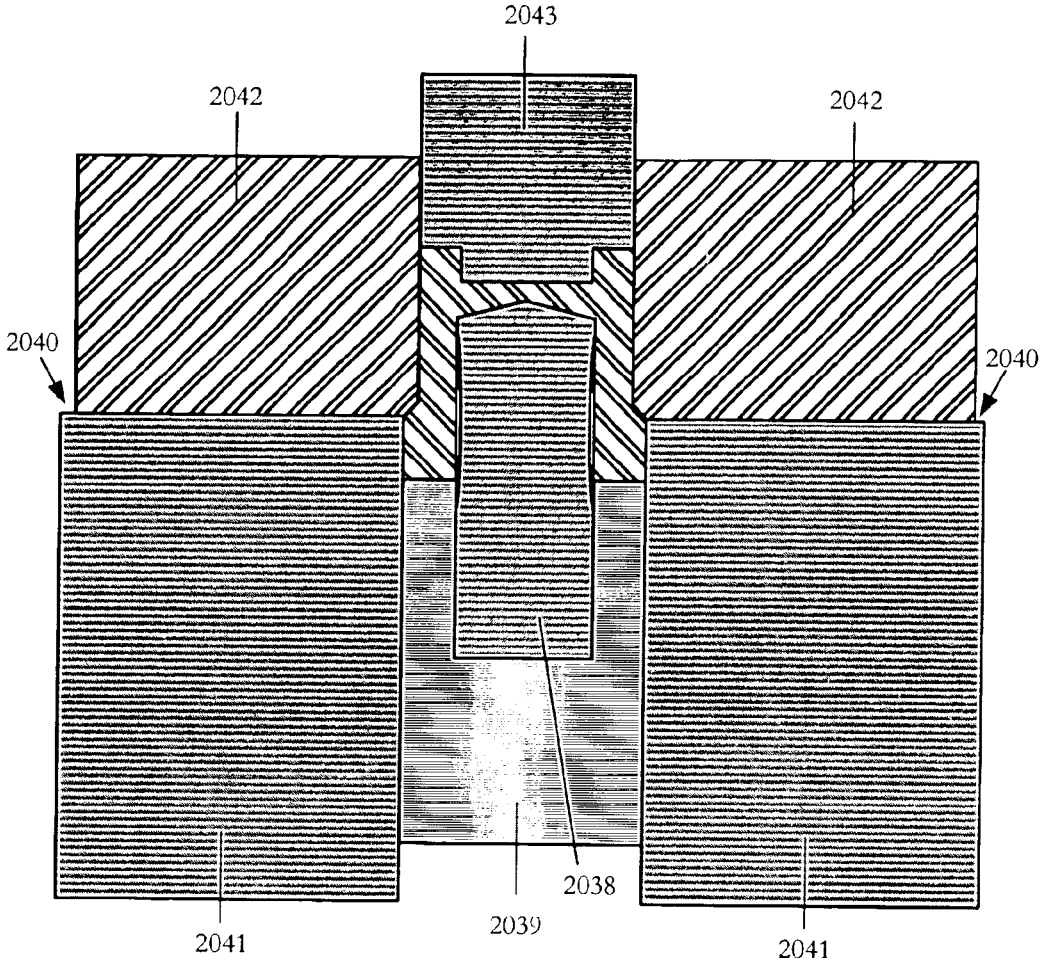

FIG. 39 depicts the forging of the inner plunger surface 250. As depicted, the inner plunger surface 250 is forged through the use of an extrusion punch 2038. A second punch stripper sleeve 2039 is used to remove the extrusion punch 2038 from the inner plunger surface 250.

Those skilled in the art will appreciate that it is advantageous to preserve the previous forging of the first plunger opening 231 and the outer plunger surface 280. A third knock out pin 2043 is used to preserve the previous forging operations on the first plunger opening 231. A third die 2040 is used to preserve the previous forging operations on the outer plunger surface 280. As depicted in FIG. 39, the third die 2040 is composed of a third die top 2041 and a third die rear 2042.

Figure 40:
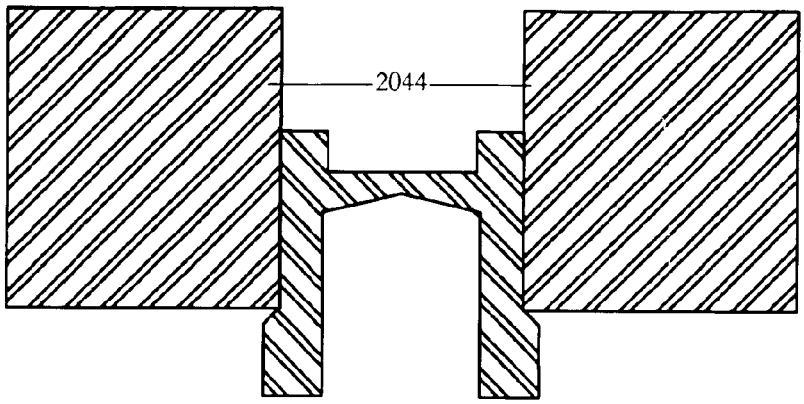

As depicted in FIG. 40, a sizing die 2044 is used in fabricating the second inner conical plunger surface 254 and the second inner cylindrical plunger surface 255. The sizing die 2044 is run along the outer plunger surface 280 from the first plunger opening 231 to the second plunger opening 232. This operation results in metal flowing through to the inner plunger surface 250.

Figure 41:
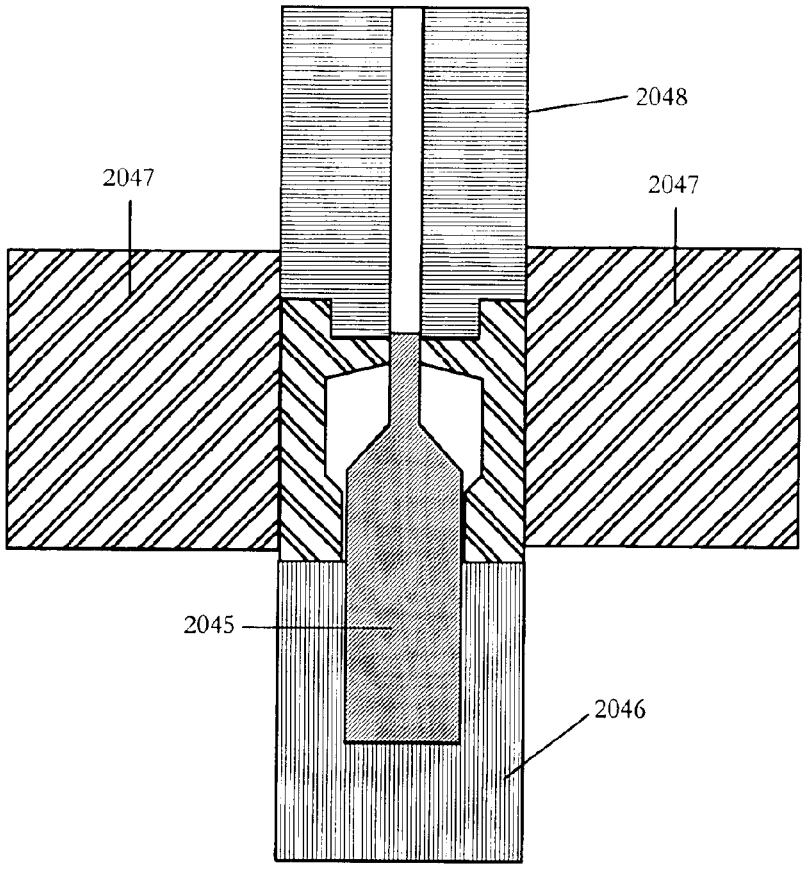

As shown in FIG. 41, the plunger hole 236 is fabricated through use of a piercing punch 2045 and a stripper sleeve 2046. The stripper sleeve 2046 is used in removing the piercing punch 2045 from the plunger hole 236. To assure that other forging operations are not affected during the fabrication of the plunger hole 236, a fourth die 2047 is used around the outer plunger surface 280 and a tool insert 2048 is used at the first plunger opening 231.

Figure 42:
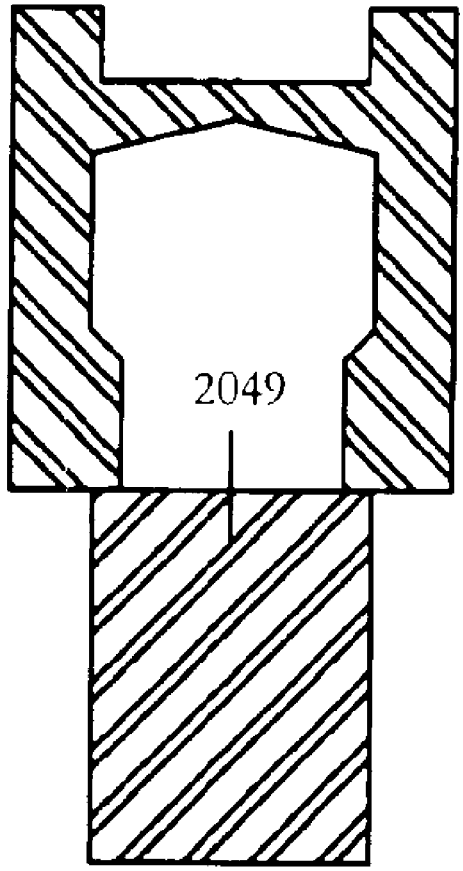
FIG. 42 depicts a step in an alternative method of fabricating a leakdown plunger.

Those skilled in the art will appreciate that further desirable finishing may be accomplished through machining. For example, an undercut plunger surface 282 may be fabricated and the second plunger opening 232 may be enlarged through machining. Alternatively, as depicted in FIG. 42, a shave punch 2049 may be inserted into the second plunger opening 232 and plow back excess material.

Figure 43:
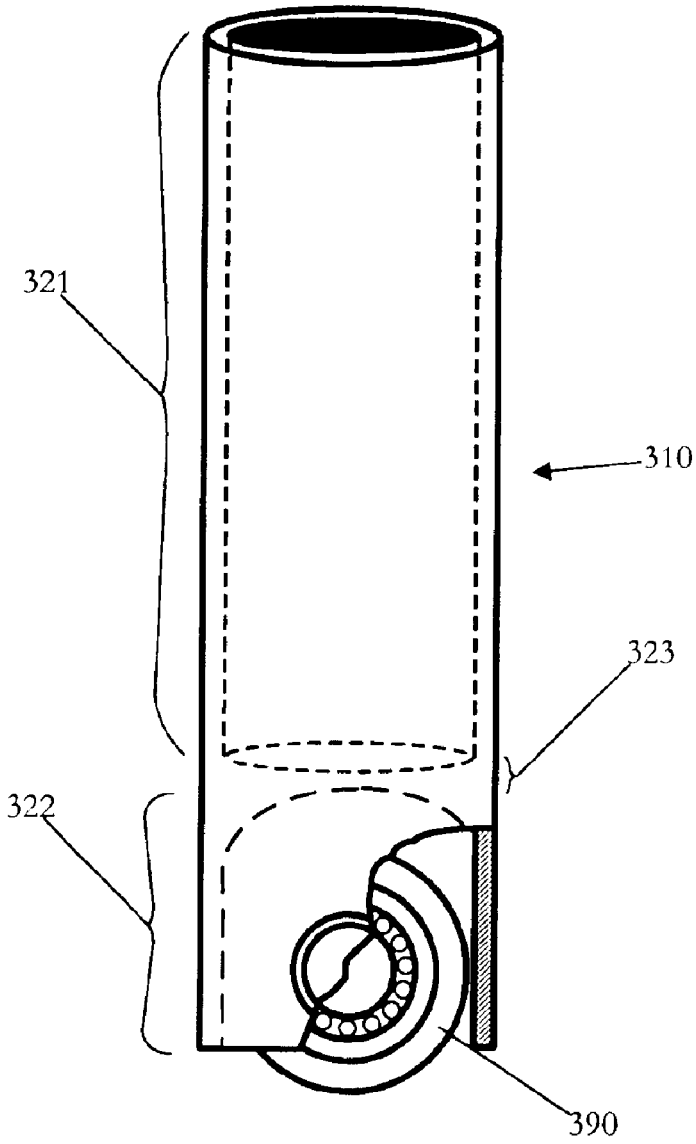
FIG. 43 depicts a preferred embodiment of a valve lifter body.
Figure 44:
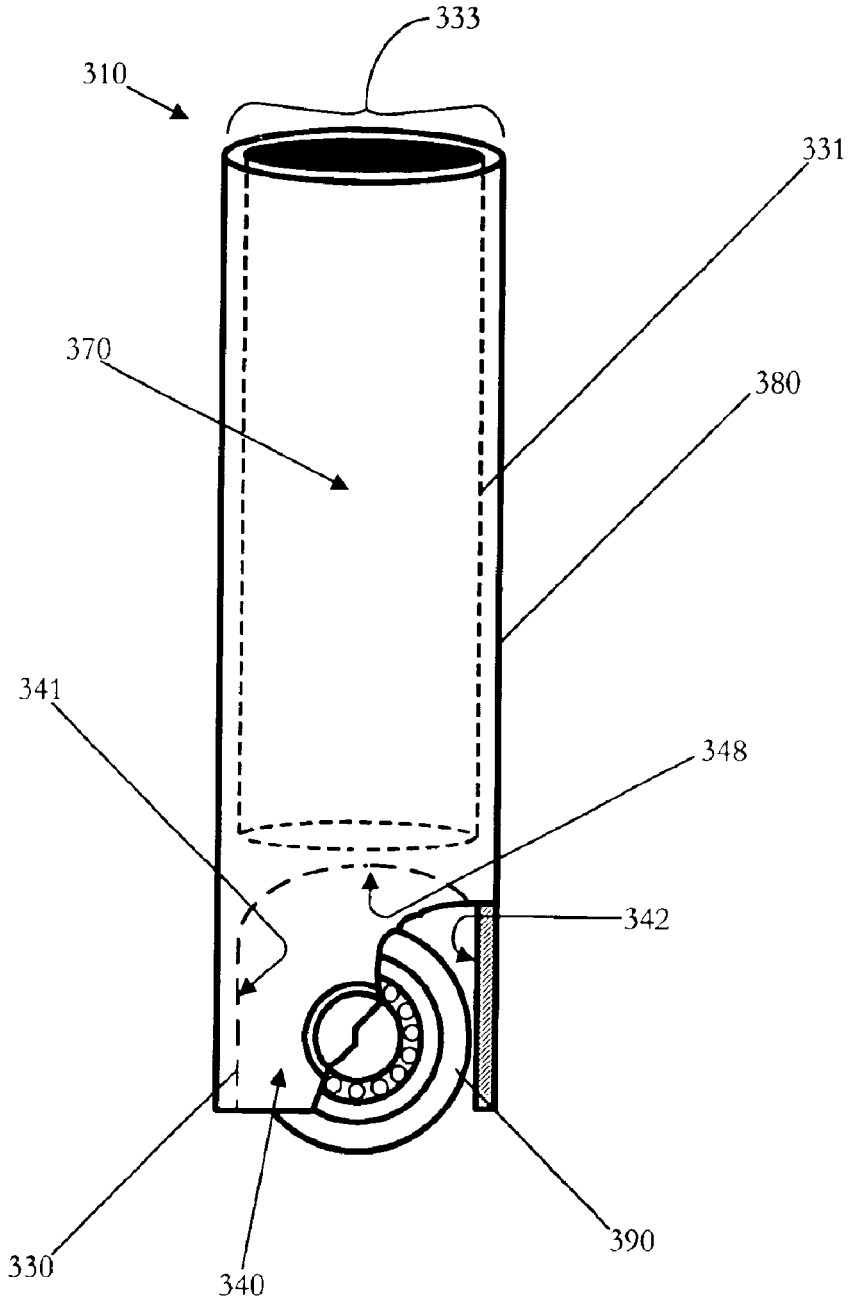
FIG. 44 depicts a preferred embodiment of a valve lifter body.
Figure 45:
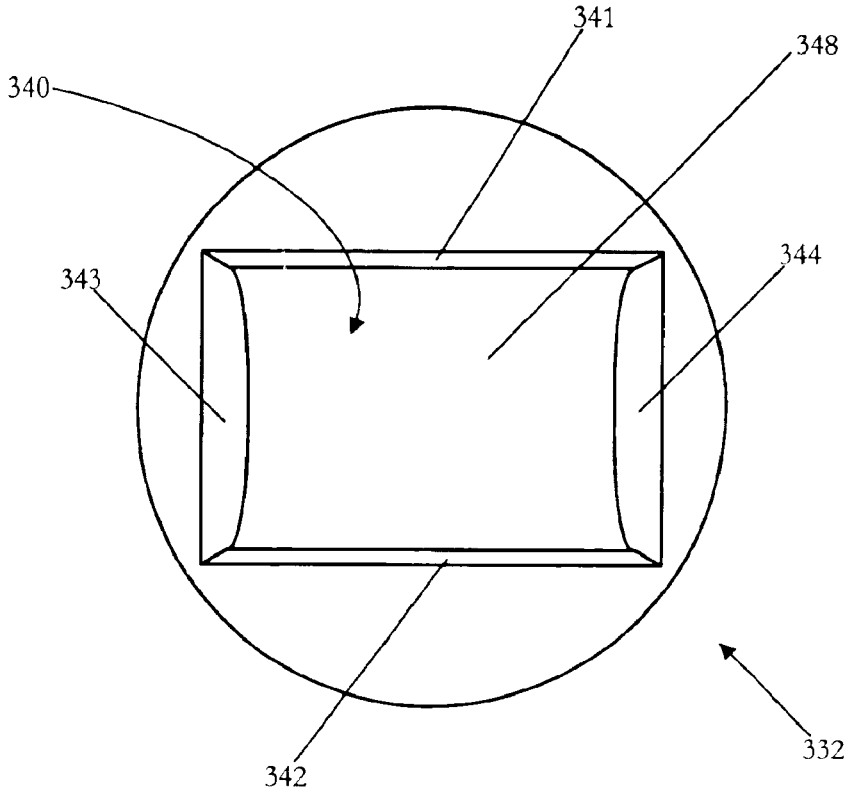
FIG. 45 depicts the top view of a preferred embodiment of a valve lifter body.

Turning now to the drawings, FIGS. 43, 44, and 45 show a preferred embodiment of the valve lifter body 310. The valve lifter 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter 310 is composed of pearlitic material. According to still another aspect of the present invention, the valve lifter 310 is composed of austenitic material. According to another aspect of the present invention, the metal is a ferritic material.

The valve lifter body 310 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 43 depicts a cross-sectional view of the valve lifter body 310 of the preferred embodiment of the present invention composed of a plurality of lifter elements. FIG. 43 shows the valve lifter body, generally designated 310, with a roller 390. The valve lifter body 310 of the preferred embodiment is fabricated from a single piece of metal wire or rod and is described herein as a plurality of lifter elements. The valve lifter body 310 includes a first hollow lifter element 321, a second hollow lifter element 322, and a solid lifter element 323. In the preferred embodiment, the solid lifter element 323 is located between the first hollow lifter element 321 and the second hollow lifter element 322.

The valve lifter body 310 functions to accommodate a plurality of inserts. According to one aspect of the present invention, the valve lifter body 310 accommodates a lash adjuster, such as the lash adjuster body 110. According to another aspect of the present invention, the valve lifter body 310 accommodates a leakdown plunger, such as the leakdown plunger 210. According to another aspect of the present invention, the valve lifter body 310 accommodates a push rod seat (not shown). According to yet another aspect of the present invention, the valve lifter body 310 accommodates a socket, such as the metering socket 10.

The valve lifter body 310 is provided with a plurality of outer surfaces and inner surfaces. FIG. 44 depicts a cross-sectional view of the valve lifter body 310 of the preferred embodiment of the present invention. As shown in FIG. 44, the valve lifter body 310 is provided with an outer lifter surface 380 which is cylindrically shaped. The outer lifter surface 380 encloses a plurality of cavities. As depicted in FIG. 44, the outer lifter surface 380 encloses a first lifter cavity 330 and a second lifter cavity 331. The first lifter cavity 330 includes a first inner lifter surface 340. The second lifter cavity 331 includes a second inner lifter surface 370.

FIG. 45 depicts a top view and provides greater detail of the first lifter cavity 330 of the preferred embodiment. As shown in FIG. 45, the first lifter cavity 330 is provided with a first lifter opening 332 shaped to accept a cylindrical insert. The first inner lifter surface 340 is configured to house a cylindrical insert 390, which, in the preferred embodiment of the present invention, functions as a roller. Those skilled in the art will appreciate that housing a cylindrical insert can be accomplished through a plurality of different configurations. The first inner lifter surface 340 of the preferred embodiment includes a plurality of flat surfaces and a plurality of walls. As depicted in FIG. 45, the inner lifter surface 340 includes two opposing lifter walls 343, 344. A first flat lifter surface 341 is adjacent to a curved lifter surface 348. The curved lifter surface 348 is adjacent to a second flat lifter surface 342. The two lifter walls 343, 344 are located on opposing sides of the curved lifter surface 348.

Figure 54:
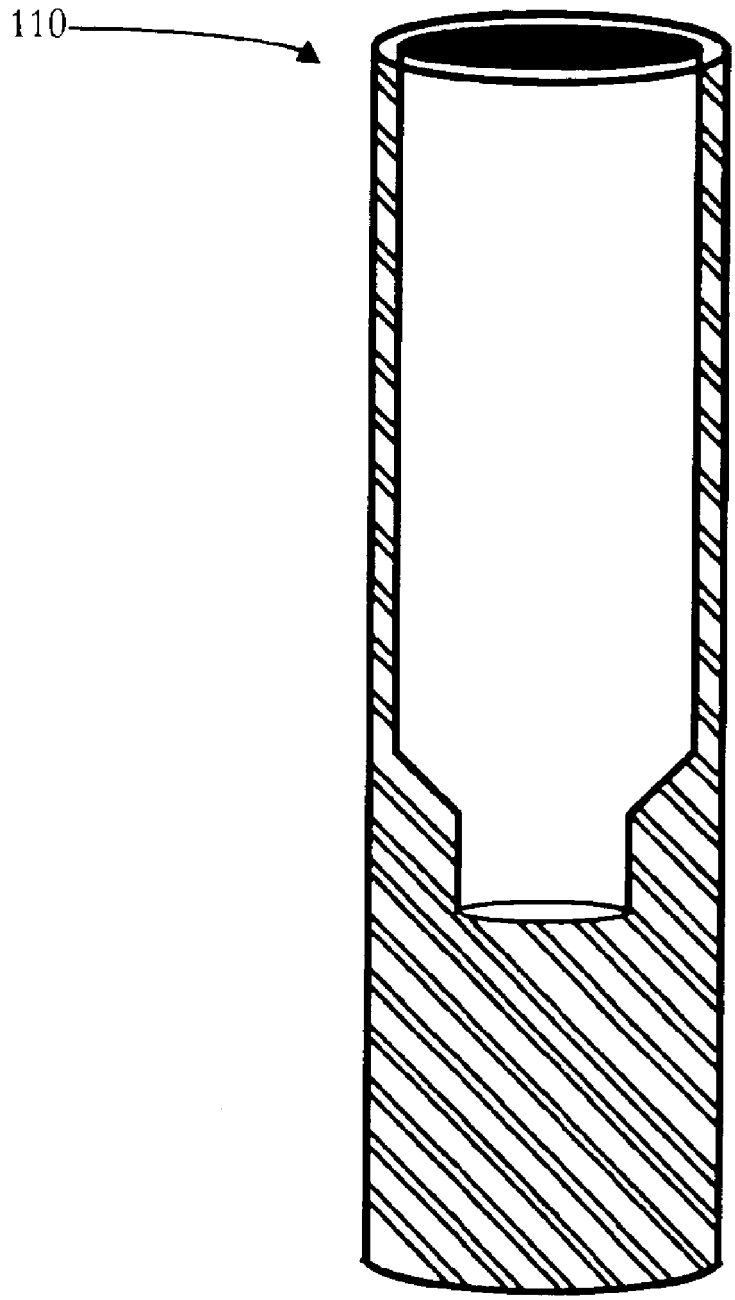
FIG. 54 depicts a lash adjuster body.

Referring to FIG. 44, the valve lifter body 310 of the present invention is provided with a second lifter cavity 331 which includes a second lifter opening 333 which is in a circular shape. The second lifter cavity 331 is provided with a second inner lifter surface 370. The second inner lifter surface 370 of the preferred embodiment is cylindrically shaped. Alternatively, the second inner lifter surface 370 is configured to house a lash adjuster generally designated 110 on FIG. 54. However, those skilled in the art will appreciate that the second inner lifter surface 370 can be conically or frustoconically shaped without departing from the spirit of the present invention.

The present invention is fabricated through a plurality of processes. According to one aspect of the present invention, the valve lifter body 310 is machined. According to another aspect of the present invention, the valve lifter body 310 is forged. According to yet another aspect of the present invention, the valve lifter body 310 is fabricated through casting. The valve lifter body 310 of the preferred embodiment of the present invention is forged. As used herein, the term "forge," "forging," or "forged" is intended to encompass what is known in the art as "cold forming," "cold heading," "deep drawing," and "hot forging."

The valve lifter body 310 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 310 preferably begins with a metal wire or metal rod which is drawn to size. The ends of the wire or rod are squared off by a punch. After being drawn to size, the wire or rod is run through a series of dies or extrusions. The second lifter cavity 331 is extruded through use of a punch and an extruding pin. After the second lifter cavity 331 has been extruded, the first lifter cavity 330 is forged. The first lifter cavity 330 is extruded through use of an extruding punch and a forming pin.

Alternatively, the valve lifter body 310 is fabricated through machining. As used herein, machining means the use of a chucking machine, a drilling machine, a grinding machine, or a broaching machine. Machining is accomplished by first feeding the valve lifter body 310 into a chucking machine, such as an ACME-Gridley automatic chucking machine. Those skilled in the art will appreciate that other machines and other manufacturers of automatic chucking machines can be used.

To machine the second lifter cavity 331, the end containing the second lifter opening 333 is faced so that it is substantially flat. The second lifter cavity 331 is bored. Alternatively, the second lifter cavity 331 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 331 is ground using an internal diameter grinding machine, such as a Heald grinding machine. Those skilled in the art will appreciate that the second lifter cavity 331 can be ground using other grinding machines.

Those skilled in the art will appreciate that the other features of the present invention may be fabricated through machining. For example, the first lifter cavity 330 can be machined. To machine the first lifter cavity 330, the end containing the first lifter opening 332 is faced so that it is substantially flat. The first lifter cavity 330 is drilled and then the first lifter opening 332 is broached using a broaching machine.

Figure 46:
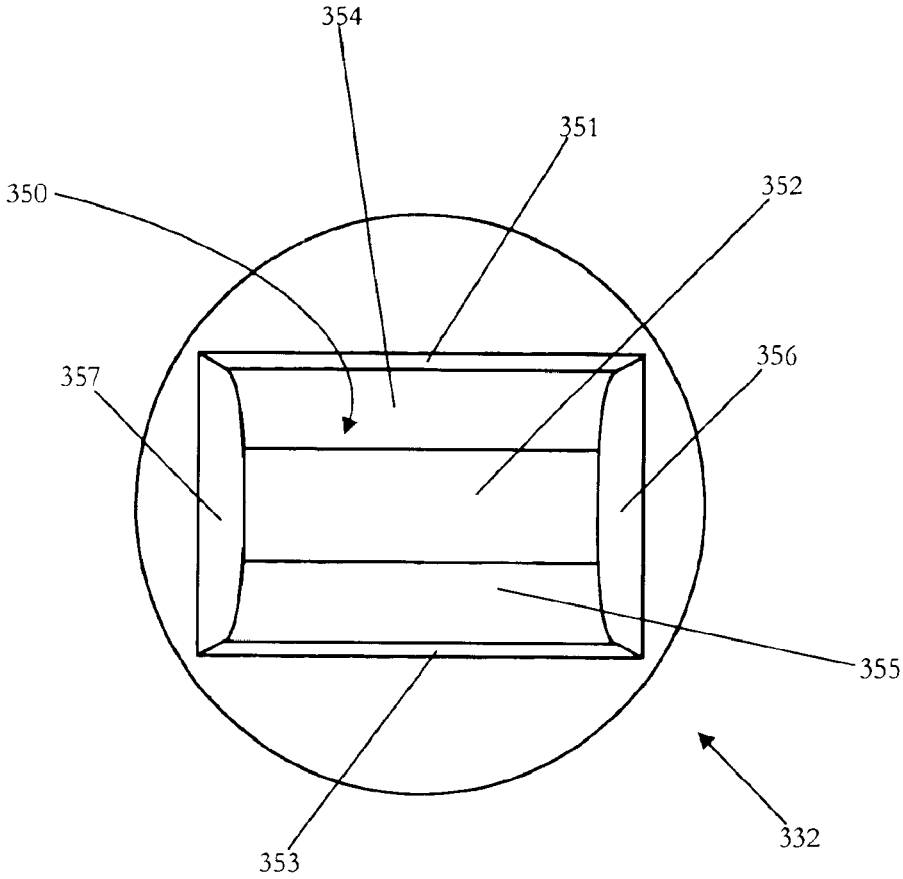
FIG. 46 depicts the top view of another preferred embodiment of a valve lifter body.
Figure 47:
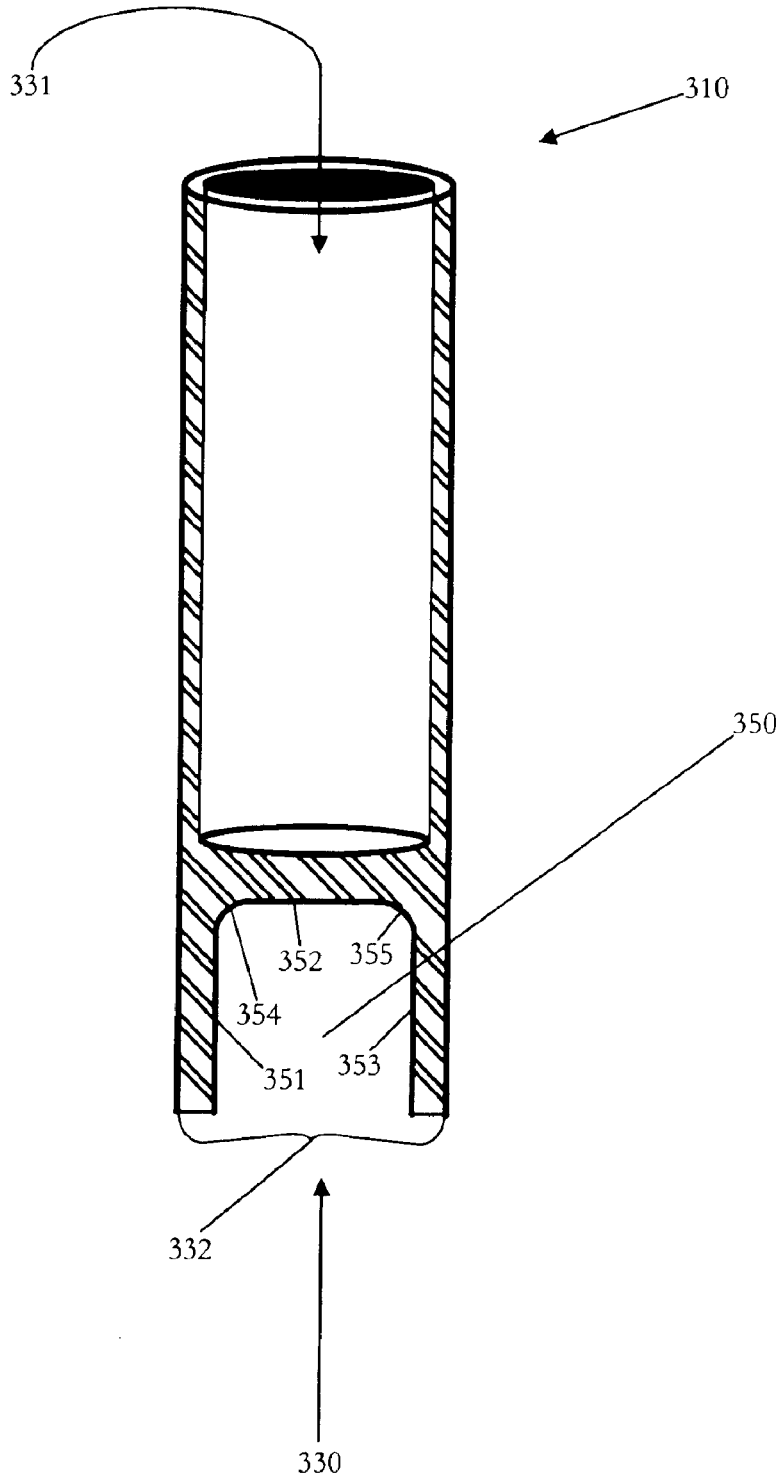
FIG. 47 depicts a second embodiment of a valve lifter body.

In an alternative embodiment of the present invention depicted in FIG. 46, the first lifter cavity 330 is provided with a first lifter opening 332 shaped to accept a cylindrical insert and a first inner lifter surface 350. The first inner lifter surface 350 includes a plurality of flat surfaces, a plurality of curved surfaces, and a plurality of walls. As depicted in FIG. 46, a first flat lifter surface 351 is adjacent to a first curved lifter surface 354. The first curved lifter surface 354 is adjacent to a second flat lifter surface 352. The second flat lifter surface 352 is adjacent to a second curved lifter surface 355. The second curved lifter surface 355 is adjacent to a third flat lifter surface 353. On opposing sides of the third flat lifter surface 353 are lifter walls 356, 357. FIG. 47 depicts a cross-sectional view of the valve lifter body 310 with the first lifter cavity 330 shown in FIG. 46.

Figure 48:
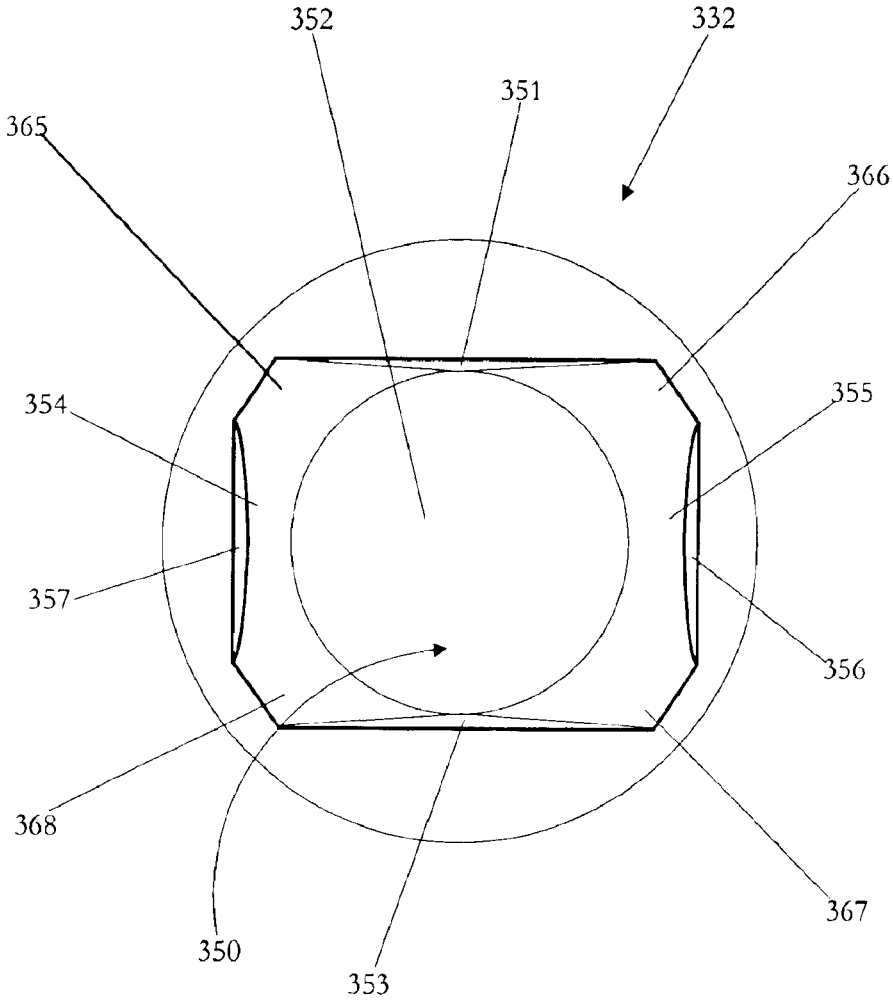
FIG. 48 depicts the top view of another preferred embodiment of a valve lifter body.
Figure 49:
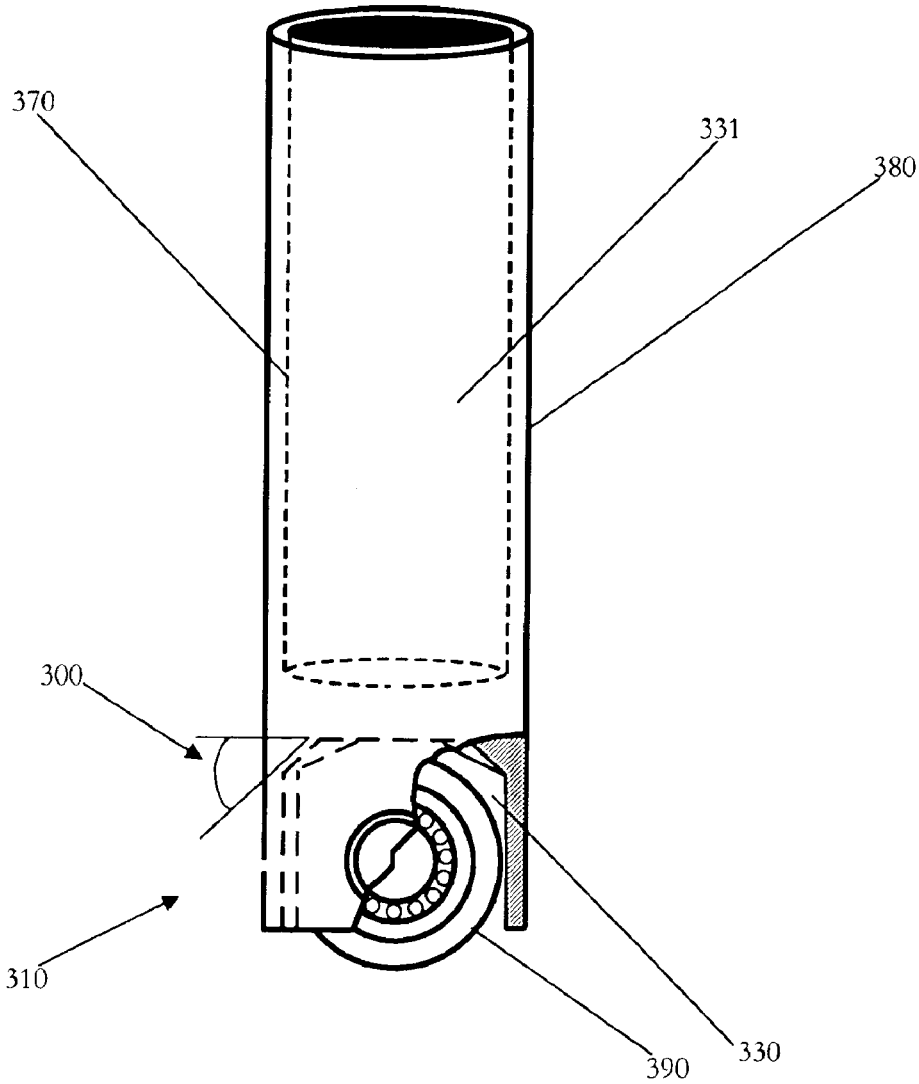
FIG. 49 depicts a third embodiment of a valve lifter body.

In another alternative embodiment of the present invention, as depicted in FIG. 48 and 49, the first lifter cavity 330 is provided with a first lifter opening 332 shaped to accept a cylindrical insert and a first inner lifter surface 350. The first inner lifter surface 350 includes a plurality of flat surfaces and a plurality of walls. Referring to FIG. 48, a first flat lifter surface 351 is adjacent to a second flat lifter surface 352, a first angled lifter surface 365, and a second angled lifter surface 366. The first angled lifter surface 365 is adjacent to a second flat lifter surface 352 and a first curved lifter surface 354. As depicted in FIG. 49 the first angled lifter surface 365 is configured to be at an angle 300 relative to the plane of the second flat lifter surface 352, preferably between twenty-five and about ninety degrees.

The second angled lifter surface 366 is adjacent to the flat lifter surface 352. As shown in FIG. 49, the second angled lifter surface 366 is configured to be at an angle 300 relative to the plane of the second flat lifter surface 352, preferably between twenty-five and about ninety degrees. The second angled lifter surface 366 is adjacent to a second curved lifter surface 355. The second curved lifter surface 355 is adjacent to a third angled lifter surface 367 and a first lifter wall 356. The third angled lifter surface 367 is adjacent to the second flat lifter surface 352 and a third flat lifter surface 353. As depicted in FIG. 49, the third angled lifter surface 367 is configured to be at an angle 300 relative to the plane of the second flat lifter surface 352, preferably between twenty-five and about ninety degrees.

The third flat lifter surface 353 is adjacent to a fourth angled lifter surface 368. The fourth angled lifter surface 368 adjacent to the first curved lifter surface 354 and a second lifter wall 357. As depicted in FIG. 49, the fourth angled lifter surface 368 is configured to be at an angle 300 relative to the plane of the second flat lifter surface 352, preferably between twenty-five and about ninety degrees. FIG. 49 depicts a cross-sectional view of an embodiment with the first lifter cavity 330 of FIG. 48.

Figure 50:
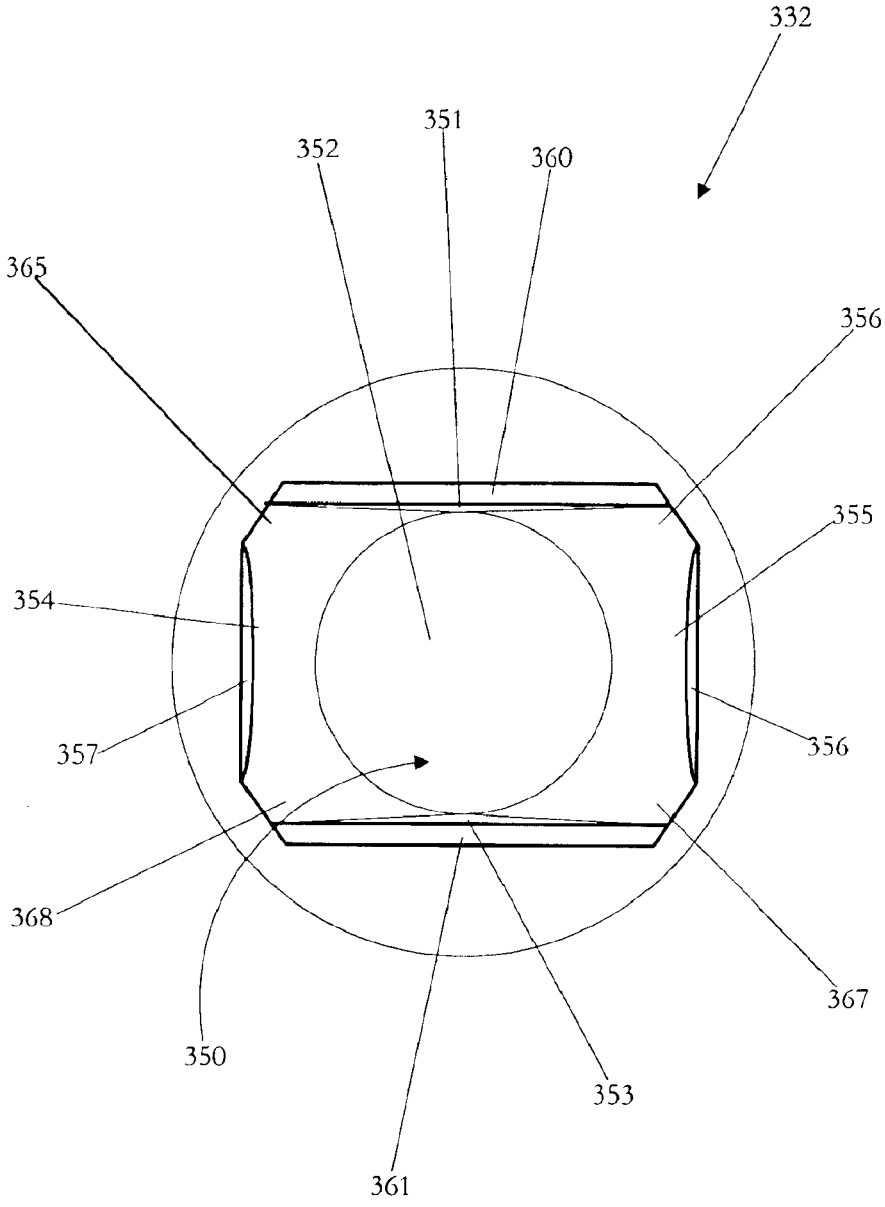
FIG. 50 depicts the top view of another preferred embodiment of a valve lifter body.

Shown in FIG. 50 is an alternative embodiment of the first lifter cavity 330 depicted in FIG. 48. In the embodiment depicted in FIG. 50, the first lifter cavity 330 is provided with a chamfered lifter opening 332 and a first inner lifter surface 350. The chamfered lifter opening 332 functions so that a cylindrical insert can be introduced to the valve lifter body 310 with greater ease. The chamfered lifter opening 332 accomplishes this function through lifter chamfers 360, 361 which are located on opposing sides of the chamfered lifter opening 332. The lifter chamfers 360, 361 of the embodiment shown in FIG. 50 are flat surfaces at an angle relative to the flat lifter surfaces 341, 342 so that a cylindrical insert 390 can be introduced through the first lifter opening 332 with greater ease. Those skilled in the art will appreciate that the lifter chamfers 360, 361 can be fabricated in a number of different configurations; so long as the resulting configuration renders introduction of a cylindrical insert 390 through the first lifter opening 332 with greater ease, it is a "chamfered lifter opening" within the spirit and scope of the present invention.

The lifter chamfers 360, 361 are preferably fabricated through forging via an extruding punch pin. Alternatively, the lifter chamfers 360, 361 are machined by being ground before heat-treating. Those skilled in the art will appreciate that other methods of fabrication can be employed within the scope of the present invention.

Figure 51:
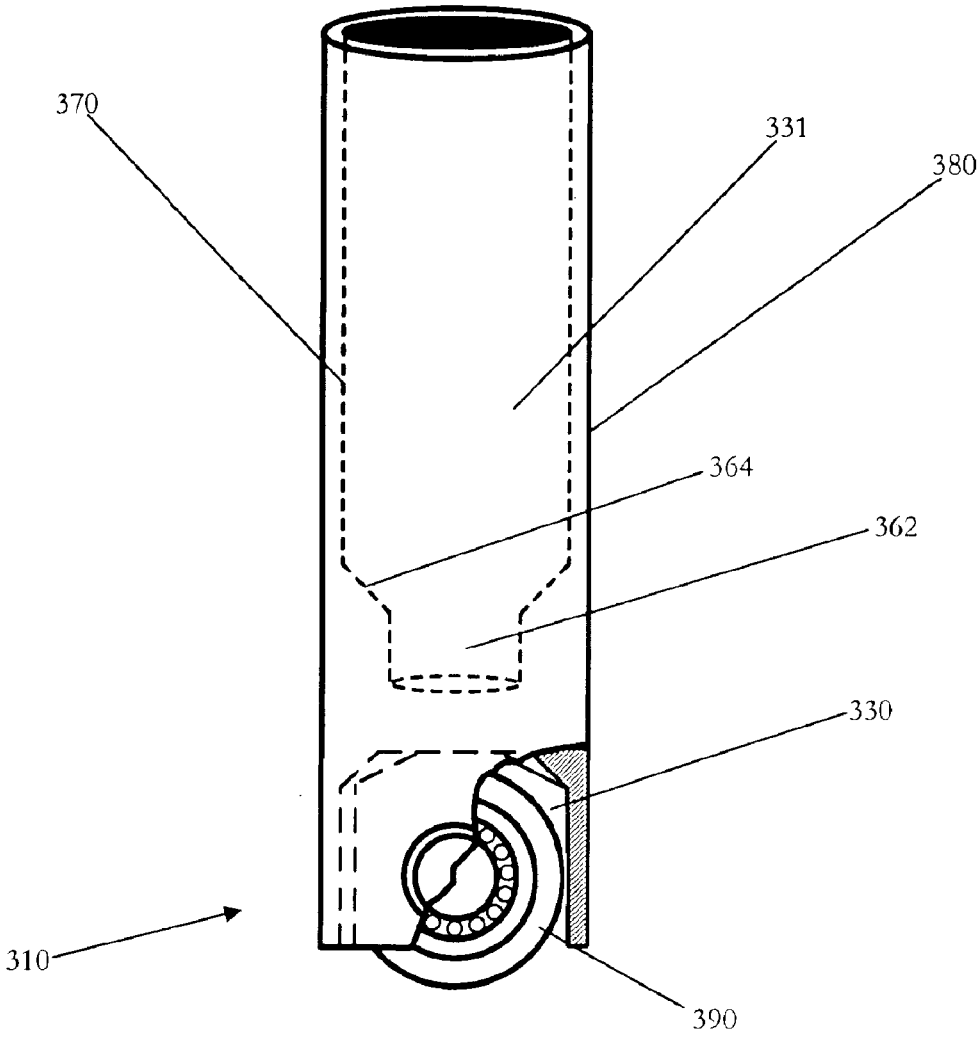
FIG. 51 depicts a fourth embodiment of a valve lifter body.

FIG. 51 discloses yet another alternative embodiment of the present invention. As depicted in FIG. 51, the valve lifter body 310 is provided with a second lifter cavity 331 which includes a plurality of cylindrical and conical surfaces. The second lifter cavity 331 depicted in FIG. 51 includes a second inner lifter surface 370. The second inner lifter surface 370 of the preferred embodiment is cylindrically shaped, concentric relative to the cylindrically shaped outer surface 380. The second inner lifter surface 370 is provided with a lifter well 362. The lifter well 362 is shaped to accommodate a spring (not shown). In the embodiment depicted in FIG. 51, the lifter well 362 is cylindrically shaped at a diameter that is smaller than the diameter of the second inner lifter surface 370. The cylindrical shape of the lifter well 362 is preferably concentric relative to the outer lifter surface 380. The lifter well 362 is preferably forged through use of an extruding die pin.

Alternatively, the lifter well 362 is machined by boring the lifter well 362 in a chucking machine. Alternatively, the lifter well 362 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 362 is ground using an internal diameter grinding machine, such as a Heald grinding machine. Those skilled in the art will appreciate that the lifter well 362 can be ground using other grinding machines.

Adjacent to the lifter well 362, the embodiment depicted in FIG. 51 is provided with a conically-shaped lead lifter surface 364 which can be fabricated through forging or machining. However, those skilled in the art will appreciate that the present invention can be fabricated without the lead lifter surface 364.

Figure 52:
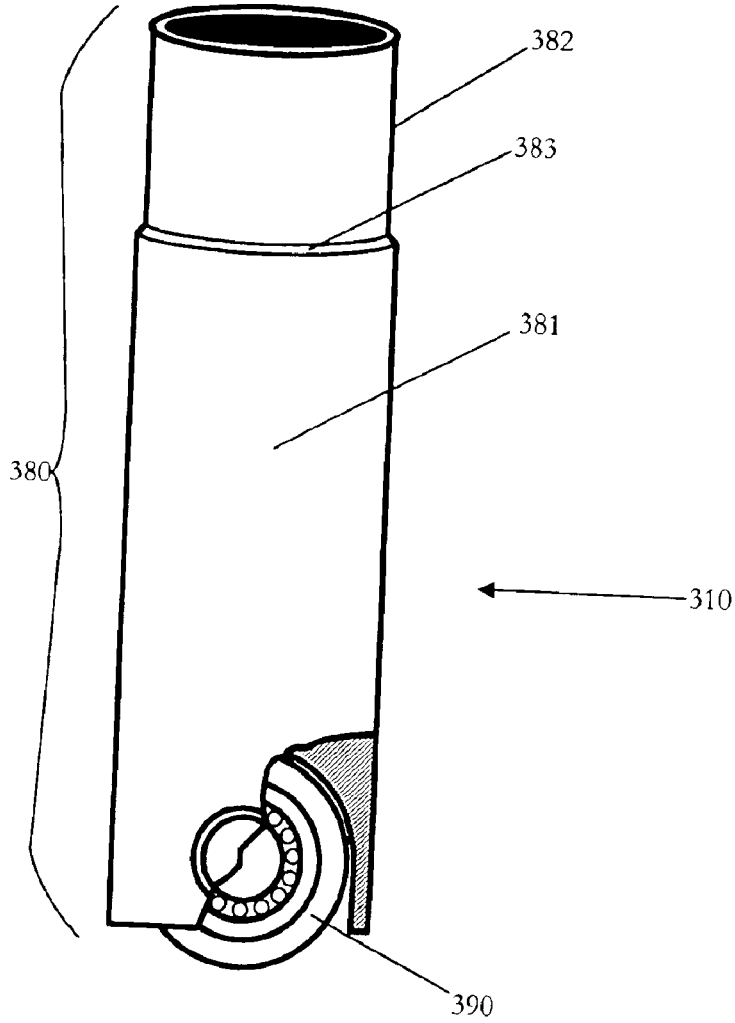
FIG. 52 depicts a fourth embodiment of a valve lifter body.

Depicted in FIG. 52 is another alternative embodiment of the present invention. As shown in FIG. 52, the valve lifter body 310 is provided with an outer lifter surface 380. The outer lifter surface 380 includes a plurality of surfaces. In the embodiment depicted in FIG. 52, the outer lifter surface 380 includes a cylindrical lifter surface 381, an undercut lifter surface 382, and a conical lifter surface 383. As depicted in FIG. 52, the undercut lifter surface 382 extends from one end of the valve lifter body 310 and is cylindrically shaped. The diameter of the undercut lifter surface 382 is smaller than the diameter of the cylindrical lifter surface 381.

The undercut lifter surface 382 is preferably forged through use of an extruding die. Alternatively, the undercut lifter surface 382 is fabricated through machining. Machining the undercut lifter surface 382 is accomplished through use of an infeed centerless grinding machine, such as a Cincinnati grinder. The surface is first heat-treated and then the undercut lifter surface 382 is ground via a grinding wheel. Those skilled in the art will appreciate that additional surfaces can be ground into the outer lifter surface 380 with minor alterations to the grinding wheel.

As depicted in FIG. 52, the conical lifter surface 383 is located between the cylindrical lifter surface 381 and the undercut lifter surface 382. The conical lifter surface 383 is preferably forged through use of an extruding die. Alternatively, the conical lifter surface 383 is fabricated through machining. Those with skill in the art will appreciate that the outer lifter surface 380 can be fabricated without the conical lifter surface 383 so that the cylindrical lifter surface 381 and the undercut lifter surface 382 abut one another.

Figure 53:
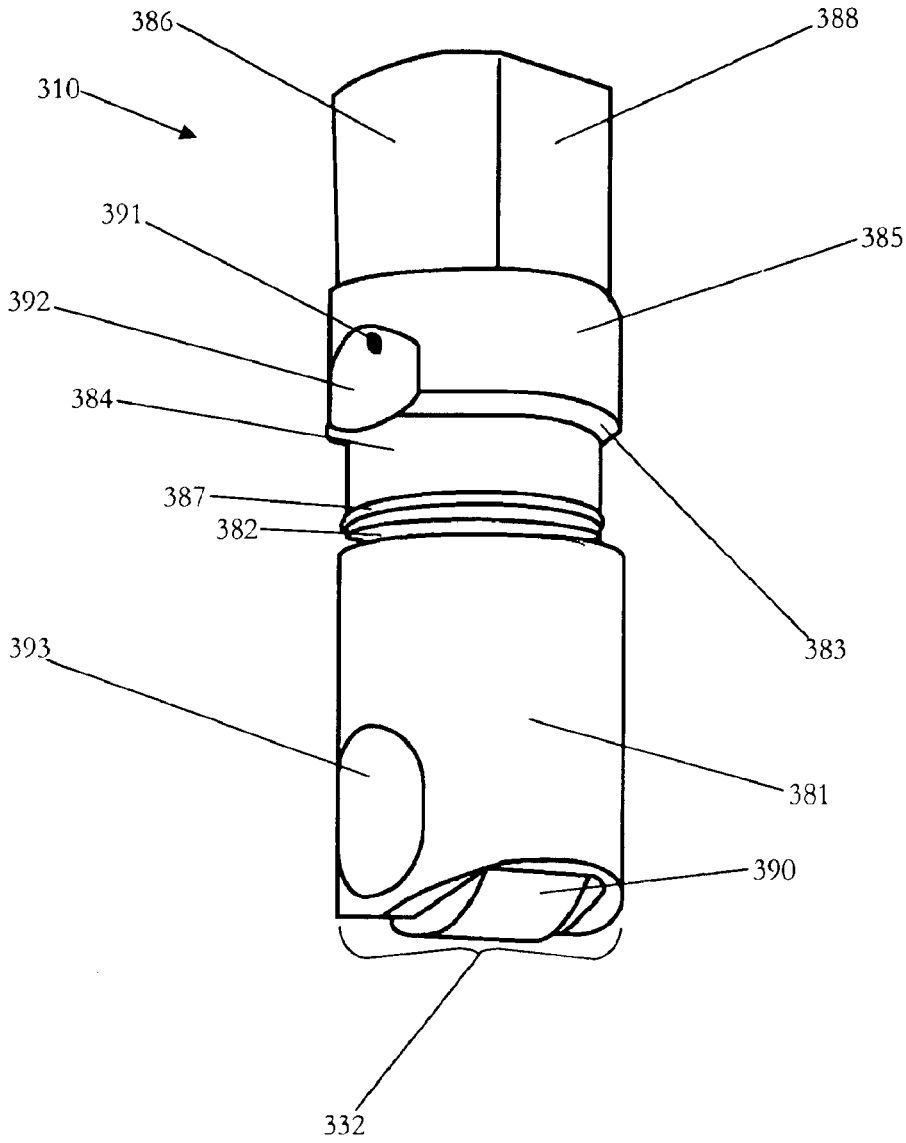
FIG. 53 depicts a fifth embodiment of a valve lifter body.

FIG. 53 depicts another embodiment valve lifter body 310 of the present invention. In the embodiment depicted in FIG. 53, the outer lifter surface 380 includes a plurality of outer surfaces. The outer lifter surface 380 is provided with a first cylindrical lifter surface 381. The first cylindrical lifter surface 381 contains a first lifter depression 393. Adjacent to the first cylindrical lifter surface 381 is a second cylindrical lifter surface 382. The second cylindrical lifter surface 382 has a radius which is smaller than the radius of the first cylindrical lifter surface 381 The second cylindrical lifter surface 382 is adjacent to a third cylindrical lifter surface 384. The third cylindrical lifter surface 384 has a radius which is greater than the radius of the second cylindrical lifter surface 382. The third cylindrical lifter surface 384 contains a lifter ridge 387. Adjacent to the third cylindrical lifter surface 384 is a conical lifter surface 383. The conical lifter surface 383 is adjacent to a fourth cylindrical lifter surface 385. The fourth cylindrical lifter surface 385 and the conical lifter surface 383 contain a second lifter depression 392. The second lifter depression 392 defines a lifter hole 391. Adjacent to the fourth cylindrical lifter surface 385 is a flat outer lifter surface 388. The flat outer lifter surface 388 is adjacent to a fifth cylindrical lifter surface 386.

Those skilled in the art will appreciate that the features of the valve lifter body 310 may be fabricated through a combination of machining, forging, and other methods of fabrication. By way of example and not limitation, the first lifter cavity 330 can be machined while the second lifter cavity 331 is forged. Conversely, the second lifter cavity 331 can be machined while the first lifter cavity 330 is forged.

Figure 55:
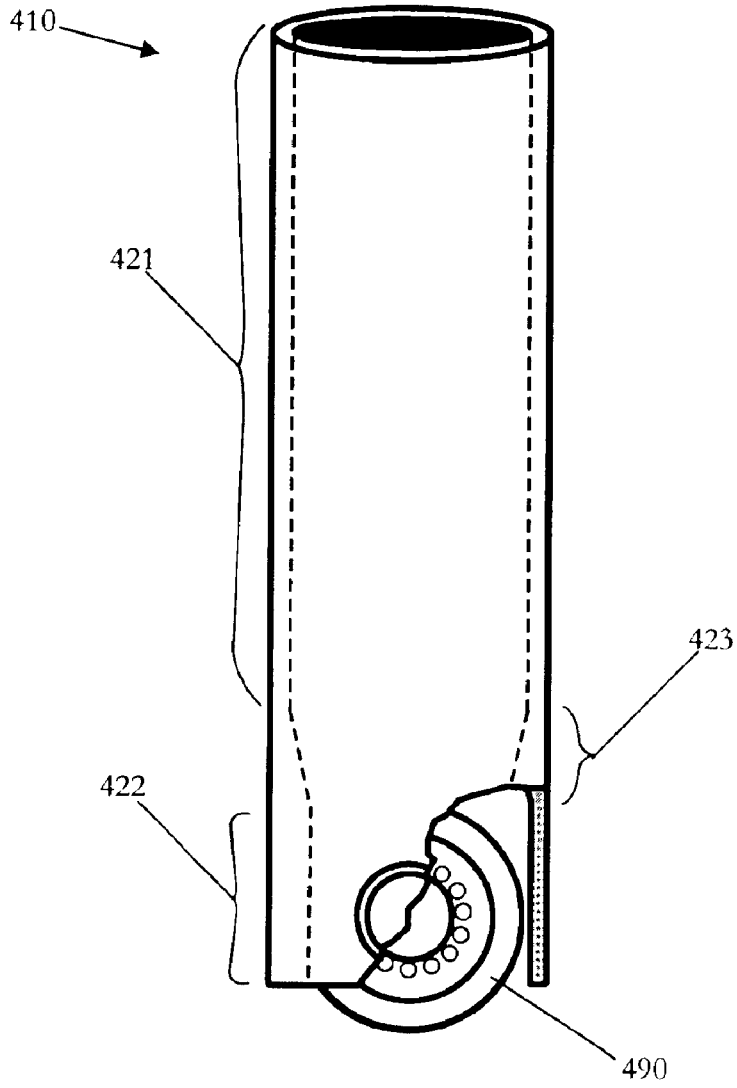
FIG. 55 depicts a preferred embodiment of a roller follower body.
Figure 56:
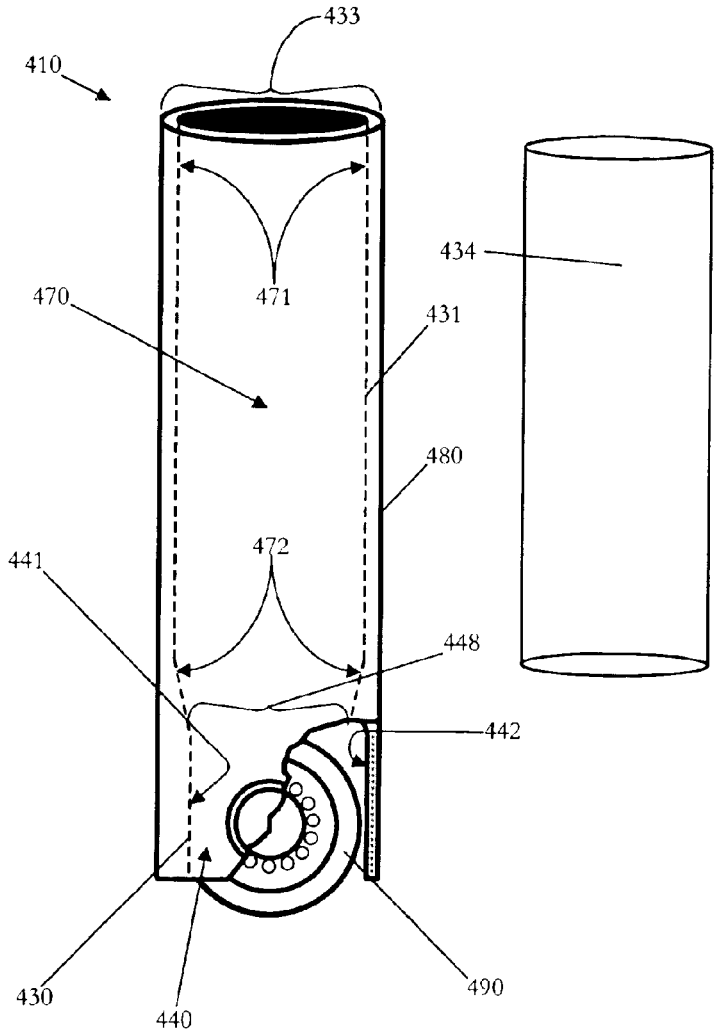
FIG. 56 depicts a preferred embodiment of a roller follower body.

Turning now to the drawings, FIGS. 55 and 56 show a preferred embodiment of the roller follower body 410. The roller follower body 410 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the roller follower body 410 is composed of pearlitic material. According to still another aspect of the present invention, the roller follower body 410 is composed of austenitic material. According to another aspect of the present invention, the metal is a ferritic material.

The roller follower body 410 is composed of a plurality of roller elements. According to one aspect of the present invention, the roller element is cylindrical in shape. According to another aspect of the present invention, the roller element is conical in shape. According to yet another aspect of the present invention, the roller element is solid. According to still another aspect of the present invention, the roller element is hollow.

FIG. 55 depicts a cross-sectional view of the roller follower body 410 composed of a plurality of roller elements. FIG. 55 shows the roller follower body, generally designated 410. The roller follower body 410 of the preferred embodiment is fabricated from a single piece of metal wire or rod and is described herein as a plurality of roller elements. The roller follower body 410 includes a first hollow roller element 421, a second hollow roller element 422, and a third hollow roller element 423. As depicted in FIG. 55, the first hollow roller element 421 is located adjacent to the third hollow roller element 423. The third hollow roller element 423 is located adjacent to the second hollow roller element 422.

The first hollow roller element 421 has a cylindrically shaped inner surface. The second hollow roller element 422 has a cylindrically shaped inner surface with a diameter which is smaller than the diameter of the first hollow roller element 421. The third hollow roller element 423 has an inner surface shaped so that an insert (not shown) rests against its inner surface "above" the second hollow roller element 422. Those skilled in the art will understand that, as used herein, terms like "above" and terms of similar import are used to specify general relationships between parts, and not necessarily to indicate orientation of the part or of the overall assembly. In the preferred embodiment, the third hollow roller element 423 has a conically or frustoconically shaped inner surface; however, an annularly shaped surface could be used without departing from the scope of the present invention.

The roller follower body 410 functions to accommodate a plurality of inserts. According to one aspect of the present invention, the roller follower body 410 accommodates a lash adjuster, such as the lash adjuster body 110. According to another aspect of the present invention, the roller follower body 410 accommodates a leakdown plunger, such as the leakdown plunger 210. According to another aspect of the present invention, the roller follower body 410 accommodates a push rod seat (not shown). According to yet another aspect of the present invention, the roller follower body 410 accommodates a socket, such as the metering socket 10.

The roller follower body 410 is provided with a plurality of outer surfaces and inner surfaces. FIG. 56 depicts a cross-sectional view of the roller follower body 410 of the preferred embodiment. As shown therein, the roller follower body 410 is provided with an outer roller surface 480 which is cylindrically shaped. The outer surface 480 encloses a plurality of cavities. As depicted in FIG. 56, the outer surface 480 encloses a first cavity 430 and a second cavity 431. The first cavity 430 includes a first inner surface 440. The second cavity 431 includes a second inner surface 470.

Figure 57A:
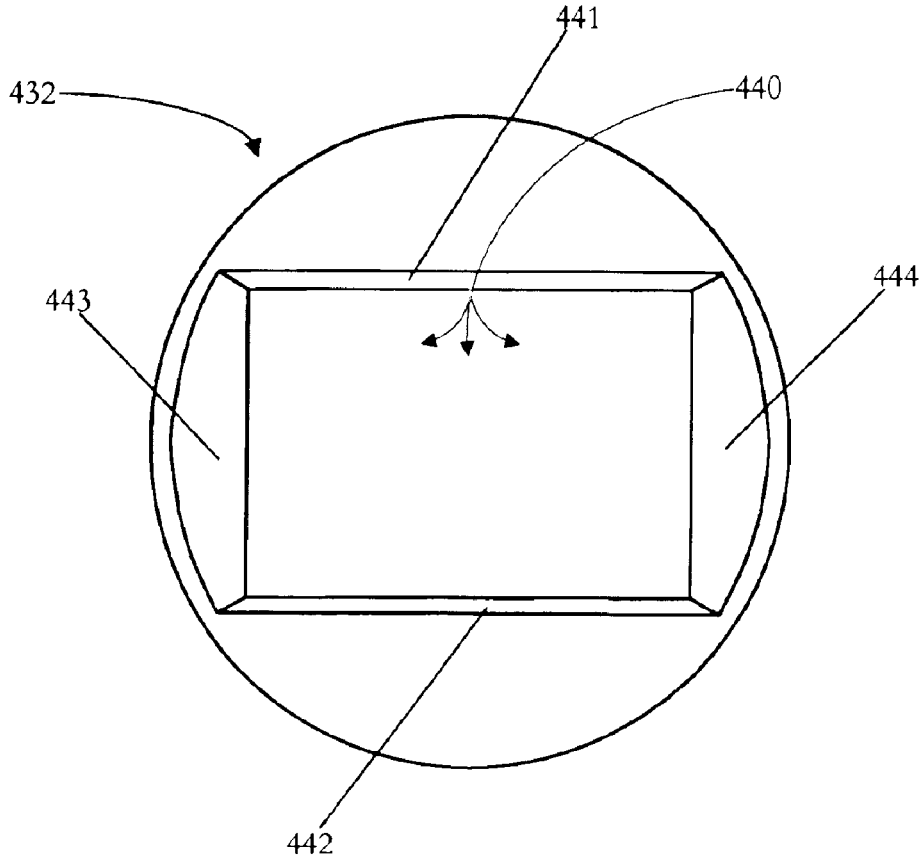
Figure 57B:
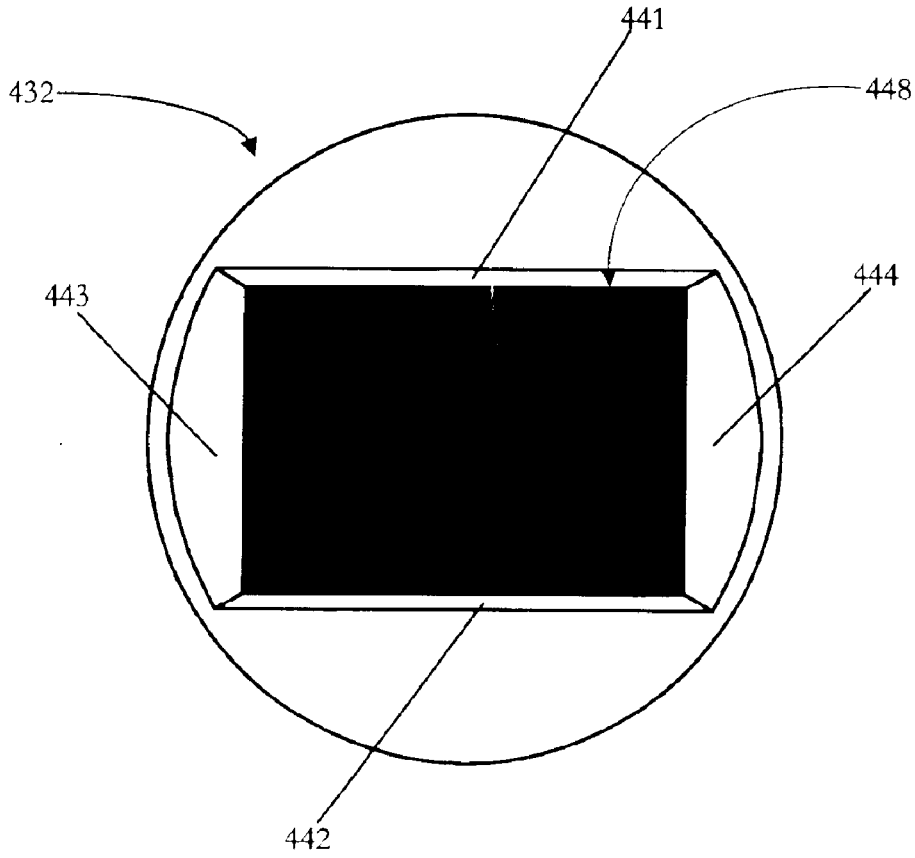

FIG. 57*a* and FIG. 57*b* depict top views and provide greater detail of the first roller cavity 430 of the preferred embodiment As shown in FIG. 57*b*, the first roller cavity 430 is provided with a first roller opening 432 shaped to accept a cylindrical insert Referring to FIG. 57*a*, the first inner roller surface 440 is configured to house a cylindrical insert 490, which, in the preferred embodiment of the present invention, functions as a roller. Those skilled in the art will appreciate that housing a cylindrical insert can be accomplished through a plurality of different configurations. In FIGS. 57*a* and 57*b*, the first inner roller surface 440 of the preferred embodiment includes a plurality of flat surfaces and a plurality of walls. As depicted in FIGS. 57*a* and 57*b*, the inner roller surface 440 defines a transition roller opening 448 which is in the shape of a polygon, the preferred embodiment being rectangular. The inner roller surface 440 includes two opposing roller walls 443, 444, a first flat roller surface 441, and a second flat roller surface 442. The first flat roller surface 441 and the second flat roller surface 442 are located generally on opposite sides of the transition roller opening 448. The transition roller opening 448 is further defined by two roller walls 443, 444 which are located generally opposite to each other.

Referring now to FIG. 56, the second roller cavity 431 of the preferred embodiment includes a second roller opening 433 that is in a circular shape. The second roller cavity 431 is provided with a second inner roller surface 470 that is configured to house an inner body 434. In the preferred embodiment the inner body 434 is the lash adjuster body 110. The second inner roller surface 470 of the preferred embodiment is cylindrically shaped. Alternatively, the second inner roller surface 470 is conically or frustoconically shaped. As depicted in FIG. 56, the second inner roller surface 470 is a plurality of surfaces including a cylindrically shaped roller surface 471 adjacent to a conically or frustoconically shaped roller surface 472.

The present invention is fabricated through a plurality of processes. According to one aspect of the present invention, the roller follower body 410 is machined. According to another aspect of the present invention, the roller follower body 410 is forged. According to yet another aspect of the present invention, the roller follower body 410 is fabricated through casting. The preferred embodiment of the present invention is forged. As used herein, the term "forge," "forging," or "forged" is intended to encompass what is known in the art as "cold forming," "cold heading," "deep drawing," and "hot forging."

The roller follower body 410 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging in the preferred embodiment begins with a metal wire or metal rod which is drawn to size. The ends of the wire or rod are squared off by a punch. After being drawn to size, the wire or rod is run through a series of dies or extrusions.

The second roller cavity 431 is extruded through use of a punch and an extruding pin. After the second roller cavity 431 has been extruded, the first roller cavity 430 is forged. The first roller cavity 430 is extruded through use of an extruding punch and a forming pin.

Alternatively, the roller follower body 410 is fabricated through machining. As used herein, machining means the use of a chucking machine, a drilling machine, a grinding machine, or a broaching machine. Machining is accomplished by first feeding the roller follower body 410 into a chucking machine, such as an ACME-Gridley automatic chucking machine. Those skilled in the art will appreciate that other machines and other manufacturers of automatic chucking machines can be used.

To machine the second roller cavity 431, the end containing the second roller opening 433 is faced so that it is substantially flat. The second roller cavity 431 is bored. Alternatively, the second roller cavity 431 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second roller cavity 431 is ground using an internal diameter grinding machine, such as a Heald grinding machine Those skilled in the art will appreciate that the second roller cavity 431 can be ground using other grinding machines.

Those skilled in the art will appreciate that the other features of the present invention may be fabricated through machining. For example, the first roller cavity 430 can be machined. To machine the first roller cavity 430, the end containing the first roller opening 432 is faced so that it is substantially flat. The first roller cavity 430 is drilled and then the first roller opening 432 is broached using a broaching machine.

In an alternative embodiment depicted in FIG. 58, the first roller cavity 430 is provided with a first inner roller surface 450 and first roller opening 432 shaped to accept a cylindrical insert 490. The first inner roller surface 450 defines a transition roller opening 452 and includes a plurality of flat surfaces, a plurality of curved surfaces, and a plurality of walls. As depicted in FIG. 58, a first flat roller surface 451 is adjacent to a first curved roller surface 454. The first curved roller surface 454 and a second curved roller surface 455 are located on opposing sides of the transition roller opening 452. The second curved roller surface 455 is adjacent to a second flat roller surface 453. On opposing sides of the second flat roller surface 453 are roller walls 456, 457.

FIG. 59 depicts a cross-sectional view of the roller follower body 410 with the first roller cavity 430 shown in FIG. 59. As shown in FIG. 59, the roller follower body 410 is also provided with a second cavity 431 which includes a second opening 433 which is in a circular shape. The second cavity 431 is provided with a second inner roller surface 470 which includes a plurality of surfaces. The second inner roller surface 470 includes a cylindrically shaped roller surface 471 and a frustoconically shaped roller surface 472.

Alternatively, the second inner roller surface 470 includes a plurality of cylindrical surfaces. As depicted in FIG. 60, the second inner roller surface 470 includes a first cylindrical roller surface 471 and a second cylindrical roller surface 473. The second inner roller surface 470 of the embodiment depicted in FIG. 60 also includes a frustoconical roller surface 472.

In yet another alternative embodiment of the present invention, as depicted in FIG. 61, the first roller cavity 430 is provided with a first roller opening 432 shaped to accept a cylindrical insert and a first inner roller surface 450. The first inner roller surface 450 defines a transition roller opening 452 linking the first roller cavity 430 with a second roller cavity 431. The second roller cavity 431 is provided with a second inner roller surface 470 which includes a plurality of surfaces. As shown in FIG. 61, the second inner roller surface 470 includes a cylindrical roller surface 471 and a frustoconical roller surface 472.

Those skilled in the art will appreciate that the second inner roller surface 470 may include a plurality of cylindrical surfaces. FIG. 62 depicts a second inner roller surface 470 which includes a first cylindrical roller surface 471 adjacent to a frustoconical roller surface 472. Adjacent to the frustoconical roller surface 472 is a second cylindrical roller surface 473. The second cylindrical roller surface 473 depicted in FIG. 62 defines a transition roller opening 452 linking a second roller cavity 431 with a first roller cavity 430. The first roller cavity 430 is provided with a first inner roller surface 450 and a first roller opening 432 shaped to accept a cylindrical insert. The first inner roller surface 450 includes a plurality of flat and curved surfaces.

FIG. 63 depicts a first inner roller surface 450 depicted in FIGS. 61 and 62. A first flat roller surface 451 is adjacent to the transition roller opening 452, a first angled roller surface 465, and a second angled roller surface 466. The first angled roller surface 465 is adjacent to the transition roller opening 452, a first roller curved surface 454, and a first angled roller wall 469-*a*. As depicted in FIGS. 61 and 62, the first angled roller surface 465 is configured to be at an angle 400 relative to the plane of a first angled roller wall 469-*a*, preferably between sixty-five and about ninety degrees.

The second angled roller surface 466 is adjacent to the transitional roller opening 452 and a second angled roller wall 469-*b*. As shown in FIGS. 61 and 62, the second angled roller surface 466 is configured to be at an angle 400 relative to the plane of the second angled roller wall 469-*b*, preferably between sixty-five and about ninety degrees. The second angled roller surface 466 is adjacent to a second curved roller surface 455. The second curved roller surface 455 is adjacent to a third angled roller surface 467 and a first roller wall 456. The third angled roller surface 467 is adjacent to the transitional roller opening 452, a second flat roller surface 453, and a third angled roller wall 469-*c*. As depicted in FIGS. 61 & 62, the third angled roller surface 467 is configured to be at an angle 400 relative to the plane of the third angled roller wall 469-*c*, preferably between sixty-five and about ninety degrees.

The second flat roller surface 453 is adjacent to a fourth angled roller surface 468. The fourth angled roller surface 468 adjacent to the first curved roller surface 454, a fourth angled roller wall 469-*d*, and a second roller wall 457. As depicted in FIGS. 61 and 62, the fourth angled roller surface 468 is configured to be at an angle relative to the plane of the fourth angled roller wall 469-*d*, preferably between sixty-five and about ninety degrees. FIGS. 61 and 62 depict cross-sectional views of embodiments with the first roller cavity 430 of FIG. 63.

Shown in FIG. 64 is an alternative embodiment of the first roller cavity 430 depicted in FIG. 63. In the embodiment depicted in FIG. 64, the first roller cavity 430 is provided with a chamfered roller opening 432 and a first inner roller surface 450. The chamfered roller opening 432 functions so that a cylindrical insert can be introduced to the roller follower body 410 with greater ease. The chamfered roller opening 432 accomplishes this function through roller chamfers 460, 461 which are located on opposing sides of the chamfered roller opening 432. The roller chamfers 460, 461 of the embodiment shown in FIG. 64 are flat surfaces at an angle relative to the flat roller surfaces 451, 452 so that a cylindrical insert 490 can be introduced through the first roller opening 432 with greater ease. Those skilled in the art will appreciate that the roller chamfers 460, 461 can be fabricated in a number of different configurations; so long as the resulting configuration renders introduction of a cylindrical insert 490 through the first roller opening 432 with greater ease, it is a "chamfered roller opening" within the spirit and scope of the present invention.

The roller chamfers 460, 461 are preferably fabricated through forging via an extruding punch pin. Alternatively, the roller chamfers 460, 461 are machined by being ground before heat-treating. Those skilled in the art will appreciate that other methods of fabrication can be employed within the scope of the present invention.

FIG. 65 discloses the second roller cavity 431 of yet another alternative embodiment of the present invention. As depicted in FIG. 65, the roller follower body 410 is provided with a second roller cavity 431 which includes a plurality of cylindrical and conical surfaces. The second roller cavity 431 depicted in FIG. 65 includes a second inner roller surface 470. The second inner roller surface 470 of the preferred embodiment is cylindrically shaped, concentric relative to the cylindrically shaped outer roller surface 480. The second inner roller surface 470 is provided with a transitional tube 462. The transitional tube 462 is shaped to fluidly link the second roller cavity 431 with a first roller cavity 430. In the embodiment depicted in FIG. 65, the transitional tube 462 is cylindrically shaped at a diameter that is smaller than the diameter of the second inner roller surface 470. The cylindrical shape of the transitional tube 462 is preferably concentric relative to the outer roller surface 480. The transitional tube 462 is preferably forged through use of an extruding die pin.

Alternatively, the transitional tube 462 is machined by boring the transitional tube 462 in a chucking machine. Alternatively, the transitional tube 462 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the transitional tube 462 is ground using an internal diameter grinding machine, such as a Heald grinding machine. Those skilled in the art will appreciate that the transitional tube 462 can be ground using other grinding machines.

Adjacent to the transitional tube 462, the embodiment depicted in FIG. 64 is provided with a conically-shaped roller lead surface 464 which can be fabricated through forging or machining. However, those skilled in the art will appreciate that the present invention can be fabricated without the roller lead surface 464

Depicted in FIG. 66 is a roller follower body 410 of an alternative embodiment of the present invention. As shown in FIG. 66, the roller follower body 410 is provided with an outer roller surface 480. The outer roller surface 480 includes a plurality of surfaces. In the embodiment depicted in FIG. 66, the outer roller surface 480 includes a cylindrical roller surface 481, an undercut roller surface 482, and a conical roller surface 483. As depicted in FIG. 66, the undercut roller surface 482 extends from one end of the roller follower body 410 and is cylindrically shaped. The diameter of the undercut roller surface 482 is smaller than the diameter of the cylindrical roller surface 481.

The undercut roller surface 482 is preferably forged through use of an extruding die. Alternatively, the undercut roller surface 482 is fabricated through machining. Machining the undercut roller surface 482 is accomplished through use of an infeed centerless grinding machine, such as a Cincinnati grinder. The surface is first heat-treated and then the undercut roller surface 482 is ground via a grinding wheel. Those skilled in the art will appreciate that additional surfaces can be ground into the outer roller surface with minor alterations to the grinding wheel.

As depicted in FIG. 66, the conical roller surface 483 is located between the cylindrical roller surface 481 and the undercut roller surface 482. The conical roller surface 483 is preferably forged through use of an extruding die. Alternatively, the conical roller surface 483 is fabricated through machining. Those with skill in the art will appreciate that the outer roller surface 480 can be fabricated without the conical roller surface 483 so that the cylindrical surface 481 and the undercut roller surface 482 abut one another.

FIG. 67 depicts a roller follower body 410 constituting another embodiment. In the embodiment depicted in FIG. 67, the outer roller surface 480 includes a plurality of surfaces. The outer roller surface 480 is provided with a first cylindrical roller surface 481. The first cylindrical roller surface 481 contains a first roller depression 493. Adjacent to the first cylindrical roller surface 481 is a second cylindrical roller surface 482. The second cylindrical roller surface 482 has a radius that is smaller than the radius of the first cylindrical roller surface 481. The second cylindrical roller surface 482 is adjacent to a third cylindrical roller surface 484. The third cylindrical roller surface 484 has a radius that is greater than the radius of the second cylindrical roller surface 482. The third cylindrical roller surface 484 contains a ridge 487. Adjacent to the third cylindrical roller surface 484 is a conical roller surface 483. The conical roller surface 483 is adjacent to a fourth cylindrical roller surface 485. The fourth cylindrical roller surface 485 and the conical roller surface 483 contain a second roller depression 492. The second roller depression 492 defines a roller hole 491. Adjacent to the fourth cylindrical roller surface 485 is a flat outer roller surface 488. The flat outer roller surface 488 is adjacent to a fifth cylindrical roller surface 486.

Those skilled in the art will appreciate that the features of the roller follower body 410 may be fabricated through a combination of machining, forging, and other methods of fabrication. By way of example and not limitation, the first roller cavity 430 can be machined while the second roller cavity 431 is forged. Conversely, the second roller cavity 431 can be machined while the first roller cavity 430 is forged.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An assembly, comprising:

a) a socket body including a forgeable material and provided with an outer socket surface that is generally cylindrical in shape, a first socket surface, and a second socket surface, wherein the outer socket surface is configured to cooperate with the inner surface of an engine workpiece, the first socket surface includes a push rod cooperating surface, and the second socket surface includes a plunger reservoir passage configured to conduct fluid and a curved socket surface that is concentric relative to the outer socket surface and configured to cooperate with a leakdown plunger; and b) the leakdown plunger is provided with a first plunger opening, a second plunger opening, and an outer plunger surface enclosing an inner plunger surface, wherein the first plunger opening is provided with an annular plunger surface defining a plunger hole shaped to accommodate an insert, the second plunger opening is configured to cooperate with the socket body, the outer plunger surface includes a cylindrical plunger surface and an undercut plunger surface wherein the undercut plunger surface is cylindrically shaped and is located at an end of the plunger body, and the inner plunger surface includes a plurality of inner cylindrical plunger surfaces and is fluidly linked to the outer socket surface by the plunger reservoir passage.

2. An assembly according to claim 1, wherein at least one of the socket body, the leakdown plunger, and the engine workpiece is fabricated at least in part through forging.

3. An assembly according to claim 1, wherein at least a portion of the second socket surface contacts the leakdown plunger and the plunger reservoir passage is located between the socket body and the leakdown plunger.

4. An assembly according to claim 1, wherein the push rod cooperating surface is generally spherical and concentric relative to the outer socket surface.

5. An assembly according to claim 1, wherein the engine workpiece is a lash adjuster body.

6. An assembly according to claim 1, wherein the curved socket surface corresponds to the second plunger opening.

7. An assembly according to claim 1, wherein the curved socket surface provides a closer fit between the second socket surface and the second plunger opening.

8. An assembly, comprising:

a) a socket body including a forgeable material and provided with an outer socket surface, a first socket surface, and a second socket surface, wherein the outer socket surface is configured to cooperate with the inner surface of a lash adjuster body, the first socket surface includes a push rod cooperating surface, and the second socket surface includes a plunger reservoir passage that is fluidly linked to a leakdown path on a leakdown plunger and configured to conduct fluid, and a curved socket surface configured to cooperate with the leakdown plunger;

b) the leakdown plunger is provided with a first plunger opening, a second plunger opening, and an outer plunger surface enclosing an inner plunger surface, wherein the first plunger opening is provided with an annular plunger surface defining a plunger hole shaped to accommodate an insert, the second plunger opening is configured to cooperate with the socket body, the outer plunger surface includes a cylindrical plunger surface and an undercut plunger surface that forms a leakdown path with the lash adjuster body, wherein the undercut plunger surface is cylindrically shaped and is located at an end of the plunger body and the inner plunger surface includes a plurality of inner cylindrical plunger surfaces and is fluidly linked to the outer socket surface by the plunger reservoir passage; and c) the lash adjuster body is provided with a lash adjuster opening and an outer lash adjuster surface enclosing a lash adjuster cavity that includes an inner lash adjuster surface, wherein the inner lash adjuster surface includes a first cylindrical lash adjuster surface and a lash adjuster well that includes a second cylindrical lash adjuster surface.

9. An assembly according to claim 8, wherein the first cylindrical lash adjuster surface abuts an annular lash adjuster surface with an annulus that defines the second cylindrical lash adjuster surface.

10. An assembly according to claim 8, wherein the first cylindrical lash adjuster surface is concentric relative to the outer lash adjuster surface.

11. An assembly according to claim 8, wherein the socket body cooperates with the leakdown plunger to define at least in part a chamber within the inner plunger surface.

12. An assembly according to claim 8, wherein the cylindrical plunger surface cooperates with the inner lash adjuster surface to provide a chamber.

13. An assembly according to claim 8, wherein at least one of the socket body, the leakdown plunger, and the lash adjuster body is fabricated at least in part through forging.

14. An assembly according to claim 8, wherein the insert is located within the lash adjuster well and comprises an insert spring, a spherical valve insert member at least partially located within the plunger hole and configured to operate with the insert spring, a cap shaped to at least partially cover both the spherical valve insert member and the insert spring so that the cap at least partially depresses the insert spring and the insert spring exerts a force on the spherical valve insert member, and a cap spring located within the lash adjuster well around a portion of the cap.

15. An assembly according to claim 8, wherein the spherical valve insert member is configured to operate with the insert spring and is at least partially located within the plunger hole, the cap spring is located around a portion of the cap, and the cap is shaped to at least partially cover both the spherical valve insert member and the insert spring so that the cap at least partially depresses the insert spring and the insert spring exerts a force on the spherical valve insert member.

16. An assembly, comprising:

a) a socket body including a forgeable material and provided with an outer socket surface, a first socket surface, and a second socket surface, and a socket passage shaped to conduct fluid, wherein the outer socket surface is configured to cooperate with the inner surface of an engine workpiece, the first socket surface includes a push rod cooperating surface defining a socket hole that fluidly links the first socket surface with the socket passage, the second socket surface defines a second socket hole that fluidly links the second socket surface with the socket passage and includes a plunger reservoir passage configured to conduct fluid and a curved socket surface configured to cooperate with a leakdown plunger, and the socket body cooperates with the leakdown plunger to define at least in part a chamber within an inner plunger surface; and b) the leakdown plunger is provided with a first plunger opening, a second plunger opening, and an outer plunger surface enclosing an inner plunger surface, wherein the first plunger opening is provided with an annular plunger surface that defines a plunger hole and that is shaped to accommodate an insert comprising a spherical valve insert member, an insert spring, a cap, and a cap spring, the outer plunger surface includes a cylindrical plunger surface and an undercut plunger surface wherein the undercut plunger surface is cylindrically shaped, concentric relative to the cylindrical plunger surface, located at an end of the plunger body, and cooperates with another body to form a leakdown path for a liquid, and the inner plunger surface is fluidly linked to the outer socket surface by the plunger reservoir passage and includes a plurality of inner cylindrical plunger surfaces and an inner conical plunger surface that functions to increase the quantity of retained fluid in the chamber.

17. An assembly according to claim 16, wherein the first and second plunger openings are provided with chamfered plunger surfaces.

18. An assembly according to claim 16, wherein a diameter of the undercut plunger surface is smaller than a diameter of the cylindrical plunger surface.

19. An assembly according to claim 16, wherein at least one of the socket body, the leakdown plunger, and the engine workpiece is fabricated at least in part through forging.

20. An assembly according to claim 16, wherein the leakdown plunger includes a forgeable material.

21. An assembly according to claim 16, wherein the outer plunger surface includes an outer conical plunger surface located between the cylindrical plunger surface and the undercut plunger surface.

22. An assembly according to claim 16, wherein the inner plunger surface includes a first inner conical plunger surface and a second inner conical plunger surface, a first inner cylindrical plunger surface, and a second inner cylindrical plunger surface.

* * * * *